US011545099B2

(12) United States Patent
Huangfu et al.

(10) Patent No.: US 11,545,099 B2
(45) **Date of Patent: *Jan. 3, 2023**

(54) DISPLAY APPARATUS HAVING DRIVING CIRCUIT FOR DERIVING ACTUAL DATA SIGNAL BASED ON THEORETICAL DATA SIGNAL

(71) Applicant: BOE Technology Group Co., Ltd., Beijing (CN)

(72) Inventors: Lujiang Huangfu, Beijing (CN); Zhenzhen Li, Beijing (CN); Wenjing Tan, Beijing (CN)

(73) Assignee: Beijing BOE Technology Development Co., Ltd., Beijing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/497,630

(22) Filed: Oct. 8, 2021

(65) Prior Publication Data

US 2022/0028348 A1 Jan. 27, 2022

Related U.S. Application Data

(63) Continuation of application No. 16/626,559, filed as application No. PCT/CN2019/097765 on Jul. 25, 2019, now Pat. No. 11,238,816.

(30) Foreign Application Priority Data

Dec. 13, 2018 (CN) ..... 201811525578.3

(51) Int. Cl.
*G09G 3/36* (2006.01)
*G09G 3/20* (2006.01)
*G09G 3/3208* (2016.01)

(52) U.S. Cl.
CPC ..... *G09G 3/3607* (2013.01); *G09G 3/2003* (2013.01); *G09G 3/3208* (2013.01);
(Continued)

(58) Field of Classification Search
CPC ..... G09G 3/3607; G09G 2300/0452; G09G 3/2003; G09G 2340/0457
See application file for complete search history.

(56) References Cited

U.S. PATENT DOCUMENTS 4,491,863 A 1/1985 Kurahashi
4,652,912 A 3/1987 Masubuchi
(Continued)

FOREIGN PATENT DOCUMENTS

CN 101339729 B 1/2009
CN 101582241 A 11/2009
(Continued)

OTHER PUBLICATIONS

First Office Action in the Indian Patent Application No. 202027048001, dated Dec. 6, 2021.
(Continued)

*Primary Examiner* — Michael J Jansen, II
(74) *Attorney, Agent, or Firm* — Intellectual Valley Law, P.C.

(57) ABSTRACT

A display apparatus is provided. The A display apparatus includes a plurality of subpixels, the plurality of subpixels comprising a plurality of first subpixels, a plurality of second subpixels, and a plurality of third subpixels. The plurality of third subpixels are arranged in an array of I columns and J rows. The display apparatus includes a plurality of repeating units. A respective repeating unit of the plurality of repeating units includes one of the plurality of first subpixels, one of the plurality of second subpixels, and two of the plurality third subpixels. The two of the plurality third subpixels in the respective repeating unit are arranged along a first direction or a second direction, the one of the plurality of first subpixels and the one of the plurality of second sub-
(Continued)

pixels in the respective repeating unit are arranged along the second direction or the first direction.

16 Claims, 20 Drawing Sheets

(52) U.S. Cl.
CPC ..... *G09G 3/36* (2013.01); *G09G 2300/0452* (2013.01); *G09G 2360/16* (2013.01)

(56) References Cited

U.S. PATENT DOCUMENTS

| | | | | |
|---|---|---|---|---|
| 5,113,274 | A | 5/1992 | Takahashi et al. | |
| 6,681,053 | B1 | 1/2004 | Zhu | |
| 6,950,115 | B2 | 9/2005 | Brown Elliott | |
| 7,123,277 | B2 | 10/2006 | Brown Elliott et al. | |
| 7,525,526 | B2 * | 4/2009 | Brown Elliott | G06T 3/4007 345/87 |
| 8,446,435 | B2 | 5/2013 | Tomizawa et al. | |
| 8,754,913 | B2 * | 6/2014 | Hwang | G09G 3/20 345/55 |
| 9,542,875 | B2 | 1/2017 | Yang et al. | |
| 9,589,492 | B2 | 3/2017 | Feng | |
| 9,647,039 | B1 * | 5/2017 | Wang | H01L 27/3218 |
| 9,734,753 | B2 * | 8/2017 | Li | G11C 19/287 |
| 9,818,803 | B2 | 11/2017 | Lee et al. | |
| 9,941,334 | B2 | 4/2018 | Hsu et al. | |
| 9,946,123 | B2 * | 4/2018 | Huangfu | G02F 1/13439 |
| 10,147,351 | B2 | 12/2018 | Yang et al. | |
| 10,181,499 | B2 * | 1/2019 | Jo | H01L 27/3276 |
| 10,210,787 | B2 * | 2/2019 | Jin | H01L 27/3213 |
| 10,274,654 | B2 * | 4/2019 | Jin | G02F 1/134309 |
| 10,283,086 | B1 * | 5/2019 | Su | G09G 3/20 |
| 10,373,541 | B2 * | 8/2019 | Lee | G09G 3/2003 |
| 10,504,483 | B2 * | 12/2019 | Chen | G09G 5/005 |
| 10,565,918 | B2 * | 2/2020 | Wu | H01L 27/3218 |
| 10,629,656 | B2 | 4/2020 | Jo et al. | |
| 10,840,307 | B2 | 11/2020 | Gu et al. | |
| 10,867,545 | B2 * | 12/2020 | Kirisken | G09G 3/32 |
| 10,903,281 | B2 | 1/2021 | Chung et al. | |
| 10,943,955 | B2 * | 3/2021 | Wang | H01L 27/3216 |
| 11,004,905 | B2 | 5/2021 | Sun et al. | |
| 11,043,539 | B2 | 6/2021 | Jo et al. | |
| 11,062,637 | B2 | 7/2021 | Jeong et al. | |
| 11,238,816 | B2 * | 2/2022 | Huangfu | G09G 3/3607 |
| 11,380,236 | B2 * | 7/2022 | Zhang | H01L 51/56 |
| 2003/0034992 | A1 * | 2/2003 | Brown Elliott | G09G 3/2003 345/690 |
| 2004/0046714 | A1 * | 3/2004 | Brown Elliott | G09G 3/2003 345/55 |
| 2005/0088385 | A1 | 4/2005 | Elliott et al. | |
| 2008/0001525 | A1 * | 1/2008 | Chao | H01L 27/3218 313/503 |
| 2009/0021534 | A1 * | 1/2009 | Tomizawa | G09G 3/3607 345/55 |
| 2011/0260951 | A1 * | 10/2011 | Hwang | G09G 3/20 345/55 |
| 2013/0234917 | A1 * | 9/2013 | Lee | H01L 27/3216 345/82 |
| 2014/0071175 | A1 | 3/2014 | Yang et al. | |
| 2015/0015466 | A1 | 1/2015 | Feng | |
| 2015/0015600 | A1 * | 1/2015 | Yang | G09G 3/2003 345/600 |
| 2016/0019825 | A1 | 1/2016 | Guo et al. | |
| 2016/0357076 | A1 | 12/2016 | Huangfu et al. | |
| 2016/0358536 | A1 * | 12/2016 | Li | G09G 3/2096 |
| 2017/0039924 | A1 * | 2/2017 | Jin | G09G 3/2003 |
| 2017/0110087 | A1 | 4/2017 | Chen et al. | |
| 2017/0133440 | A1 * | 5/2017 | Wang | H01L 51/001 |
| 2017/0193880 | A1 | 7/2017 | Lee et al. | |
| 2017/0278905 | A1 | 9/2017 | Hsu et al. | |
| 2017/0294491 | A1 * | 10/2017 | Jo | H01L 27/3218 |
| 2018/0088260 | A1 | 3/2018 | Jin et al. | |
| 2018/0308412 | A1 * | 10/2018 | Wu | G09G 3/3258 |
| 2019/0081113 | A1 * | 3/2019 | Gu | G09G 3/2003 |
| 2019/0115399 | A1 * | 4/2019 | Jo | G09G 3/3225 |
| 2019/0139513 | A1 * | 5/2019 | Su | G09G 5/02 |
| 2019/0237518 | A1 * | 8/2019 | Sun | H01L 27/3218 |
| 2019/0340970 | A1 * | 11/2019 | Kirisken | G09G 3/32 |
| 2020/0013833 | A1 * | 1/2020 | Wang | H01L 27/3216 |
| 2020/0152712 | A1 * | 5/2020 | Chung | H01L 27/3218 |
| 2020/0176524 | A1 * | 6/2020 | Jo | H01L 27/3218 |
| 2020/0258441 | A1 * | 8/2020 | Zhang | G09G 3/2003 |
| 2020/0365070 | A1 * | 11/2020 | Jeong | G09G 3/2003 |
| 2021/0335297 | A1 * | 10/2021 | Huangfu | G09G 3/3208 |
| 2022/0028348 | A1 * | 1/2022 | Huangfu | G09G 3/3607 |

FOREIGN PATENT DOCUMENTS

| | | | |
|---|---|---|---|
| CN | 104597655 | A | 5/2015 |
| CN | 205355055 | U | 6/2016 |
| CN | 105741774 | A | 7/2016 |
| CN | 205845956 | U | 12/2016 |
| EP | 2423911 | A2 | 2/2012 |
| EP | 3306598 | A1 | 4/2018 |
| JP | 2010212814 | A | 9/2010 |
| WO | 2016192241 | A1 | 12/2016 |

OTHER PUBLICATIONS

First Office Action in the Chinese Patent Application No. 201811525578.3, dated Nov. 16, 2020; English translation attached.

Second Office Action in the Chinese Patent Application No. 201811525578.3, dated May 20, 2021; English translation attached.

International Search Report & Written Opinion dated Oct. 28, 2019, regarding PCT/CN2019/097765.

Notice of Allowance in the U.S. Appl. No. 16/626,559, dated Oct. 6, 2021.

Non-Final Office Action in the U.S. Appl. No. 16/626,559, dated Aug. 30, 2021.

Response to Non-Final Office Action in the U.S. Appl. No. 16/626,559, dated Sep. 24, 2021.

Extended European Search Report in the European Patent Application No. 19832268.7, dated Oct. 25, 2022.

* cited by examiner $$R^{0}_{i,j} = \left(\frac{r^{\gamma}_{i-1,j} + r^{\gamma}_{i,j}}{2}\right)^{\frac{1}{\gamma}}$$

$$G^{0}_{i,j} = g_{i,j}$$

$$B^{0}_{i+1,j} = \left(\frac{b^{\gamma}_{i,j} + b^{\gamma}_{i+1,j}}{2}\right)^{\frac{1}{\gamma}}$$

$$G^{0}_{i+1,j} = g_{i+1,j}$$

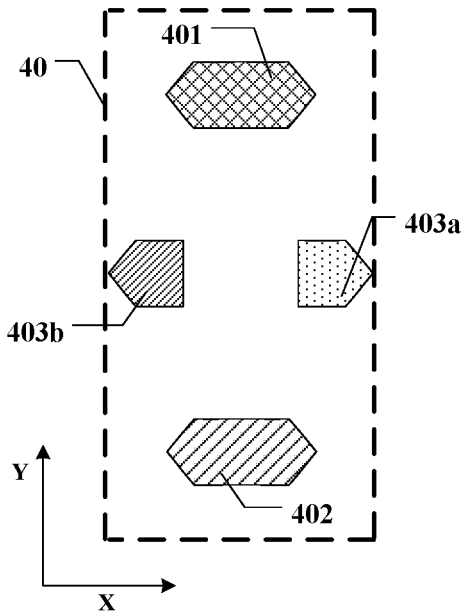

FIG. 9B

Deriving an first actual data signal of a subpixel of the plurality of first subpixels in an i-th column and in a j-th row, based on a theoretical data signal of a first logic subpixel of the first color from a first logic pixel in a (i-1)-th column and in a (j-1)-th row and a theoretical data signal of a first logic subpixel of the first color from a second logic pixel in the i-th column and the (j-1)-th row

↓

Deriving a second actual data signal of a subpixel of the plurality of third subpixels in the i-th column and in the j-th row, based on a theoretical data signal of a third logic subpixel of the third color from a third logic pixel in the i-th column and in the j-th row

↓

Deriving a third actual data signal of a subpixel of the plurality of second subpixels in the i-th column and in a (j+1)-th row, based on a theoretical data signal of a second logic subpixel of the second color from a fourth logic pixel in the (i-1)-th column and in the (j+1)-th row and a theoretical data signal of a second logic subpixel of the second color from a fifth logic pixel in the i-th column and in the (j+1)-th row

↓

Deriving a fourth actual data signal of a subpixel of the plurality of third subpixels in the (i-1)-th column and in the j-th row, based on a theoretical data signal of a third logic subpixel of the third color from a sixth logic pixel in the (i-1)-th column and in the j-th row

FIG. 10

DISPLAY APPARATUS HAVING DRIVING CIRCUIT FOR DERIVING ACTUAL DATA SIGNAL BASED ON THEORETICAL DATA SIGNAL

CROSS-REFERENCE TO RELATED APPLICATION

This application is a continuation of U.S. application Ser. No. 16/626,559, filed Jul. 25, 2019, which is a national stage application under 35 U.S.C. § 371 of International Application No. PCT/CN2019/097765, filed Jul. 25, 2019, which claims priority to Chinese Patent Application No. 201811525578.3, filed Dec. 13, 2018. Each of the forgoing applications is herein incorporated by reference in its entirety for all purposes.

TECHNICAL FIELD

The present invention relates to display technology, more particularly, to a method of driving a pixel arrangement structure having a plurality of subpixels, a driving chip for driving a pixel arrangement structure having a plurality of subpixels, a display apparatus, and a computer-program product.

BACKGROUND

Nowadays, display devices are required to have higher and higher resolutions. A display device having a high resolution can perform a high quality display. Usually, decreasing the size of each subpixel and distances between any two adjacent subpixels can increase the resolution of a display device. To decrease the size of each subpixel and distances between any two adjacent subpixels, the accuracy of fabricating the display device should be higher, resulting in increasing difficulties in fabricating the display device, and increasing cost of fabricating the display device.

Sup-Pixel Rendering takes advantage of the fact that human eyes have different sensitivities with respect to different colors. By changing a pixel arrangement that a pixel has a red subpixel, a green subpixel, and a blue subpixel into a pixel arrangement that two or more pixels share a subpixel having a selected color with respect to which the human eye has a relatively low sensitivity, a total number of subpixels can be decreased, but the display performance by the latter pixel arrangement can keep the same as the display performance by the former pixel arrangement. Reducing the total number of subpixels can reduce the difficulties to fabricate a display panel, and decreasing the cost of fabricating the display panel.

SUMMARY

In one aspect, the present invention provides a method of driving a pixel arrangement structure having a plurality of subpixels, comprising a plurality of first subpixels of a first color, a plurality of second subpixels of a second color, and a plurality of third subpixels of a third color; wherein the plurality of third subpixels are arranged in an array of I columns and J rows; and the pixel arrangement structure comprises a plurality of minimum translational repeating units, a respective one of the plurality of minimum translational repeating units comprising one of the plurality of first subpixels, one of the plurality of second subpixels, and two of the plurality third subpixels; wherein the method comprises deriving an first actual data signal of a subpixel of the plurality of first subpixels in an i-th column and in a j-th row, based on a theoretical data signal of a first logic subpixel of the first color from a first logic pixel in a (i−1)-th column and in a (j−1)-th row and a theoretical data signal of a first logic subpixel of the first color from a second logic pixel in the (i−1)-th column and the j-th row; deriving a second actual data signal of a subpixel of the plurality of third subpixels in the i-th column and in the j-th row, based on a theoretical data signal of a third logic subpixel of the third color from a third logic pixel in the i-th column and in the j-th row; deriving a third actual data signal of a subpixel of the plurality of second subpixels in an (i+1)-th column and in the j-th row, based on a theoretical data signal of a second logic subpixel of the second color from a fourth logic pixel in the (i+1)-th column and in the (j−1)-th row and a theoretical data signal of a second logic subpixel of the second color from a fifth logic pixel in the (i+1)-th column and in the j-th row; and deriving a fourth actual data signal of a subpixel of the plurality of third subpixels in the i-th column and in the (j−1)-th row, based on a theoretical data signal of a third logic subpixel of the third color from a sixth logic pixel in the i-th column and in the (j−1)-th row; wherein $2 \le i \le I$, $2 \le j \le J$.

Optionally, the plurality of third subpixels are grouped into a plurality of virtual pixels arranged along a row direction and a column direction; the plurality of third subpixels are grouped into a plurality of pairs of adjacent third subpixels; wherein a respective one of the plurality of virtual pixels comprises a subpixel selected from the respective one of the plurality of pairs of adjacent third subpixels; and a subpixel selected from the respective one of the plurality of first subpixels and the respective one of the second subpixels; wherein a first virtual pixel of the plurality of virtual pixels in the i-th column and in the j-th row of an array of the plurality of virtual pixels comprises the subpixel of the plurality of first subpixels in the i-th column and in the j-th row and the subpixel of the plurality of third subpixels in the i-th column and in the j-th row in a same minimum translational repeating unit; a second virtual pixel of the plurality of virtual pixels in the (i+1)-th column and in the j-th row of the array of the plurality of virtual pixels comprises the subpixel of the plurality of second subpixels in the (i+1)-th column and in the j-th row in the same minimum translational repeating unit; and a third virtual pixel of the plurality of virtual pixels in the i-th column and in the (j−1)-th row of the array of the plurality of virtual pixels comprises a subpixel of the plurality of third subpixels in the i-th column and in the (j−1)-th row in the same minimum translational repeating unit; and the subpixel of the plurality of third subpixels in the i-th column and in the j-th row and the subpixel of the plurality of third subpixels in the i-th column and in the (j−1)-th row are grouped into one of the plurality of pairs of adjacent third subpixels.

Optionally, the first actual data signal of the subpixel of the plurality of first subpixels in the i-th column and in the j-th row is represented by a following equation $$X_{i,j} = (\alpha_1 \cdot x_{i-1,j-1}^{\gamma}\ \alpha_2 \cdot x_{i-1,j}^{\gamma})^{\frac{1}{\gamma}};$$

wherein $X_{i,j}$ represents the first actual data signal of the subpixel of the plurality of first subpixels in the i-th column and in the j-th row; $x_{i-1,j-1}$ represents the theoretical data signal of the first logic subpixel of the first color from the first logic pixel in the (i−1)-th column and in the (j−1)-th row; $x_{i-1,j}$ represents the theoretical data signal of the first logic subpixel of the first color from the second logic pixel in the (i−1)-th column and the j-th row; $\alpha_1$ represents a weight of the $x_{i-1,j-1}$; $\alpha_2$ represents a weight of the $x_{i-1,j}$; and $\gamma$ is a constant; the second actual data signal of the subpixel of the plurality of third subpixels in the i-th column and in the j-th row is represented by a following equation $G_{i,j}=g_{i,j}$; wherein $G_{i,j}$ represents the second actual data signal of the subpixel of the plurality of third subpixels in the i-th column and in the j-th row; $g_{i,j}$ represents the theoretical data signal of the third logic subpixel of the third color from the third logic pixel in the i-th column and in the j-th row; the third actual data signal of the subpixel of the plurality of second subpixels in an (i+1)-th column and in the j-th row is represented by a following equation $$Y_{i+1,j} = (\beta_1 \cdot y^{\gamma}_{i+1,j-1} + \beta_2 \cdot y^{\gamma}_{i+1,j})^{\frac{1}{\gamma}};$$

wherein $Y_{i+1,j}$ represents the third actual data signal of the subpixel of the plurality of second subpixels in an (i+1)-th column and in the j-th row; $y_{i+1,j-1}$ represents the theoretical data signal of the second logic subpixel of the second color from the fourth logic pixel in the (i+1)-th column and in the (j−1)-th row; $y_{i+1,j}$ represents the theoretical data signal of the second logic subpixel of the second color from the fifth logic pixel in the (i+1)-th column and in the j-th row; $\beta_1$ represents a weight of the $y_{i+1,j-1}$; $\beta_2$ represents a weight of the $y_{i+1,j}$, and $\gamma$ is a constant; the fourth actual data signal of the subpixel of the plurality of third subpixels in the i-th column and in the (j−1)-th row is represented by a following equation $G_{i,j-1}=g_{i,j-1}$; wherein $G_{i,j-1}$ represents the fourth actual data signal of the subpixel of the plurality of third subpixels in the i-th column and in the (j−1)-th row; and $g_{i,j-1}$ represents the theoretical data signal of the third logic subpixel of the third color from the sixth logic pixel in the i-th column and in the (j−1)-th row.

Optionally, each of the $\alpha_1$ and the $\alpha_2$ is 0.5; and each of the $\beta_1$ and the $\beta_2$ is 0.5.

Optionally, the third color is green; and the first color and the second color are two different colors selected from red, and blue.

Optionally, the row direction and column direction are substantially perpendicular to each other.

Optionally, the respective one of the plurality of first subpixels has a substantial hexagonal shape; the respective one of the plurality of second subpixels has a substantial hexagonal shape; any two sides of the substantial hexagonal shape facing each other are substantially parallel to each other; each of the respective one of a plurality of pairs of adjacent third subpixels has a substantial pentagonal shape; the substantial pentagonal shape has two substantially parallel sides, and a base side substantially perpendicular to the two substantially parallel sides and connecting the substantially parallel sides; a base side of the first one of the respective one of the plurality of pairs of adjacent third subpixels is in direct adjacent to a base side of the second one of the respective one of a plurality of pairs of adjacent third subpixels; and a pair of sides having a longest length among six sides of the respective one of the plurality of first subpixels, a pair of sides having a longest length among six sides of the respective one of the plurality of second subpixels, and the two substantially parallel sides of the each of the respective one of a plurality of pairs of adjacent third subpixels are substantially parallel.

Optionally, one of the plurality of first subpixels and one of the plurality of second subpixels in the respective one of the plurality of minimum translational repeating units are aligned along the row direction; and a respective one pair of the plurality of pairs of adjacent third subpixels in the respective one of the plurality of minimum translational repeating units are aligned along the column direction.

Optionally, in the respective one of the plurality of minimum translational repeating units, orthographic projections of a respective one pair of the plurality of pairs of adjacent third subpixels on a plane perpendicular to the column direction are between an orthographic projection of a respective one of the plurality of first subpixels on the plane perpendicular to the column direction and an orthographic projection of a respective one of the plurality of second subpixels on the plane perpendicular to the column direction.

Optionally, the pixel arrangement structure comprises a plurality of repeating rows; a respective one of the plurality of repeating rows comprises a selected number of minimum translational repeating units arranged along a row direction; the plurality of repeating rows are arranged along a column direction; and the row direction and the column direction are not parallel to each other.

In another aspect, the present invention provides a driving chip for driving a pixel arrangement structure having a plurality of subpixels; wherein the plurality of subpixels comprises a plurality of first subpixels of a first color, a plurality of second subpixels of a second color, and a plurality of third subpixels of a third color; the plurality of third subpixels are arranged in an array of I columns and J rows; and the pixel arrangement structure comprises a plurality of minimum translational repeating units, a respective one of the plurality of minimum translational repeating units comprising one of the plurality of first subpixels, one of the plurality of second subpixels, and two of the plurality third subpixels; wherein the driving chip comprises a memory; and one or more processors; wherein the memory and the one or more processors are connected with each other; and the memory stores computer-executable instructions for controlling the one or more processors to derive an first actual data signal of a subpixel of the plurality of first subpixels in an i-th column and in a j-th row, based on a theoretical data signal of a first logic subpixel of the first color from a first logic pixel in a (i−1)-th column and in a (j−1)-th row and a theoretical data signal of a first logic subpixel of the first color from a second logic pixel in the (i−1)-th column and the j-th row; derive a second actual data signal of a subpixel of the plurality of third subpixels in the i-th column and in the j-th row, based on a theoretical data signal of a third logic subpixel of the third color from a third logic pixel in the i-th column and in the j-th row; derive a third actual data signal of a subpixel of the plurality of second subpixels in an (i+1)-th column and in the j-th row, based on a theoretical data signal of a second logic subpixel of the second color from a fourth logic pixel in the (i+1)-th column and in the (j−1)-th row and a theoretical data signal of a second logic subpixel of the second color from a fifth logic pixel in the (i+1)-th column and in the j-th row; and derive a fourth actual data signal of a subpixel of the plurality of third subpixels in the i-th column and in the (j−1)-th row, based on a theoretical data signal of a third logic subpixel of the third color from a sixth logic pixel in the i-th column and in the (j−1)-th row; wherein $2 \le i \le I$, $2 \le j \le J$.

In another aspect, the present invention provides a display apparatus, comprising the driving chip described herein one or more integrated circuits connected to the driving chip; and the pixel arrangement structure having the plurality of subpixels.

In another aspect, the present invention provides a computer-program product comprising a non-transitory tangible computer-readable medium having computer-readable instructions thereon, the computer-readable instructions being executable by a processor to cause the processor to drive a pixel arrangement structure having a plurality of first subpixels of a first color, a plurality of second subpixels of a second color, and a plurality of third subpixels of a third color, and a plurality of third subpixels; wherein the plurality of third subpixels are arranged in an array of I columns and J rows; and the pixel arrangement structure comprises a plurality of minimum translational repeating units, a respective one of the plurality of minimum translational repeating units comprising one of the plurality of first subpixels, one of the plurality of second subpixels, and two of the plurality third subpixels; wherein driving the pixel arrangement structure comprises executing the computer-readable instructions by the processor to cause the processor to derive an first actual data signal of a subpixel of the plurality of first subpixels in an i-th column and in a j-th row, based on a theoretical data signal of a first logic subpixel of the first color from a first logic pixel in a (i−1)-th column and in a (j−1)-th row and a theoretical data signal of a first logic subpixel of the first color from a second logic pixel in the (i−1)-th column and the j-th row; derive a second actual data signal of a subpixel of the plurality of third subpixels in the i-th column and in the j-th row, based on a theoretical data signal of a third logic subpixel of the third color from a third logic pixel in the i-th column and in the j-th row; derive a third actual data signal of a subpixel of the plurality of second subpixels in an (i+1)-th column and in the j-th row, based on a theoretical data signal of a second logic subpixel of the second color from a fourth logic pixel in the (i+1)-th column and in the (j−1)-th row and a theoretical data signal of a second logic subpixel of the second color from a fifth logic pixel in the (i+1)-th column and in the j-th row; and derive a fourth actual data signal of a subpixel of the plurality of third subpixels in the i-th column and in the (j−1)-th row, based on a theoretical data signal of a third logic subpixel of the third color from a sixth logic pixel in the i-th column and in the (j−1)-th row; wherein $2 \le i \le I$, $2 \le j \le J$.

In another aspect, the present invention provides a method of driving a pixel arrangement structure having a plurality of subpixels comprising a plurality of first subpixels of a first color, a plurality of second subpixels of a second color, and a plurality of third subpixels of a third color; wherein the plurality of third subpixels are arranged in an array of I columns and J rows; and the pixel arrangement structure comprises a plurality of minimum translational repeating units, a respective one of the plurality of minimum translational repeating units comprising one of the plurality of first subpixels, one of the plurality of second subpixels, and two of the plurality third subpixels; wherein the method comprises deriving an first actual data signal of a subpixel of the plurality of first subpixels in an i-th column and in a j-th row, based on a theoretical data signal of a first logic subpixel of the first color from a first logic pixel in a (i−1)-th column and in a (j−1)-th row and a theoretical data signal of a first logic subpixel of the first color from a second logic pixel in the i-th column and the (j−1)-th row; deriving a second actual data signal of a subpixel of the plurality of third subpixels in the i-th column and in the j-th row, based on a theoretical data signal of a third logic subpixel of the third color from a third logic pixel in the i-th column and in the j-th row; deriving a third actual data signal of a subpixel of the plurality of second subpixels in the i-th column and in a (j+1)-th row, based on a theoretical data signal of a second logic subpixel of the second color from a fourth logic pixel in the (i−1)-th column and in the (j+1)-th row and a theoretical data signal of a second logic subpixel of the second color from a fifth logic pixel in the i-th column and in the (j+1)-th row; and deriving a fourth actual data signal of a subpixel of the plurality of third subpixels in the (i−1)-th column and in the j-th row, based on a theoretical data signal of a third logic subpixel of the third color from a sixth logic pixel in the (i−1)-th column and in the j-th row; wherein $2 \le i \le I$, $2 \le j \le J$.

Optionally, the plurality of third subpixels are grouped into a plurality of virtual pixels arranged along a row direction and a column direction; the plurality of third subpixels are grouped into a plurality of pairs of adjacent third subpixels; wherein a respective one of the plurality of virtual pixels comprises: a subpixel selected from the respective one of the plurality of pairs of adjacent third subpixels; and a subpixel selected from the respective one of the plurality of first subpixels and the respective one of the second subpixels; wherein a first virtual pixel of the plurality of virtual pixels in the i-th column and in the j-th row of an array of the plurality of virtual pixels comprises the subpixel of the plurality of first subpixels in the i-th column and in the j-th row and the subpixel of the plurality of third subpixels in the i-th column and in the j-th row in a same minimum translational repeating unit; a second virtual pixel of the plurality of virtual pixels in the i-th column and in the (j+1)-th row of the array of the plurality of virtual pixels comprises the subpixel of the plurality of second subpixels in the i-th column and in the (j+1)-th row in the same minimum translational repeating unit; and a third virtual pixel of the plurality of virtual pixels in the (i−1)-th column and in the j-th row of the array of the plurality of virtual pixels comprises the subpixel of the plurality of third subpixels in the (i−1)-th column and in the j-th row in the same minimum translational repeating unit; the subpixel of the plurality of third subpixels in the i-th column and in the j-th row and the subpixel of the plurality of third subpixels in the (i−1)-th column and in the j-th row are grouped into one of the plurality of pairs of adjacent third subpixels.

Optionally, the first actual data signal of the subpixel of the plurality of first subpixels in the i-th column and in the j-th row is represented by a following equation $$X_{i,j} = (\alpha_1 \cdot x_{i-1,j-1}^{\gamma}\ \alpha_2 \cdot x_{i-1,j}^{\gamma})^{\frac{1}{\gamma}};$$

wherein $X_{i,j}$ represents the first actual data signal of a subpixel of the plurality of first subpixels in an i-th column and in a j-th row; $x_{i-1,j-1}$ represents the theoretical data signal of the first logic subpixel of the first color from the first logic pixel in the (i−1)-th column and in the (j−1)-th row; $x_{i,j-1}$ represents the theoretical data signal of the first logic subpixel of the first color from the second logic pixel in the i-th column and the (j−1)-th row; $\alpha_1$ represents a weight of the $x_{i-1,j-1}$; $\alpha_2$ represents a weight of the $x_{i,j-1}$; and $\gamma$ is a constant; the second actual data signal of the subpixel of the plurality of third subpixels in the i-th column and in the j-th row is represented by a following equation $G_{i,j}=g_{i,j}$; wherein $G_{i,j}$ represents the second actual data signal of the subpixel of the plurality of third subpixels in the i-th column and in the j-th row; $g_{i,j}$ represents the theoretical data signal of the third logic subpixel of the third color from the third logic pixel in the i-th column and in the j-th row; the third actual data signal of the subpixel of the plurality of second subpixels in the i-th column and in the (j+1)-th row is represented by a following equation $$Y_{i+1,j} = (\beta_1 \cdot y_{i+1,j-1}^{\gamma} + \beta_2 \cdot y_{i+1,j}^{\gamma})^{\frac{1}{\gamma}};$$

wherein $Y_{i,j+1}$ represents third actual data signal of the subpixel of the plurality of second subpixels in the i-th column and in the (j+1)-th row; $y_{i-1,j+1}$ represents the theoretical data signal of the second logic subpixel of the second color from the fourth logic pixel in the (i−1)-th column and in the (j+1)-th row; $y_{i,j+1}$ represents the theoretical data signal of the second logic subpixel of the second color from the fifth logic pixel in the i-th column and in the (j+1)-th row; $\beta_1$ represents a weight of the $y_{i-1,j+1}$; $\beta_2$ represents a weight of the $y_{i,j+1}$, and $\gamma$ is a constant; the fourth actual data signal of the subpixel of the plurality of third subpixels in the (i−1)-th column and in the j-th row is represented by a following equation $G_{i-1,j}=g_{i-1,j}$; wherein $G_{i-1,j}$ represents the fourth actual data signal of the subpixel of the plurality of third subpixels in the (i−1)-th column and in the j-th row; and $g_{i-1,j}$ represents theoretical data signal of the third logic subpixel of the third color from the sixth logic pixel in the (i−1)-th column and in the j-th row.

Optionally, each of the $\alpha_1$ and the $\alpha_2$ is 0.5; and each of the $\beta_1$ and the $\beta_2$ is 0.5.

In another aspect, the present invention provides a driving chip for driving a pixel arrangement structure having a plurality of subpixels; wherein the plurality of subpixels comprises a plurality of first subpixels of a first color, a plurality of second subpixels of a second color, and a plurality of third subpixels of a third color; the plurality of third subpixels are arranged in an array of I columns and J rows; and the pixel arrangement structure comprises a plurality of minimum translational repeating units, a respective one of the plurality of minimum translational repeating units comprising one of the plurality of first subpixels, one of the plurality of second subpixels, and two of the plurality third subpixels; wherein the driving chip comprises a memory; and one or more processors; wherein the memory and the one or more processors are connected with each other; and the memory stores computer-executable instructions for controlling the one or more processors to derive an first actual data signal of a subpixel of the plurality of first subpixels in an i-th column and in a j-th row, based on a theoretical data signal of a first logic subpixel of the first color from a first logic pixel in a (i−1)-th column and in a (j−1)-th row and a theoretical data signal of a first logic subpixel of the first color from a second logic pixel in the i-th column and the (j−1)-th row; derive a second actual data signal of a subpixel of the plurality of third subpixels in the i-th column and in the j-th row, based on a theoretical data signal of a third logic subpixel of the third color from a third logic pixel in the i-th column and in the j-th row; derive a third actual data signal of a subpixel of the plurality of second subpixels in the i-th column and in a (j+1)-th row, based on a theoretical data signal of a second logic subpixel of the second color from a fourth logic pixel in the (i−1)-th column and in the (j+1)-th row and a theoretical data signal of a second logic subpixel of the second color from a fifth logic pixel in the i-th column and in the (j+1)-th row; and derive a fourth actual data signal of a subpixel of the plurality of third subpixels in the (i−1)-th column and in the j-th row, based on a theoretical data signal of a third logic subpixel of the third color from a sixth logic pixel in the (i−1)-th column and in the j-th row; wherein $2 \le i \le I$, $2 \le j \le J$.

In another aspect, the present invention provides a display apparatus, comprising the driving chip described herein; one or more integrated circuits connected to the driving chip; and the pixel arrangement structure having the plurality of subpixels.

In another aspect, the present invention provides a computer-program product comprising a non-transitory tangible computer-readable medium having computer-readable instructions thereon, the computer-readable instructions being executable by a processor to cause the processor to drive a pixel arrangement structure having a plurality of first subpixels of a first color, a plurality of second subpixels of a second color, and a plurality of third subpixels of a third color; wherein the plurality of third subpixels are arranged in an array of I columns and J rows; and the pixel arrangement structure comprises a plurality of minimum translational repeating units, a respective one of the plurality of minimum translational repeating units comprising one of the plurality of first subpixels, one of the plurality of second subpixels, and two of the plurality third subpixels; wherein driving the pixel arrangement structure comprises executing the computer-readable instructions by the processor to cause the processor to derive an first actual data signal of a subpixel of the plurality of first subpixels in an i-th column and in a j-th row, based on a theoretical data signal of a first logic subpixel of the first color from a first logic pixel in a (i−1)-th column and in a (j−1)-th row and a theoretical data signal of a first logic subpixel of the first color from a second logic pixel in the i-th column and the (j−1)-th row; derive a second actual data signal of a subpixel of the plurality of third subpixels in the i-th column and in the j-th row, based on a theoretical data signal of a third logic subpixel of the third color from a third logic pixel in the i-th column and in the j-th row; derive a third actual data signal of a subpixel of the plurality of second subpixels in the i-th column and in a (j+1)-th row, based on a theoretical data signal of a second logic subpixel of the second color from a fourth logic pixel in the (i−1)-th column and in the (j+1)-th row and a theoretical data signal of a second logic subpixel of the second color from a fifth logic pixel in the i-th column and in the (j+1)-th row; and derive a fourth actual data signal of a subpixel of the plurality of third subpixels in the (i−1)-th column and in the j-th row, based on a theoretical data signal of a third logic subpixel of the third color from a sixth logic pixel in the (i−1)-th column and in the j-th row; wherein $2 \le i \le I$, $2 \le j \le J$.

In another aspect, the present disclosure provides a display apparatus, comprising a plurality of subpixels, the plurality of subpixels comprising a plurality of first subpixels, a plurality of second subpixels, and a plurality of third subpixels; wherein the plurality of third subpixels are arranged in an array of I columns and J rows; and the display apparatus comprises a plurality of repeating units, a respective repeating unit of the plurality of repeating units comprising one of the plurality of first subpixels, one of the plurality of second subpixels, and two of the plurality third subpixels; the two of the plurality third subpixels in the respective repeating unit are arranged along a first direction, the one of the plurality of first subpixels and the one of the plurality of second subpixels in the respective repeating unit are arranged along a second direction, or the two of the plurality third subpixels in the respective repeating unit are arranged along the second direction, the one of the plurality of first subpixels and the one of the plurality of second subpixels in the respective repeating unit are arranged along the first direction, the first direction and the second direction are non-parallel to each other; the plurality of repeating units are arranged along the first direction, forming multiple repeating groups, the multiple repeating group arranged along the second direction; the display apparatus comprises a plurality of virtual pixels, a respective virtual pixel comprises a respective third subpixel of the plurality third subpixels, and at least one of a respective first subpixel of plurality of first subpixels or a respective second subpixel of the plurality of second subpixels; the plurality of virtual pixels are arranged in an array comprising a plurality of rows of virtual pixels arranged along the first direction and a plurality of columns of virtual pixels arranged along the second direction; the two of the plurality third subpixels in the respective repeating unit are in two adjacent rows of virtual pixels, respectively, and in a same column of virtual pixels, a first virtual pixel comprising at least one third subpixel belonging to a first adjacent repeating group of the multiple repeating group and a second virtual pixel comprising at least one third subpixel belonging to a second adjacent repeating group of the multiple repeating group are in a same column of virtual pixels, the first adjacent repeating group and the second adjacent repeating group directly adjacent to each other; and the display apparatus further comprises a driving circuit configured to drive image display according to the array of virtual pixels, at least a virtual pixel shares a first subpixel or a second subpixel belonging to an adjacent virtual pixel so that when the virtual pixel is driven to display image, the first subpixel or the second subpixel belonging to the adjacent virtual pixel also emits light.

Optionally, the one of the plurality of first subpixels in the respective repeating unit is a first subpixel in an i-th column and in a j-th row, the one of the plurality of second subpixels in the respective repeating unit is a second subpixel in an (i+1)-th column and in the j-th row, the two of the plurality third subpixels in the respective repeating unit are a third subpixel in the i-th column and in a (j−1)-th row and a third subpixel in the i-th column and in the j-th row, respectively; and the two of the plurality third subpixels in the respective repeating unit belong to a virtual pixel in the i-th column and in the j-th row and a virtual pixel in the i-th column and in a (j−1)-th row, respectively, the one of the plurality of first subpixels in the respective repeating unit belongs to a virtual pixel in an (i−1)-th column and in the (j−1)-th row, the one of the plurality of second subpixels in the respective repeating unit belongs to a virtual pixel in the (i+1)-th column and in the j-th row.

Optionally, the driving circuit is configured to derive a first actual data signal of a subpixel of the plurality of first subpixels in an i-th column and in a j-th row, based on a theoretical data signal of a first logic subpixel from a first logic pixel in a (i−1)-th column and in a (j−1)-th row and a theoretical data signal of a first logic subpixel from a second logic pixel in the (i−1)-th column and the j-th row; derive a second actual data signal of a subpixel of the plurality of third subpixels in the i-th column and in the j-th row, based on a theoretical data signal of a third logic subpixel from a third logic pixel in the i-th column and in the j-th row; derive a third actual data signal of a subpixel of the plurality of second subpixels in an (i+1)-th column and in the j-th row, based on a theoretical data signal of a second logic subpixel from a fourth logic pixel in the (i+1)-th column and in the (j−1)-th row and a theoretical data signal of a second logic subpixel from a fifth logic pixel in the (i+1)-th column and in the j-th row; and derive a fourth actual data signal of a subpixel of the plurality of third subpixels in the i-th column and in the (j−1)-th row, based on a theoretical data signal of a third logic subpixel from a sixth logic pixel in the i-th column and in the (j−1)-th row; wherein $2 \le i \le I$, $2 \le j \le J$.

Optionally, the first logic pixel in a (i−1)-th column and in a (j−1)-th row, the second logic pixel in the (i−1)-th column and the j-th row, the third logic pixel in the i-th column and in the j-th row, the fourth logic pixel in the (i+1)-th column and in the (j−1)-th row, the fifth logic pixel in the (i+1)-th column and in the j-th row, and the sixth logic pixel in the i-th column and in the (j−1)-th row, are pixels in a true red-green-blue (RGB) pixel mode; the theoretical data signal of the first logic subpixel from the first logic pixel in the (i−1)-th column and in the (j−1)-th row is a data signal of a subpixel in the true RGB pixel mode of a same color as the first subpixel in the i-th column and in the j-th row, the subpixel in a first logic pixel corresponding to a virtual pixel comprising the first subpixel in the i-th column and in the j-th row or a virtual pixel sharing the first subpixel in the i-th column and in the j-th row; the theoretical data signal of the first logic subpixel from the second logic pixel in the (i−1)-th column and the j-th row is a data signal of a subpixel in the true RGB pixel mode of a same color as the first subpixel in the i-th column and in the j-th row, the subpixel in a first logic pixel corresponding to a virtual pixel comprising the first subpixel in the i-th column and in the j-th row or a virtual pixel sharing the first subpixel in the i-th column and in the j-th row; the theoretical data signal of the third logic subpixel from the third logic pixel in the i-th column and in the j-th row is a data signal of a subpixel in the true RGB pixel mode of a same color as the third subpixel in the i-th column and in the j-th row, the subpixel in a first logic pixel corresponding to a virtual pixel comprising the third subpixel in the i-th column and in the j-th row; the theoretical data signal of the second logic subpixel from the fourth logic pixel in the (i+1)-th column and in the (j−1)-th row is a data signal of a subpixel in the true RGB pixel mode of a same color as the second subpixel in an (i+1)-th column and in the j-th row, the subpixel in a fourth logic pixel corresponding to a virtual pixel comprising the second subpixel in an (i+1)-th column and in the j-th row or a virtual pixel sharing the second subpixel in an (i+1)-th column and in the j-th row; the theoretical data signal of the second logic subpixel from the fifth logic pixel in the (i+1)-th column and in the j-th row is a data signal of a subpixel in the true RGB pixel mode of a same color as the second subpixel in an (i+1)-th column and in the j-th row, the subpixel in a fifth logic pixel corresponding to a virtual pixel comprising the second subpixel in an (i+1)-th column and in the j-th row or a virtual pixel sharing the second subpixel in an (i+1)-th column and in the j-th row; and the theoretical data signal of the third logic subpixel from the sixth logic pixel in the i-th column and in the (j−1)-th row is a data signal of a subpixel in the true RGB pixel mode of a same color as the third subpixel in the i-th column and in the (j−1)-th row, the subpixel in a sixth logic pixel corresponding to a virtual pixel comprising the third subpixel in the i-th column and in the (j−1)-th row or a virtual pixel sharing the third subpixel in the i-th column and in the (j−1)-th row.

Optionally, the one of the plurality of first subpixels in the respective repeating unit is a first subpixel in an i-th column and in a j-th row, the one of the plurality of second subpixels in the respective repeating unit is a second subpixel in an (i+1)-th column and in the j-th row, the two of the plurality third subpixels in the respective repeating unit are a third subpixel in the i-th column and in a (j−1)-th row and a third subpixel in the i-th column and in the j-th row, respectively;

and in the respective repeating unit, the first subpixel in the i-th column and in the j-th row and the third subpixel in the i-th column and in the j-th row belong to a virtual pixel in the i-th column and in the j-th row, the second subpixel in the (i+1)-th column and in the j-th row belongs to virtual pixel in the (i+1)-th column and in the j-th row, the third subpixel in the i-th column and in the (j−1)-th row belongs to virtual pixel in the i-th column and in the (j−1)-th row.

Optionally, the driving circuit is configured to derive a first actual data signal of a subpixel of the plurality of first subpixels in an i-th column and in a j-th row, based on a theoretical data signal of a first logic subpixel from a first logic pixel in a (i−1)-th column and in a (j−1)-th row and a theoretical data signal of a first logic subpixel from a second logic pixel in the (i−1)-th column and the j-th row; derive a second actual data signal of a subpixel of the plurality of third subpixels in the i-th column and in the j-th row, based on a theoretical data signal of a third logic subpixel from a third logic pixel in the i-th column and in the j-th row; derive a third actual data signal of a subpixel of the plurality of second subpixels in an (i+1)-th column and in the j-th row, based on a theoretical data signal of a second logic subpixel from a fourth logic pixel in the (i+1)-th column and in the (j−1)-th row and a theoretical data signal of a second logic subpixel from a fifth logic pixel in the (i+1)-th column and in the j-th row; and derive a fourth actual data signal of a subpixel of the plurality of third subpixels in the i-th column and in the (j−1)-th row, based on a theoretical data signal of a third logic subpixel from a sixth logic pixel in the i-th column and in the (j−1)-th row; wherein $2 \le i \le I$, $2 \le j \le J$.

Optionally, the first logic pixel in a (i−1)-th column and in a (j−1)-th row, the second logic pixel in the (i−1)-th column and the j-th row, the third logic pixel in the i-th column and in the j-th row, the fourth logic pixel in the (i+1)-th column and in the (j−1)-th row, the fifth logic pixel in the (i+1)-th column and in the j-th row, and the sixth logic pixel in the i-th column and in the (j−1)-th row, are pixels in a true red-green-blue (RGB) pixel mode; the theoretical data signal of the first logic subpixel from the first logic pixel in the (i−1)-th column and in the (j−1)-th row is a data signal of a subpixel in the true RGB pixel mode of a same color as the first subpixel in the i-th column and in the j-th row, the subpixel in a first logic pixel corresponding to a virtual pixel comprising the first subpixel in the i-th column and in the j-th row or a virtual pixel sharing the first subpixel in the i-th column and in the j-th row; the theoretical data signal of the first logic subpixel from the second logic pixel in the (i−1)-th column and the j-th row is a data signal of a subpixel in the true RGB pixel mode of a same color as the first subpixel in the i-th column and in the j-th row, the subpixel in a first logic pixel corresponding to a virtual pixel comprising the first subpixel in the i-th column and in the j-th row or a virtual pixel sharing the first subpixel in the i-th column and in the j-th row; the theoretical data signal of the third logic subpixel from the third logic pixel in the i-th column and in the j-th row is a data signal of a subpixel in the true RGB pixel mode of a same color as the third subpixel in the i-th column and in the j-th row, the subpixel in a first logic pixel corresponding to a virtual pixel comprising the third subpixel in the i-th column and in the j-th row; the theoretical data signal of the second logic subpixel from the fourth logic pixel in the (i+1)-th column and in the (j−1)-th row is a data signal of a subpixel in the true RGB pixel mode of a same color as the second subpixel in an (i+1)-th column and in the j-th row, the subpixel in a fourth logic pixel corresponding to a virtual pixel comprising the second subpixel in an (i+1)-th column and in the j-th row or a virtual pixel sharing the second subpixel in an (i+1)-th column and in the j-th row; the theoretical data signal of the second logic subpixel from the fifth logic pixel in the (i+1)-th column and in the j-th row is a data signal of a subpixel in the true RGB pixel mode of a same color as the second subpixel in an (i+1)-th column and in the j-th row, the subpixel in a fifth logic pixel corresponding to a virtual pixel comprising the second subpixel in an (i+1)-th column and in the j-th row or a virtual pixel sharing the second subpixel in an (i+1)-th column and in the j-th row; and the theoretical data signal of the third logic subpixel from the sixth logic pixel in the i-th column and in the (j−1)-th row is a data signal of a subpixel in the true RGB pixel mode of a same color as the third subpixel in the i-th column and in the (j−1)-th row, the subpixel in a sixth logic pixel corresponding to a virtual pixel comprising the third subpixel in the i-th column and in the (j−1)-th row or a virtual pixel sharing the third subpixel in the i-th column and in the (j−1)-th row.

Optionally, the first actual data signal of the subpixel of the plurality of first subpixels in the i-th column and in the j-th row is represented by a following equation:

$$X_{i,j} = (\alpha_1 \cdot x_{i-1,j-1}^{\gamma}\ \alpha_2 \cdot x_{i-1,j}^{\gamma})^{\frac{1}{\gamma}};$$

wherein $X_{i,j}$ represents the first actual data signal of the subpixel of the plurality of first subpixels in the i-th column and in the j-th row; $x_{i-1,j-1}$ represents the theoretical data signal of the first logic subpixel of the first color from the first logic pixel in the (i−1)-th column and in the (j−1)-th row; $x_{i-1,j}$ represents the theoretical data signal of the first logic subpixel of the first color from the second logic pixel in the (i−1)-th column and the j-th row; $\alpha_1$ represents a weight of the $x_{i-1,j-1}$; $\alpha_2$ represents a weight of the $x_{i-1,j}$; and $\gamma$ is a constant; the second actual data signal of the subpixel of the plurality of third subpixels in the i-th column and in the j-th row is represented by a following equation: $G_{i,j}=g_{i,j}$; wherein $G_{i,j}$ represents the second actual data signal of the subpixel of the plurality of third subpixels in the i-th column and in the j-th row; $g_{i,j}$ represents the theoretical data signal of the third logic subpixel of the third color from the third logic pixel in the i-th column and in the j-th row; the third actual data signal of the subpixel of the plurality of second subpixels in an (i+1)-th column and in the j-th row is represented by a following equation:

$$Y_{i+1,j} = (\beta_1 \cdot y_{i+1,j-1}^{\gamma} + \beta_2 \cdot y_{i+1,j}^{\gamma})^{\frac{1}{\gamma}};$$

wherein $Y_{i+1,j}$ represents the third actual data signal of the subpixel of the plurality of second subpixels in an (i+1)-th column and in the j-th row; $y_{i+1,j-1}$ represents the theoretical data signal of the second logic subpixel of the second color from the fourth logic pixel in the (i+1)-th column and in the (j−1)-th row; $y_{i+1,j}$ represents the theoretical data signal of the second logic subpixel of the second color from the fifth logic pixel in the (i+1)-th column and in the j-th row; $\beta_1$ represents a weight of the $y_{i+1,j-1}$; $\beta_2$ represents a weight of the $y_{i+1,j}$, and $\gamma$ is a constant; the fourth actual data signal of the subpixel of the plurality of third subpixels in the i-th column and in the (j−1)-th row is represented by a following equation: $G_{i,j-1}=g_{i,j-1}$; wherein $G_{i,j-1}$ represents the fourth actual data signal of the subpixel of the plurality of third subpixels in the i-th column and in the (j−1)-th row; and $g_{i,j-1}$ represents the theoretical data signal of the third logic subpixel of the third color from the sixth logic pixel in the i-th column and in the (j−1)-th row.

Optionally, the one of the plurality of first subpixels in the respective repeating unit is a first subpixel in an i-th column and in a j-th row, the one of the plurality of second subpixels in the respective repeating unit is a second subpixel in the i-th column and in the (j+1)-th row, the two of the plurality third subpixels in the respective repeating unit are a third subpixel in a (i−1)-th column and in the j-th row and a third subpixel in the i-th column and in the j-th row, respectively; and the two of the plurality third subpixels in the respective repeating unit belong to a virtual pixel in the i-th column and in the j-th row and a virtual pixel in the (i−1)-th column and in the j-th row, respectively, the one of the plurality of first subpixels in the respective repeating unit belongs to a virtual pixel in the (i−1)-th column and in the (j−1)-th row, the one of the plurality of second subpixels in the respective repeating unit belongs to a virtual pixel in the i-th column and in the (j+1)-th row.

Optionally, the driving circuit is configured to derive a first actual data signal of a subpixel of the plurality of first subpixels in an i-th column and in a j-th row, based on a theoretical data signal of a first logic subpixel from a first logic pixel in a (i−1)-th column and in a (j−1)-th row and a theoretical data signal of a first logic subpixel from a second logic pixel in the i-th column and the (j−1)-th row; derive a second actual data signal of a subpixel of the plurality of third subpixels in the i-th column and in the j-th row, based on a theoretical data signal of a third logic subpixel from a third logic pixel in the i-th column and in the j-th row; derive a third actual data signal of a subpixel of the plurality of second subpixels in the i-th column and in the (j+1)-th row, based on a theoretical data signal of a second logic subpixel from a fourth logic pixel in the (i−1)-th column and in the (j+1)-th row and a theoretical data signal of a second logic subpixel from a fifth logic pixel in the i-th column and in the (j+1)-th row; and derive a fourth actual data signal of a subpixel of the plurality of third subpixels in the (i−1)-th column and in the j-th row, based on a theoretical data signal of a third logic subpixel from a sixth logic pixel in the (i−1)-th column and in the j-th row; wherein $2 \le i \le I$, $2 \le j \le J$.

Optionally, the first logic pixel in a (i−1)-th column and in a (j−1)-th row, the second logic pixel in the i-th column and the (j−1)-th row, the third logic pixel in the i-th column and in the j-th row, the fourth logic pixel in the (i−1)-th column and in the (j+1)-th row, the fifth logic pixel in the i-th column and in the (j+1)-th row, and the sixth logic pixel in the (i−1)-th column and in the j-th row, are pixels in a true red-green-blue (RGB) pixel mode; the theoretical data signal of the first logic subpixel from the first logic pixel in the (i−1)-th column and in the (j−1)-th row is a data signal of a subpixel in the true RGB pixel mode of a same color as the first subpixel in the i-th column and in the j-th row, the subpixel in a first logic pixel corresponding to a virtual pixel comprising the first subpixel in the i-th column and in the j-th row or a virtual pixel sharing the first subpixel in the i-th column and in the j-th row; the theoretical data signal of the first logic subpixel from the second logic pixel in the i-th column and the (j−1)-th row is a data signal of a subpixel in the true RGB pixel mode of a same color as the first subpixel in the i-th column and in the j-th row, the subpixel in a first logic pixel corresponding to a virtual pixel comprising the first subpixel in the i-th column and in the j-th row or a virtual pixel sharing the first subpixel in the i-th column and in the j-th row; the theoretical data signal of the third logic subpixel from the third logic pixel in the i-th column and in the j-th row is a data signal of a subpixel in the true RGB pixel mode of a same color as the third subpixel in the i-th column and in the j-th row, the subpixel in a first logic pixel corresponding to a virtual pixel comprising the third subpixel in the i-th column and in the j-th row; the theoretical data signal of the second logic subpixel from the fourth logic pixel in the (i−1)-th column and in the (j+1)-th row is a data signal of a subpixel in the true RGB pixel mode of a same color as the second subpixel in the i-th column and in the (j+1)-th row, the subpixel in a fourth logic pixel corresponding to a virtual pixel comprising the second subpixel in the i-th column and in the (j+1)-th row or a virtual pixel sharing the second subpixel in the i-th column and in the (j+1)-th row; the theoretical data signal of the second logic subpixel from the fifth logic pixel in the i-th column and in the (j+1)-th row is a data signal of a subpixel in the true RGB pixel mode of a same color as the second subpixel in the i-th column and in the (j+1)-th row, the subpixel in a fifth logic pixel corresponding to a virtual pixel comprising the second subpixel in the i-th column and in the (j+1)-th row or a virtual pixel sharing the second subpixel in the i-th column and in the (j+1)-th row; and the theoretical data signal of the third logic subpixel from the sixth logic pixel in the (i−1)-th column and in the j-th row is a data signal of a subpixel in the true RGB pixel mode of a same color as the third subpixel in the (i−1)-th column and in the j-th row, the subpixel in a sixth logic pixel corresponding to a virtual pixel comprising the third subpixel in the (i−1)-th column and in the j-th row or a virtual pixel sharing the third subpixel in the (i−1)-th column and in the j-th row.

Optionally, the one of the plurality of first subpixels in the respective repeating unit is a first subpixel in an i-th column and in a j-th row, the one of the plurality of second subpixels in the respective repeating unit is a second subpixel in the i-th column and in the (j+1)-th row, the two of the plurality third subpixels in the respective repeating unit are a third subpixel in a (i−1)-th column and in the j-th row and a third subpixel in the i-th column and in the j-th row, respectively; and the two of the plurality third subpixels in the respective repeating unit belong to a virtual pixel in the i-th column and in the j-th row and a virtual pixel in the (i−1)-th column and in the j-th row, respectively, the one of the plurality of first subpixels in the respective repeating unit belongs to a virtual pixel in the (i−1)-th column and in the (j−1)-th row, the one of the plurality of second subpixels in the respective repeating unit belongs to a virtual pixel in the i-th column and in the (j+1)-th row; in a respective repeating unit, the first subpixel in the i-th column and in the j-th row and the third subpixel in the i-th column and in the j-th row belong to a virtual pixel in the i-th column and in the j-th row, the second subpixel in the i-th column and in the (j+1)-th row belongs to virtual pixel in the i-th column and in the (j+1)-th row, the third subpixel in the (i−1)-th column and in the j-th row belongs to virtual pixel in the (i−1)-th column and in the j-th row.

Optionally, the driving circuit is configured to derive a first actual data signal of a subpixel of the plurality of first subpixels in an i-th column and in a j-th row, based on a theoretical data signal of a first logic subpixel from a first logic pixel in a (i−1)-th column and in a (j−1)-th row and a theoretical data signal of a first logic subpixel from a second logic pixel in the i-th column and the (j−1)-th row; derive a second actual data signal of a subpixel of the plurality of third subpixels in the i-th column and in the j-th row, based on a theoretical data signal of a third logic subpixel from a third logic pixel in the i-th column and in the j-th row; derive a third actual data signal of a subpixel of the plurality of second subpixels in the i-th column and in the (j+1)-th row, based on a theoretical data signal of a second logic subpixel from a fourth logic pixel in the (i−1)-th column and in the (j+1)-th row and a theoretical data signal of a second logic subpixel from a fifth logic pixel in the i-th column and in the (j+1)-th row; and derive a fourth actual data signal of a subpixel of the plurality of third subpixels in the (i−1)-th column and in the j-th row, based on a theoretical data signal of a third logic subpixel from a sixth logic pixel in the (i−1)-th column and in the j-th row; wherein $2 \le i \le I$, $2 \le j \le J$.

Optionally, the first logic pixel in a (i−1)-th column and in a (j−1)-th row, the second logic pixel in the i-th column and the (j−1)-th row, the third logic pixel in the i-th column and in the j-th row, the fourth logic pixel in the (i−1)-th column and in the (j+1)-th row, the fifth logic pixel in the i-th column and in the (j+1)-th row, and the sixth logic pixel in the (i−1)-th column and in the j-th row, are pixels in a true red-green-blue (RGB) pixel mode; the theoretical data signal of the first logic subpixel from the first logic pixel in the (i−1)-th column and in the (j−1)-th row is a data signal of a subpixel in the true RGB pixel mode of a same color as the first subpixel in the i-th column and in the j-th row, the subpixel in a first logic pixel corresponding to a virtual pixel comprising the first subpixel in the i-th column and in the j-th row or a virtual pixel sharing the first subpixel in the i-th column and in the j-th row; the theoretical data signal of the first logic subpixel from the second logic pixel in the i-th column and the (j−1)-th row is a data signal of a subpixel in the true RGB pixel mode of a same color as the first subpixel in the i-th column and in the j-th row, the subpixel in a first logic pixel corresponding to a virtual pixel comprising the first subpixel in the i-th column and in the j-th row or a virtual pixel sharing the first subpixel in the i-th column and in the j-th row; the theoretical data signal of the third logic subpixel from the third logic pixel in the i-th column and in the j-th row is a data signal of a subpixel in the true RGB pixel mode of a same color as the third subpixel in the i-th column and in the j-th row, the subpixel in a first logic pixel corresponding to a virtual pixel comprising the third subpixel in the i-th column and in the j-th row; the theoretical data signal of the second logic subpixel from the fourth logic pixel in the (i−1)-th column and in the (j+1)-th row is a data signal of a subpixel in the true RGB pixel mode of a same color as the second subpixel in the i-th column and in the (j+1)-th row, the subpixel in a fourth logic pixel corresponding to a virtual pixel comprising the second subpixel in the i-th column and in the (j+1)-th row or a virtual pixel sharing the second subpixel in the i-th column and in the (j+1)-th row; the theoretical data signal of the second logic subpixel from the fifth logic pixel in the i-th column and in the (j+1)-th row is a data signal of a subpixel in the true RGB pixel mode of a same color as the second subpixel in the i-th column and in the (j+1)-th row, the subpixel in a fifth logic pixel corresponding to a virtual pixel comprising the second subpixel in the i-th column and in the (j+1)-th row or a virtual pixel sharing the second subpixel in the i-th column and in the (j+1)-th row; and the theoretical data signal of the third logic subpixel from the sixth logic pixel in the (i−1)-th column and in the j-th row is a data signal of a subpixel in the true RGB pixel mode of a same color as the third subpixel in the (i−1)-th column and in the j-th row, the subpixel in a sixth logic pixel corresponding to a virtual pixel comprising the third subpixel in the (i−1)-th column and in the j-th row or a virtual pixel sharing the third subpixel in the (i−1)-th column and in the j-th row.

Optionally, the first actual data signal of the subpixel of the plurality of first subpixels in the i-th column and in the j-th row is represented by a following equation:

$$X_{i,j} = (\alpha_1 \cdot x_{i-1,j-1}^{\gamma}\ \alpha_2 \cdot x_{i-1,j}^{\gamma})^{\frac{1}{\gamma}};$$

wherein $X_{i,j}$ represents the first actual data signal of the subpixel of the plurality of first subpixels in the i-th column and in the j-th row; $x_{i-1,j-1}$ represents the theoretical data signal of the first logic subpixel of the first color from the first logic pixel in the (i−1)-th column and in the (j−1)-th row; $x_{i1,j-1}$ represents the theoretical data signal of the first logic subpixel of the first color from the second logic pixel in the i-th column and the (j−1)-th row; $\alpha_1$ represents a weight of the $x_{i-1,j-1}$; $\alpha_2$ represents a weight of the $x_{i-1,j}$; and $\gamma$ is a constant; the second actual data signal of the subpixel of the plurality of third subpixels in the i-th column and in the j-th row is represented by a following equation: $G_{i,j}=g_{i,j}$; wherein $G_{i,j}$ represents the second actual data signal of the subpixel of the plurality of third subpixels in the i-th column and in the j-th row; $g_{i,j}$ represents the theoretical data signal of the third logic subpixel of the third color from the third logic pixel in the i-th column and in the j-th row; the third actual data signal of the subpixel of the plurality of second subpixels in the i-th column and in the (j+1)-th row is represented by a following equation:

$$Y_{i+1,j} = (\beta_1 \cdot y_{i+1,j-1}^{\gamma} + \beta_2 \cdot y_{i+1,j}^{\gamma})^{\frac{1}{\gamma}};$$

wherein $Y_{i,j+1}$ represents the third actual data signal of the subpixel of the plurality of second subpixels in the i-th column and in the (j+1)-th row; $y_{i+1,j-1}$ represents the theoretical data signal of the second logic subpixel of the second color from the fourth logic pixel in the (i−1)-th column and in the (j+1)-th row; $y_{i,j+1}$ represents the theoretical data signal of the second logic subpixel of the second color from the fifth logic pixel in the i-th column and in the (j+1)-th row; $\beta_1$ represents a weight of the $y_{i-1,j+1}$; $\beta_2$ represents a weight of the $y_{i,j+1}$, and $\gamma$ is a constant; the fourth actual data signal of the subpixel of the plurality of third subpixels in the (i−1)-th column and in the j-th row is represented by a following equation: $G_{i-1,1}=g_{i-1,j}$; wherein $G_{i-1,1}$ represents the fourth actual data signal of the subpixel of the plurality of third subpixels in the (i−1)-th column and in the j-th row; and $g_{i-1,j}$ represents the theoretical data signal of the third logic subpixel of the third color from the sixth logic pixel in the (i−1)-th column and in the j-th row.

Optionally, each of the $\alpha_1$ and the $\alpha_2$ is 0.5; and each of the $\beta_1$ and the $\beta_2$ is 0.5.

Optionally, the first direction and the second direction are co-planar directions that are substantially perpendicular to each other.

Optionally, adjacent repeating units of the plurality of repeating units are staggered along the first direction.

Optionally, in a central region of the display apparatus, odd-numbered repeating units have a same arrangement, even-numbered repeating units have a same arrangement, a virtual extension of a line connecting centers of two third subpixels in a same repeating unit of the respective repeating group is between a center of a first subpixel and a center of a second subpixel, the first subpixel and the second subpixel being directly adjacent to the two third subpixels in the same repeating unit, respectively, the first subpixel and the second subpixel being in two adjacent repeating groups directly adjacent to the respective repeating group, respectively.

Optionally, when the two of the plurality third subpixels in the respective repeating unit are arranged along the first direction, the one of the plurality of first subpixels and the one of the plurality of second subpixels in the respective repeating unit are arranged along the second direction, the two of the plurality third subpixels are between the one of the plurality of first subpixels and the one of the plurality of second subpixels along the second direction; wherein, when the two of the plurality third subpixels in the respective repeating unit are arranged along the second direction, the one of the plurality of first subpixels and the one of the plurality of second subpixels in the respective repeating unit are arranged along the first direction, the two of the plurality third subpixels are between the one of the plurality of first subpixels and the one of the plurality of second subpixels along the first direction.

Optionally, in the respective repeating unit, centers of the two of the plurality third subpixels are on two different sides of a line connecting a center of the one of the plurality of first subpixels and a center of the one of the plurality of second subpixels.

Optionally, when the two of the plurality third subpixels in the respective repeating unit are arranged along the first direction, the one of the plurality of first subpixels and the one of the plurality of second subpixels in the respective repeating unit are arranged along the second direction, first dimensions of the one of the plurality of first subpixels and the one of the plurality of second subpixels along the first direction are greater than second dimensions of the one of the plurality of first subpixels and the one of the plurality of second subpixels along the second direction; wherein, when the two of the plurality third subpixels in the respective repeating unit are arranged along the second direction, the one of the plurality of first subpixels and the one of the plurality of second subpixels in the respective repeating unit are arranged along the first direction, second dimensions of the one of the plurality of first subpixels and the one of the plurality of second subpixels along the second direction are greater than first dimensions of the one of the plurality of first subpixels and the one of the plurality of second subpixels along the first direction.

Optionally, when the two of the plurality third subpixels in the respective repeating unit are arranged along the first direction, the one of the plurality of first subpixels and the one of the plurality of second subpixels in the respective repeating unit are arranged along the second direction, orthographic projections of the two of the plurality third subpixels on a plane perpendicular to the first direction are between orthographic projections of the one of the plurality of first subpixels and the one of the plurality of second subpixels on the plane; wherein, when the two of the plurality third subpixels in the respective repeating unit are arranged along the second direction, the one of the plurality of first subpixels and the one of the plurality of second subpixels in the respective repeating unit are arranged along the first direction, orthographic projections of the two of the plurality third subpixels on a plane perpendicular to the second direction are between orthographic projections of the one of the plurality of first subpixels and the one of the plurality of second subpixels on the plane.

Optionally, a respective first subpixel of the plurality of first subpixels has a substantially hexagonal shape; a respective second subpixel of the plurality of second subpixels has a substantially hexagonal shape comprising three groups of opposite sides, two opposite sides in a respective group face each other and are substantially parallel to each other; a respective third subpixel of the plurality of third subpixels has a substantially pentagonal shape comprising a group of parallel opposite sides and a perpendicular side, the perpendicular side is perpendicular to the parallel opposite sides and connected to the parallel opposite sides, two perpendicular sides respectively from the two of the plurality third subpixels in the respective repeating unit are adjacent to each other; and in the respective repeating unit, longest opposite sides in a group among three groups of opposite sides of the substantially hexagonal shape of the respective first subpixel, longest opposite sides in a group among the three groups of opposite sides of the substantially hexagonal shape of the respective second subpixel, and the parallel opposite sides of the substantially pentagonal shape of the respective third subpixel are parallel to each other.

Optionally, in the respective repeating unit, the plurality of first subpixels and the plurality of second subpixels have a same order of arrangement.

BRIEF DESCRIPTION OF THE FIGURES

The following drawings are merely examples for illustrative purposes according to various disclosed embodiments and are not intended to limit the scope of the present invention.

FIG. 9B is a schematic diagram of a structure of a respective one of a plurality of minimum translational repeating units in some embodiments according to the present disclosure.

FIG. 10 is a flow chart of a method of driving a pixel arrangement structure in some embodiments according to the present disclosure.

DETAILED DESCRIPTION

Figure 1:
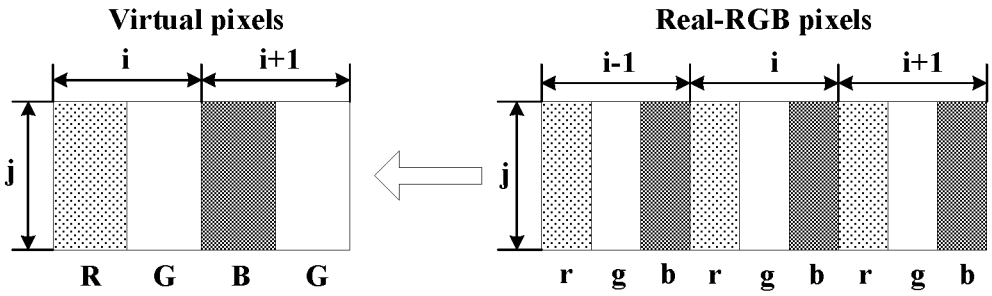
FIG. 1 is a schematic diagram illustrating an algorithm of Sup-Pixel Rendering used in driving a plurality of subpixels in a pixel arrangement structure in some embodiments according to the present disclosure.

The disclosure will now be described more specifically with reference to the following embodiments. It is to be noted that the following descriptions of some embodiments are presented herein for purpose of illustration and description only. It is not intended to be exhaustive or to be limited to the precise form disclosed.

The present disclosure provides, inter alia, a method of driving a pixel arrangement structure having a plurality of subpixels, a driving chip for driving a pixel arrangement structure having a plurality of subpixels, a display apparatus, and a computer-program product that substantially obviate one or more of the problems due to limitations and disadvantages of the related art. In one aspect, the present disclosure provides a method of driving a pixel arrangement structure having a plurality of subpixels including a plurality of first subpixels of a first color, a plurality of second subpixels of a second color, and a plurality of third subpixels of a third color. In some embodiments, the method of driving a pixel arrangement structure includes deriving an first actual data signal of a subpixel of the plurality of first subpixels in an i-th column and in a j-th row, based on a theoretical data signal of a first logic subpixel of the first color from a first logic pixel in a (i−1)-th column and in a (j−1)-th row and a theoretical data signal of a first logic subpixel of the first color from a second logic pixel in the (i−1)-th column and the j-th row; deriving a second actual data signal of a subpixel of the plurality of third subpixels in the i-th column and in the j-th row, based on a theoretical data signal of a third logic subpixel of the third color from a third logic pixel in the i-th column and in the j-th row; deriving a third actual data signal of a subpixel of the plurality of second subpixels in an (i+1)-th column and in the j-th row, based on a theoretical data signal of a second logic subpixel of the second color from a fourth logic pixel in the (i+1)-th column and in the (j−1)-th row and a theoretical data signal of a second logic subpixel of the second color from a fifth logic pixel in the (i+1)-th column and in the j-th row; and deriving a fourth actual data signal of a subpixel of the plurality of third subpixels in the i-th column and in the (j−1)-th row, based on a theoretical data signal of a third logic subpixel of the third color from a sixth logic pixel in the i-th column and in the (j−1)-th row; wherein $2 \le i \le I$, $2 \le j \le J$. Optionally, the plurality of third subpixels are arranged in an array of I columns and J rows. Optionally, the pixel arrangement structure includes a plurality of minimum translational repeating units. Optionally, a respective one of the plurality of minimum translational repeating units includes one of the plurality of first subpixels, one of the plurality of second subpixels, and two of the plurality third subpixels.

A subpixel in a display apparatus is a minimum unit to display images. In a display apparatus, a plurality of subpixels include a plurality of red (R) subpixels, a plurality of green (G) subpixels, and a plurality of blue (B) subpixels, which is used by the display apparatus to display different colors. A subpixel having one red subpixel, one green subpixel, and one blue subpixel is called a real-RGB pixel. Many display apparatus use the real-RGB pixels, and a driving method of the display apparatus having the real-RGB pixels are merely designed to drive the real-RGB pixels.

When the display resolution of the display panel is substantially equivalent to human eye resolution, a virtual pixel technology may be used, replacing the conventional three-subpixel pixel arrangement. Rather, based on human eye's different sensitivities with respect to different colors, a virtual pixel including two subpixels of different colors may be used to achieve the same color display, without including the perceived visual resolution.

The virtual pixel technology can be achieved using Sup-Pixel Rendering which may derive an actual data signal of a red subpixel of a virtual pixel based on theoretical data signal of two or more adjacent red logic subpixels respectively from two or more adjacent real-RGB pixels, and derive an actual data signal of a blue subpixels of the same virtual pixel based on theoretical data signal of two or more adjacent blue logic subpixels respectively from two or more adjacent real-RGB pixels. The virtual pixel technology using Sup-Pixel Rendering allows a subpixel of a virtual pixel to have theoretical data signal of two or more adjacent theoretical subpixels from real-RGB pixels, which may allow the subpixel of the virtual pixel to express more information from two or more adjacent theoretical subpixels, so, even though the total number of subpixels is reduced, the effective information from the real-RGB pixels can be greatly used to keep the perceived visual resolution substantially unchanged.

In some embodiments, columns and rows of an arrangement of virtual pixels is defined by an arrangement of the plurality of third subpixels. Optionally, rows of third subpixels correspond to rows of virtual pixels. Optionally, columns of third subpixels correspond to columns of virtual pixels. Optionally, a respective one of the virtual subpixels includes a respective one of the plurality of third subpixels. Optionally, two virtual subpixels do not share a same third subpixel.

One of algorithms used in Sup-Pixel Rendering is deriving actual data signal of a virtual pixel bases on theoretical data signals of multiple adjacent real-RGB pixels. For example, when the multiple adjacent real-RGB pixels are in a same row, a transition between the actual data signal of the virtual pixel and the theoretical data signals of multiple adjacent real-RGB pixels is considered as a simple transition in row. For example, an actual data signal of a green subpixel of a virtual pixel is based on a theoretical data signal of a green logic subpixel of a corresponding real-RGB pixel, an actual data signal of a red subpixel of the virtual pixel is based on an average value a sum of two theoretical data signal of two red logic subpixels from two corresponding and adjacent real-RGB pixels, and an actual data signal of a blue subpixel of the virtual pixel is based on an average value a sum of two theoretical data signal of two blue logic subpixels from two corresponding and adjacent real-RGB pixels FIG. 1 is a schematic diagram illustrating an algorithm of Sup-Pixel Rendering used in driving a plurality of subpixels in a pixel arrangement structure in some embodiments according to the present disclosure. Referring to FIG. 1, in some embodiments, a virtual pixel in an i-th column and in an j-th row includes a red subpixel R, and a green subpixel G. A virtual pixel in an (i+1)-th column and in the j-th row includes a blue subpixel B, and a green subpixel G. The subpixels in the virtual pixels are arranged in an RGBG-stripe arrangement. Optionally, each one of the real-RGB pixels includes a red logic subpixel r, a green logic subpixel g, and a blue logic subpixel b. The logic subpixels in the real-RGB pixels are arranged in an RGBRGB-stripe arrangement.

In one example, an actual data signal of the virtual pixel in an i-th column and in an j-th row is based on a theoretical data signal of a real-RGB pixel in an (i−1)-th column and the j-th row and a theoretical data signal of a real-RGB pixel in the i-th column and j-th row. In another example, an actual data signal of the virtual pixel in an (i+1)-th column and in the j-th row is based on the theoretical data signal of the real-RGB pixel in the i-th column and j-th row and a theoretical data signal of a real-RGB pixel in the (i+1)-th column and in the j-th row.

For example, the actual data signal of the virtual pixel includes an actual data signal of a red subpixel R of the virtual pixel, and an actual data signal of a blue subpixel B of the virtual pixel, and an actual data signal of a green subpixel G of the virtual pixel. For example, the theoretical data signal of a real-RGB pixel includes a theoretical data signal of a red logic pixel r of the real-RGB pixel, a theoretical data signal of a blue logic pixel b of the real-RGB pixel, and theoretical data signal of a green logic pixel g of the real-RGB pixel.

Based on an algorithm shown in FIG. 1, an actual data signal of the red subpixel R of the virtual pixel in the i-th column and in the j-th row is represented by a following equation:

$$R^0_{i,j} = \left(\frac{r^\gamma_{i-1,j} + r^\gamma_{i,j}}{2}\right)^{\frac{1}{\gamma}} \tag{1.1}$$

wherein $R^0_{i,j}$ represents the actual data signal of the red subpixel R of the virtual pixel in the i-th column and in the j-th row; $r_{i-1,j}$ represents a theoretical data signal of a red logic subpixel r of the real-RGB pixels in the (i−1)-th column and the j-th row; $r_{i,j}$ represents a theoretical data signal of a red logic subpixel r of the real-RGB pixels in the i-th column and j-th row; and γ is a constant.

An actual data signal of the green subpixel G of the virtual pixel in the i-th column and in the j-th row is represented by a following equation:

$$G^0_{i,j} = g_{i,j} \tag{1.2}$$

wherein $G^0_{i,j}$ represents the actual data signal of the green subpixel G of the virtual pixel in the i-th column and in the j-th row; and $g_{i,j}$ represents a theoretical data signal of a green logic subpixel g of the real-RGB pixels in the i-th column and j-th row.

An actual data signal of the blue subpixel B of the virtual pixel in the (i+1)-th column and in the j-th row is represented by a following equation:

$$B^0_{i+1,j} = \left(\frac{b^\gamma_{i,j} + b^\gamma_{i+1,j}}{2}\right)^{\frac{1}{\gamma}} \tag{1.3}$$

wherein $B^0_{i+1,j}$ represents the actual data signal of the blue subpixel B of the virtual pixel in the (i+1)-th column and in the j-th row; $b_{i,j}$ represents a theoretical data signal of a blue logic subpixel b of the real-RGB pixels in the i-th column and j-th row; $b_{i+1,j}$ represents a theoretical data signal of a blue logic subpixel b of the real-RGB pixels in the (i+1)-th column and in the j-th row; and γ is a constant.

An actual data signal of the green subpixel G of the virtual pixel in the (i+1)-th column and in the j-th row is represented by a following equation:

$$G^0_{i+1,j} = g_{i+1,j} \tag{1.2}$$

wherein $G^0_{i+1,j}$ represents the actual data signal of the green subpixel G of the virtual pixel in the (i+1)-th column and in the j-th row; and $g_{i+1,j}$ represents a theoretical data signal of a green logic subpixel g of the real-RGB pixels in the (i+1)-th column and in the j-th row.

Figure 2A:
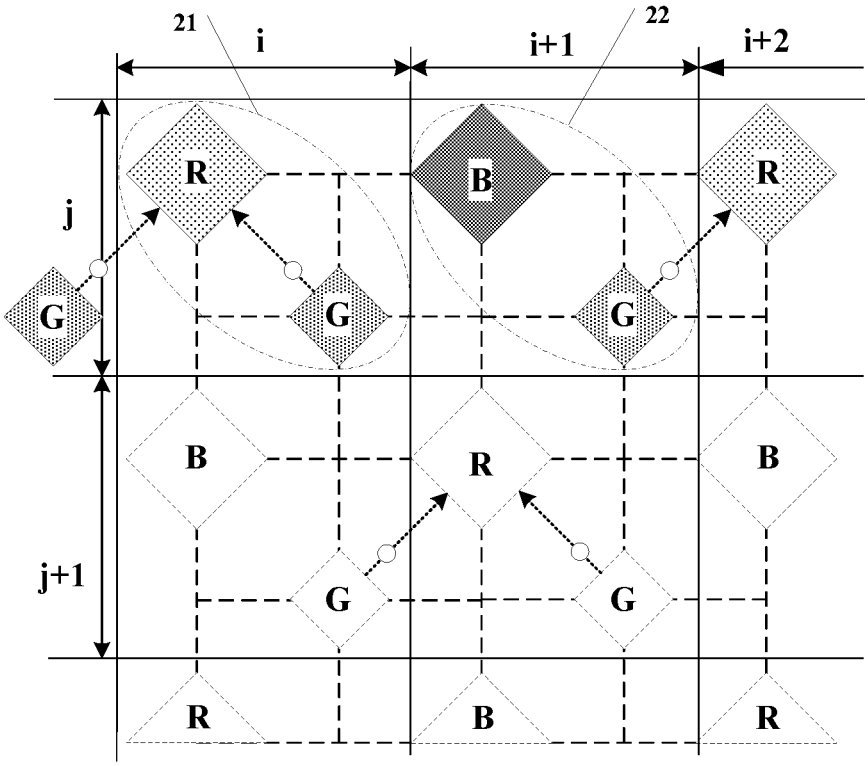
FIG. 2A is a schematic diagram illustrating that a pixel arrangement structure is displaying a horizontal line having a substantially white color in some embodiments according to the present disclosure.
Figure 2B:
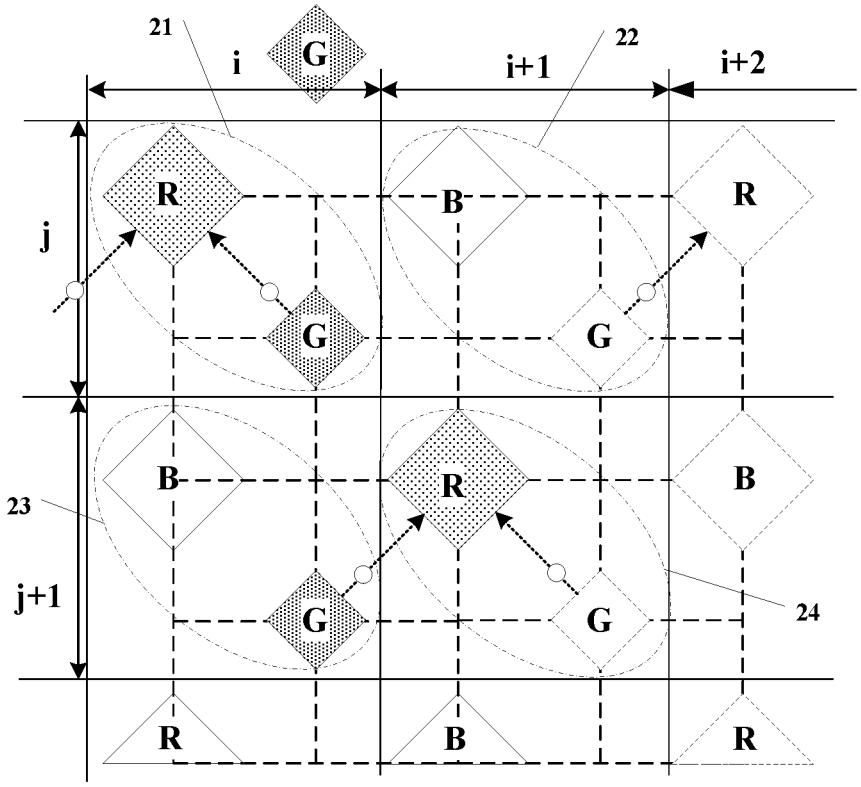
FIG. 2B is a schematic diagram illustrating that a pixel arrangement structure is displaying a vertical line having a substantially white color in some embodiments according to the present disclosure.

FIG. 2A is a schematic diagram illustrating that a pixel arrangement structure is displaying a horizontal line having a substantially white color in some embodiments according to the present disclosure. FIG. 2B is a schematic diagram illustrating that a pixel arrangement structure is displaying a vertical line having a substantially white color in some embodiments according to the present disclosure.

In some embodiments, referring to both FIG. 2A and FIG. 2B, the pixel arrangement structure has an RGBG-diamond arrangement. Optionally, subpixels of a plurality of subpixels in each row of the pixel arrangement structure are arranged in a RGBG arrangement. For example, a respective one of the plurality of virtual pixels includes a subpixel selected from a respective one of a plurality of green subpixels, and a subpixel selected from a respective one of the plurality of red subpixels and a respective one of the blue subpixel. For example, one of two adjacent pixels has a red subpixel, and a green subpixel, and the other one of the two adjacent pixels has a blue subpixel and a green subpixel.

In some embodiments, referring to FIG. 2A, the pixel arrangement structure is displaying the horizontal line having the substantially white color. A virtual pixel 21 in a i-th column and in a j-th row have a red subpixel R in the i-th column and in the j-th row, and a green subpixel Gin the i-th column and in the j-th row. A virtual pixel 22 in a (i+1)-th column and in the j-th row includes a blue subpixel B in the (i+1)-th column and in the j-th row, and a green subpixel Gin the (i+1)-th column and in the j-th row.

When the pixel arrangement structure is displaying the horizontal line having the substantially white color in the j-th row, all subpixels in the j-th row should emit light. For example, the red subpixel R in the i-th column and in the j-th row, the green subpixel G in the i-th column and in the j-th row, the blue subpixel B in the (i+1)-th column and in the j-th row, and the green subpixel Gin the (i+1)-th column and in the j-th row emit light, and brightness of those subpixels are 100% (e.g., grey scales of those subpixels are 225), so the horizontal line having the substantially white color is displayed on the j-th row. No signal is sent to subpixels shown in blank subpixels in FIG. 2A, e.g., the blank subpixels shown in FIG. 2A do not emit light. Blank subpixels are subpixels in figures in which no pattern are filled.

In some embodiments, referring to FIG. 2B, the pixel arrangement structure is displaying the vertical line having the substantially white color. The virtual pixel 21 in the i-th column and in the j-th row includes the red subpixel R in the i-th column and in the j-th row, and the green subpixel Gin the i-th column and in the j-th row. The virtual pixel 22 in the (i+1)-th column and in the j-th row includes the blue subpixel B in the (i+1)-th column and in the j-th row, and the green subpixel Gin the (i+1)-th column and in the j-th row. The virtual pixel 23 in the i-th column and in the (j+1)-th row includes a red subpixel R in the i-th column and in the (j+1)-th row, and a green subpixel Gin the i-th column and in the (j+1)-th row. The virtual pixel 24 in the (i+1)-th column and in the (j+1)-th row includes a blue subpixel B in the (i+1)-th column and in the (j+1)-th row, and a green subpixel G in the (i+1)-th column and in the (j+1)-th row.

When the pixel arrangement structure is displaying the vertical line having the substantially white color in the i-th column, all subpixels in the i-th column should emit light, and all red subpixels in the (i+1)-th column and all blue subpixels in the (i+1)-th column should emit light. For example, the red subpixel R in the i-th column and in the j-th row, the green subpixel Gin the i-th column and in the j-th row, the blue subpixel B in the (i+1)-th column and in the j-th row, the blue subpixel B in the i-th column and in the (j+1)-th row, the green subpixel G in the i-th column and in the (j+1)-th row, the red subpixel R in the (i+1)-th column and in the (j+1)-th row emit light. No signal is sent to blank subpixels shown in FIG. 2B, e.g., the blank subpixels shown in FIG. 2A do not emit light. Brightness of the red subpixels and the blue subpixels in the i-th column are 50% (e.g., grey scales of those subpixels are 128), brightness of green subpixels in the i-th column are 100% (e.g., grey scales of those subpixels are 225), and brightness of the red subpixels and the blue subpixels in the (i+1)-th column is 50%, so the vertical line having the substantially white color is displayed on the i-th column.

In some embodiments, a bright center of a virtual pixel is between a green subpixel in the virtual pixel and a red subpixel adjacent to the green subpixel, and a distance between the bright center of the virtual pixel and the green subpixel is shorter than a distance between the bright center of the virtual pixel and the red subpixel.

Optionally, referring to FIG. 2A and FIG. 2B, a white circular shape in the respective one of the plurality of virtual pixels, and between a respective one of the plurality of green subpixels in the respective one of the plurality of virtual pixels and a respective one of the plurality of red subpixels adjacent to the respective one of the plurality of green subpixels, represents a bright center of the respective one of the plurality of virtual pixels.

For example, a bright center of the virtual pixel 21 in the i-th column and in the j-th row is between the red subpixel in the i-th column and in the j-th row and the green subpixel in the i-th column and in the j-th row. A bright center of the virtual pixel 22 in the (i+1)-th column and in the j-th row is between the green subpixel in the (i+1)-th column and in the j-th row and a red subpixel in a (i+2) column and in the j-th row.

In some embodiments, referring to FIG. 2A, when the pixel arrangement structure is displaying the horizontal line having substantially white color in the j-th row, bright centers of virtual pixels in the j-th row are in a same straight line substantially parallel to a row direction.

Referring to FIG. 2A and FIG. 2B, optionally, centers of red subpixels and centers of blue subpixels in a same row are in a same R&B straight line substantially parallel to the row direction. Centers of green subpixels in the same row are in a same G straight line substantially parallel to the row direction, but the same R&B straight line dose not overlap with the same G straight line.

Optionally, referring to FIG. 2A, using the algorithms of Sup-Pixel Rendering in the equation (1.1) and the equation (1.4), in the j-th row, the green subpixels emitting light to form the horizontal line having the substantial white color in the j-th row are arranged on a side of the virtual pixels in the j-th row closer to the (j+1)-th row, so when horizontal line having the substantial white color is displayed in the j-th row, a side of the j-th row closer to the (j+1)-th row has a substantial white color tinged with green color, and a side of the j-th row closer to a (j−1)-th row has a substantially white color tinged with purple color.

Optionally, referring to FIG. 2B, when the pixel arrangement structure is displaying the vertical line having substantially white color in the i-th column, bright centers of virtual pixels in the i-th column are not in a same straight line substantially parallel to a column direction.

In some embodiments, referring to FIG. 2A and FIG. 2B, along the row direction, orthographic projections of two green subpixels on a plane perpendicular to the column direction are between orthographic projections of two adjacent red subpixels on the plane perpendicular to the column direction. Optionally, there is no red subpixel between any two adjacent red subpixels, but there can be subpixels with color other than red between any two adjacent red subpixels, for example, there is one blue subpixel between any two adjacent red subpixels.

For example, the red subpixel R in the i-th column and in the j-th row is on a side of the green subpixel Gin the i-th column and in the j-th row away from the (i+1)-th column and away from the (j+1)-th row. The red subpixel R in the (i+2)-th column and in the j-th row is on a side of the green subpixel Gin the (i+1)-th column and the j-th row away from the i-th column and (j+1)-th row. So, the bright center of the virtual pixel 22 in the (i+1)-th column and in the j-th row is closer to the (i+2)-th column, but the bright center of the virtual pixel 21 in the i-th column and in the j-th row is closer to a (i−1)-th column, resulting that the bright centers are not evenly distributed, and further resulting graininess of an image displayed by those subpixels.

In some embodiments, the present disclosure provides a method of driving a pixel arrangement structure, driving chips using the method of driving the pixel arrangement structure, display apparatus using the method of driving the pixel arrangement structure, and a computer-program product using the method of driving the pixel arrangement structure. The method of driving the pixel arrangement structure includes using two logic subpixels in a same column but in adjacent rows to determine actual data signal of a subpixel in a virtual pixel to display lines with substantially white color along the row direction or the column direction. So, by using the method described herein, the bright centers of the virtual pixels in a same row or in a same column are in a straight line along the row direction or along the column direction, which may decrease or diminish the color separation in the line having the substantial white color, and reduce the distribution non-uniformity of bright centers and to further reduce the graininess of an image.

Figure 3A:
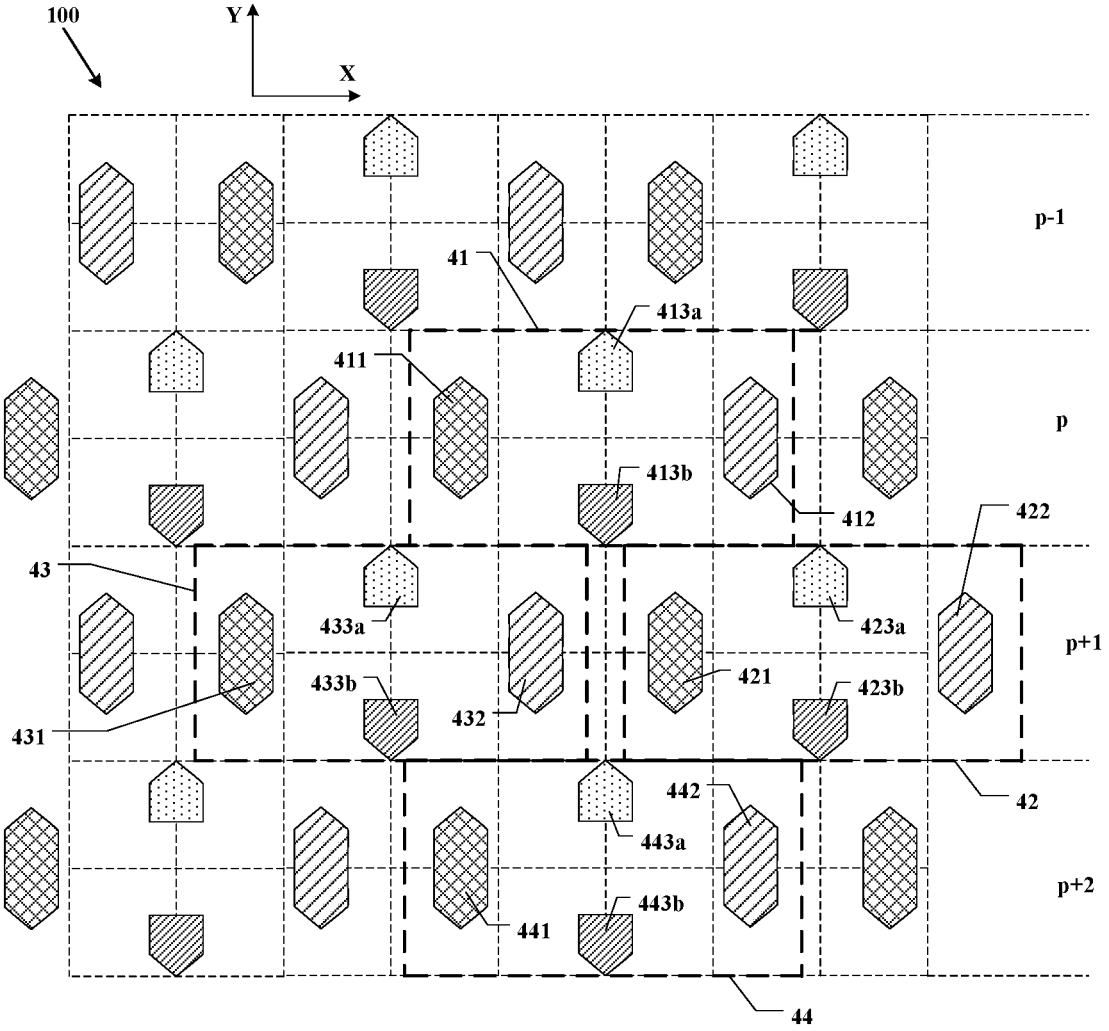
FIG. 3A is a schematic diagram of a partial structure of a pixel arrangement structure in some embodiments according to the present disclosure.
Figure 3B:
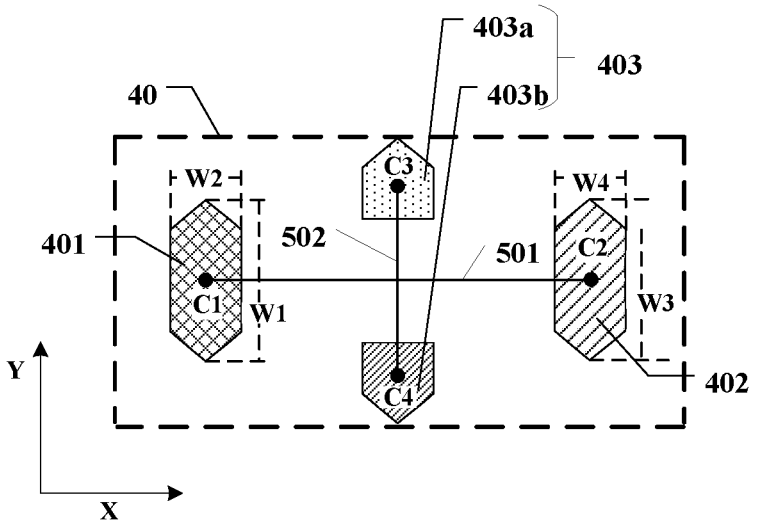
FIG. 3B is a schematic diagram of a structure of a respective one of a plurality of minimum translational repeating units in some embodiments according to the present disclosure.
Figure 3C:
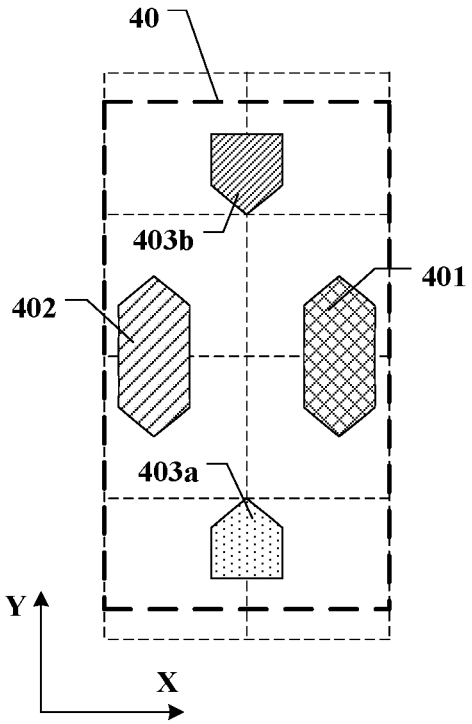
FIG. 3C is a schematic diagram of a structure of a respective one of a plurality of minimum translational repeating units in some embodiments according to the present disclosure.
Figure 4:
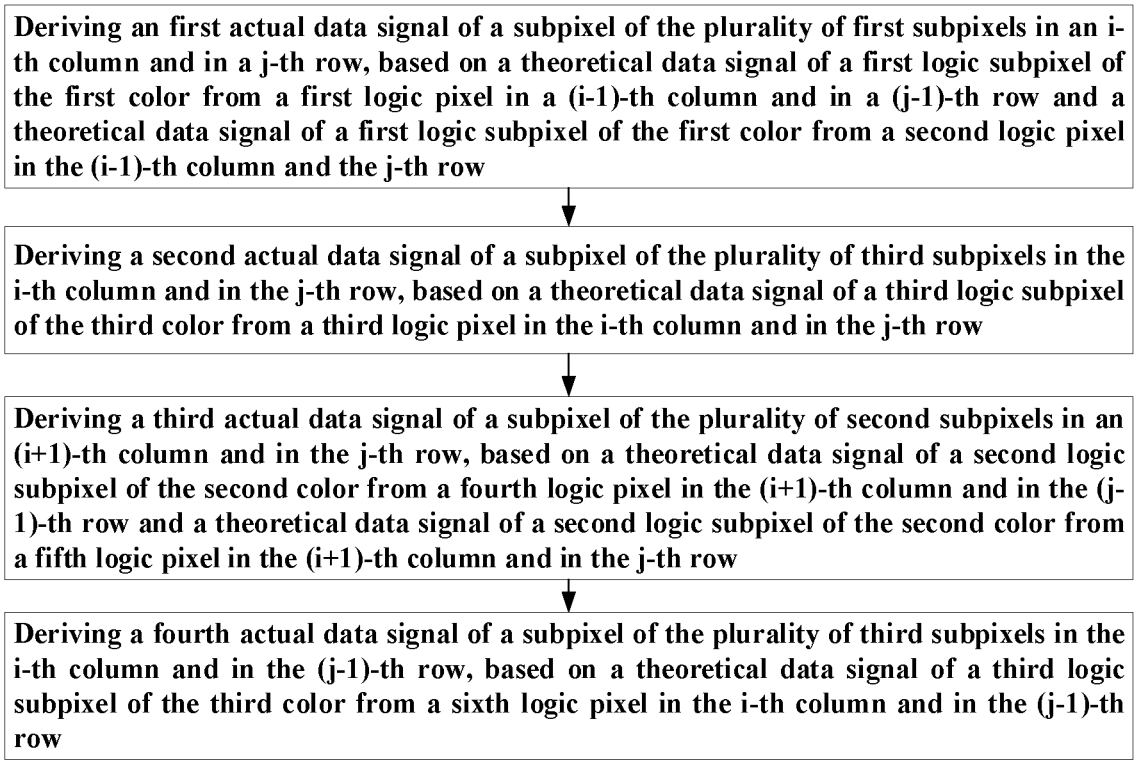
FIG. 4 is a flow chart of a method of driving a pixel arrangement structure in some embodiments according to the present disclosure.

FIG. 3A is a schematic diagram of a partial structure of a pixel arrangement structure in some embodiments according to the present disclosure. FIG. 3B is a schematic diagram of a structure of a respective one of a plurality of minimum translational repeating units in some embodiments according to the present disclosure. FIG. 3C is a schematic diagram of a structure of a respective one of a plurality of minimum translational repeating units in some embodiments according to the present disclosure. FIG. 4 is a flow chart of a method of driving a pixel arrangement structure in some embodiments according to the present disclosure.

In some embodiments, referring to FIG. 3A and FIG. 3B, a pixel arrangement structure 100 driven by the method disclosed by the present disclosure includes a plurality of first subpixels 401 of a first color, a plurality of second subpixels 402 of a second color, and a plurality of third subpixels 403 of a third color. Optionally, the plurality of third subpixels 403 are arranged in an array of I columns and J rows. Optionally, the pixel arrangement structure 100 includes a plurality of minimum translational repeating units 40.

In some embodiments, the pixel arrangement structure 100 includes a plurality of repeating rows. Optionally, a respective one of the plurality of repeating rows includes a selected number of minimum translational repeating units 40 arranged along a row direction X. For example, FIG. 3A shows four repeating rows of the plurality of repeating rows including a (p−1)-th repeating row, a p-th repeating row, a (p+1)-th repeating row, and a (p+2)-th repeating row. p is a positive integer greater than or equal to 2.

Figure 3D:
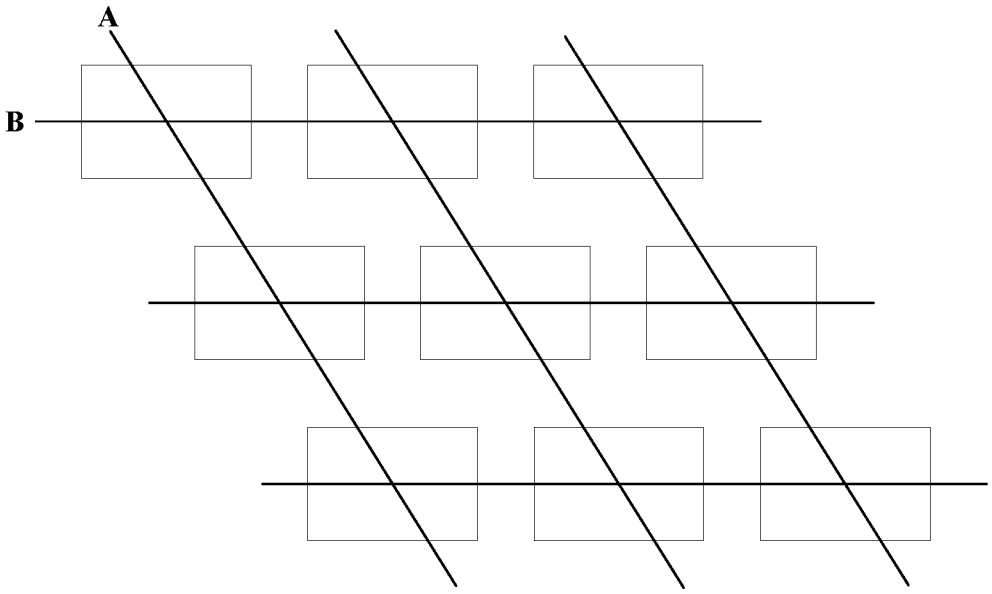
FIG. 3D is a schematic diagram illustrating a relationship between a row direction X and a column direction Y in some embodiments according to the present disclosure.

FIG. 3D is a schematic diagram illustrating an arrangement of a plurality of minimum translational repeating units in some embodiments according to the present disclosure. In some embodiments, referring to FIG. 3A and FIG. 3D, the plurality of repeating rows are arranged along a column direction Y, so the plurality of minimum translational repeating units 40 are arranged in an array along the row direction X and the column direction Y. Optionally, the column direction Y and the row direction X are different directions. Optionally, the column direction Y and the row direction X are perpendicular to each other.

In some embodiments, the plurality of minimum translational repeating units 40 are arranged along a first direction A and a second direction B. Optionally, the first direction A and the second direction B are two different directions. Optionally, the first direction A and the second direction B are perpendicular to each other. Optionally, the first direction A is identical to the column direction Y. Optionally, the second direction B is identical to the row direction X.

In some embodiments, referring to FIG. 3B, a respective one of the plurality of minimum translational repeating units 40 includes one of the plurality of first subpixels 401, one of the plurality of second subpixels 402, and two of the plurality third subpixels 403 (i.e., one of the plurality of first subpixels 401 is insufficient to constitute the respective one of the plurality of minimum translational repeating units 40; one of the plurality of second subpixels 402 is insufficient to constitute the respective one of the plurality of minimum translational repeating units 40; one of the plurality of third subpixels 403 is insufficient to constitute the respective one of the plurality of minimum translational repeating units 40).

In some embodiments, the plurality of third subpixels 403 are grouped into a plurality of pairs of adjacent third subpixels. For example, a respective one pair of the plurality of pairs of adjacent third subpixels includes a first one 403*a* of a respective one pair of the plurality of pairs of adjacent third subpixels and a second one 403*b* of the respective one pair of the plurality of pairs of adjacent third subpixels.

Optionally, one of the plurality of first subpixels and one of the plurality of second subpixels in a respective one of the plurality of minimum translational repeating units are aligned along the row direction; and a respective one pair of the plurality of pairs of adjacent third subpixels in the respective one of the plurality of minimum translational repeating units are aligned along the column direction.

Optionally, in the respective one of the plurality of minimum translational repeating units, orthographic projections of a respective one pair of the plurality of pairs of adjacent third subpixels on a plane perpendicular to the column direction are between an orthographic projection of a respective one of the plurality of first subpixels on the plane perpendicular to the column direction and an orthographic projection of a respective one of the plurality of second subpixels on the plane perpendicular to the column direction.

In some embodiments, the plurality of subpixels of the pixel arrangement constitute a plurality of virtual pixels. Optionally, the plurality of third subpixels are grouped into a plurality of virtual pixels arranged along the row direction X and the column direction Y. Optionally, columns and rows defined by an array of the plurality of third subpixels are equivalent (e.g., identical) to columns and rows defined by an array of the plurality of the plurality of virtual pixels.

Optionally, a respective one of the plurality of virtual pixels includes a subpixel selected from the respective one of the plurality of pairs of adjacent third subpixels; and a subpixel selected from the respective one of the plurality of first subpixels and the respective one of the second subpixels. Optionally, a plurality of virtual pixel can be defined in different ways based on different driving methods. Optionally, four subpixels in the respective one of the plurality of minimum translational repeating units 40 are assigned into three different virtual pixels of the plurality of virtual pixels.

Figure 5A:
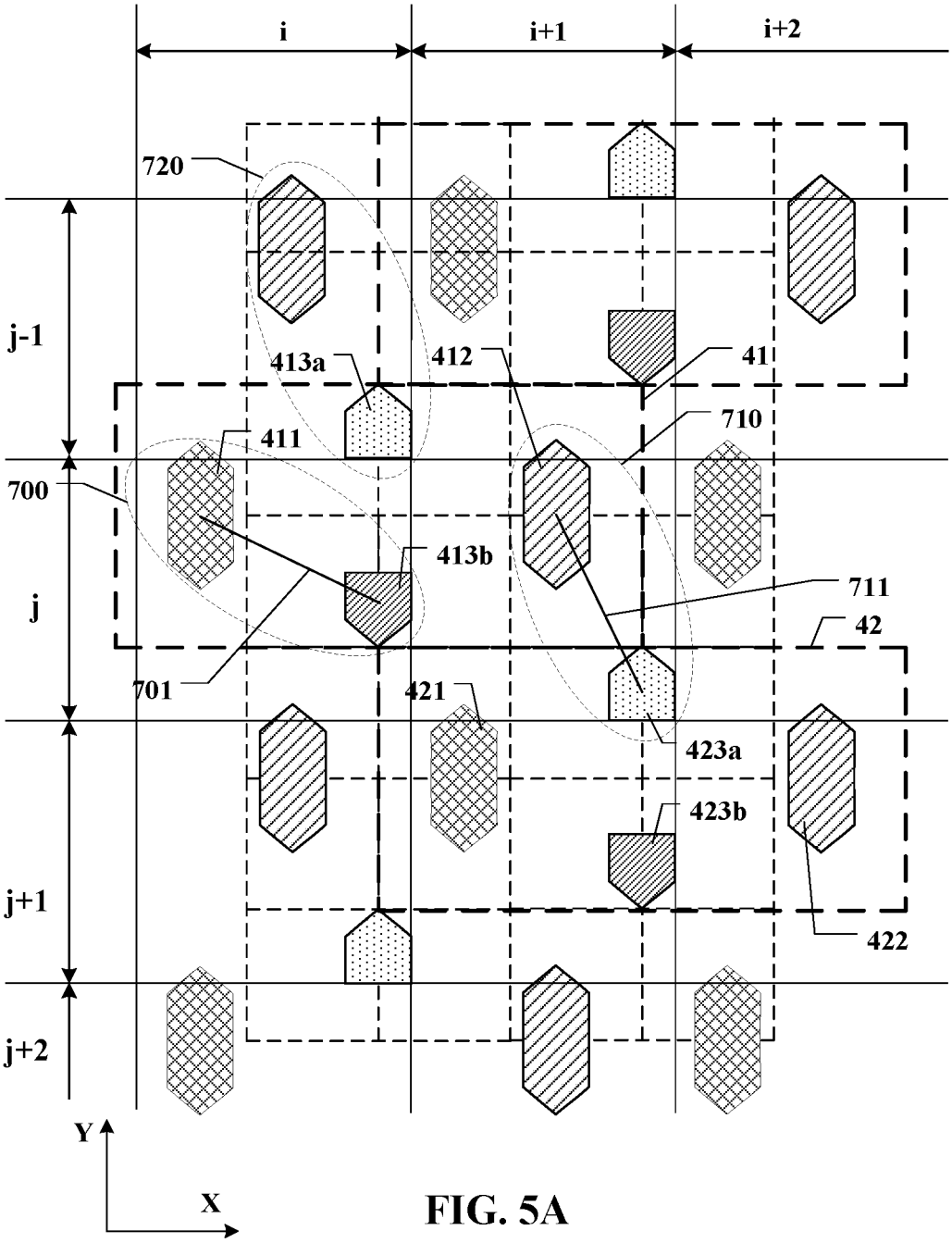
FIG. 5A is a schematic diagram of a partial structure of an array of the plurality of virtual pixels of a pixel arrangement structure in some embodiments according to the present disclosure.
Figure 5B:
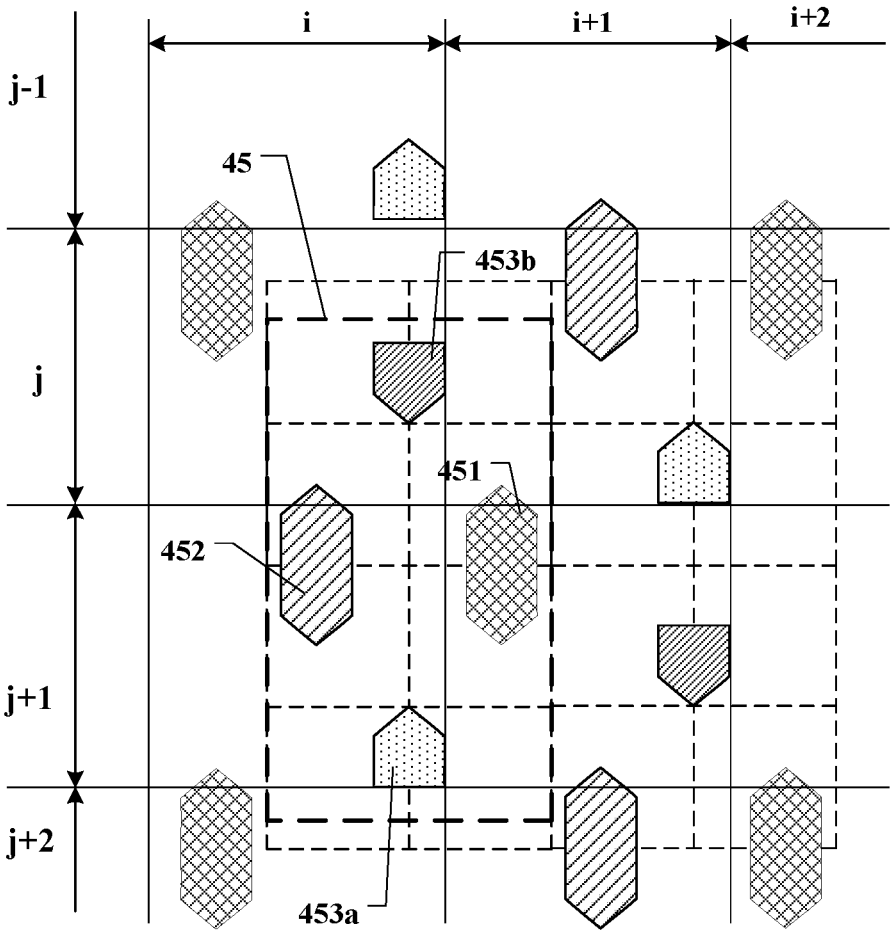
FIG. 5B is a schematic diagram of a partial structure of an array of the plurality of virtual pixels of a pixel arrangement structure in some embodiments according to the present disclosure.

FIG. 5A is a schematic diagram of a partial structure of an array of the plurality of virtual pixels of a pixel arrangement structure in some embodiments according to the present disclosure. FIG. 5B is a schematic diagram of a partial structure of an array of the plurality of virtual pixels of a pixel arrangement structure in some embodiments according to the present disclosure.

In some embodiments, referring to FIG. 3A and FIG. 5A, the p-th repeating row includes a first minimum translational repeating unit 41. The (p+1)-th repeating row includes a second minimum translational repeating unit 42, and a third minimum translational repeating unit 43. The (p+2)-th repeating row includes a fourth minimum translational repeating unit 44.

Optionally, a first virtual pixel 700 of the plurality of virtual pixels in the i-th column and in the j-th row includes a subpixel 411 of the plurality of first subpixels 401 in the i-th column and in the j-th row and a subpixel 413*b* of the plurality of third subpixels 403 in the i-th column and in the j-th row, both the subpixel 411 of the plurality of first subpixels 401 and the subpixel 413*b* of the plurality of third subpixels 403 are in a same minimum translational repeating unit (e.g., the first minimum translational repeating unit 41).

Optionally, a second virtual pixel 710 of the plurality of virtual pixels in the (i+1)-th column and in the j-th row includes a subpixel 412 of the plurality of second subpixels 402 in the (i+1)-th column and in the j-th row in the same minimum translational repeating unit as the subpixel 411 (e.g., the first minimum translational repeating unit 41).

Optionally, a third virtual pixel 720 of the plurality of virtual pixels in the i-th column and in the (j−1)-th row includes a subpixel 413*a* of the plurality of third subpixels 403 in the i-th column and in the (j−1)-th row in the same minimum translational repeating unit as the subpixel 411 (e.g., the first minimum translational repeating unit 41).

Optionally, the subpixel 413*b* of the plurality of third subpixels 403 in the i-th column and in the j-th row and the subpixel 413*a* of the plurality of third subpixels 403 in the i-th column and in the (j−1)-th row are grouped into one of the plurality of pairs of adjacent third subpixels.

In the first minimum translational repeating unit 41, the subpixel 411 of the plurality of first subpixels 401 in the i-th column and in the j-th row, the subpixel 413*a* of the plurality of third subpixels 403 in the i-th column and in the (j−1)-th row, and the subpixel 413*b* of the plurality of third subpixels 403 in the i-th column and in the j-th row are in the same column (e.g., the i-th column). The subpixel 412 of the plurality of second subpixels 402 in the (i+1)-th column and in the j-th row is in the (i+1)-th column.

In the first minimum translational repeating unit 41, the subpixel 411 of the plurality of first subpixels 401 in the i-th column and in the j-th row, the subpixel 412 of the plurality of second subpixels 402 in the (i+1)-th column and in the j-th row is in the (i+1)-th column, and the subpixel 413*b* of the plurality of third subpixels in the i-th column and in the j-th row are in the same row (e.g. the j-th row). The subpixel 413*a* of the plurality of third subpixels 403 in the i-th column and in the (j−1)-th row is in the (j−1)-th row.

In some embodiments, the plurality of virtual pixels includes a plurality of first type virtual pixels and a plurality of second type virtual pixels. In one example, a respective one of the plurality of first type virtual pixels includes one of the plurality of first subpixels 401 and one of the plurality of third subpixels 403 from a same minimum translational repeating unit. In another example, a respective one of the plurality of second type virtual pixel includes one of the plurality of second subpixels 402, and one of the plurality of third subpixels 403 from different minimum translational repeating units.

In one example, the first virtual pixel 700 of the plurality of virtual pixels in the i-th column and in the j-th row is one of the plurality of first type virtual pixels. The subpixel 411 of the plurality of first subpixels 401 in the i-th column and in the j-th row, and the subpixel 413*b* of the plurality of third subpixels 403 in the i-th column and in the j-th row are from a same translational repeating unit (e.g., the first minimum translational repeating unit 41).

In another example, the second virtual pixel 710 of the plurality of virtual pixels in the (i+1)-th column and in the j-th row is one of the plurality of second type virtual pixels. The subpixel 412 of the plurality of second subpixels 402 in the (i+1)-th column and in the j-th row is from the first minimum translational repeating unit 41, and the subpixel 423*a* of the plurality of third subpixels 403 in the (i+1)-th column and in the j-th row is from the second minimum translational repeating unit 42 which is different from the first minimum translational repeating unit 41.

Optionally, the plurality of first type virtual pixels and the plurality of second type virtual pixels are alternatively arranged along the row direction X. Optionally, the plurality of first type of virtual pixels and the plurality of second type of virtual pixels are alternatively arranged along the column direction Y.

Optionally, along the row direction X, two subpixels of the plurality of third subpixels 403 respective in two adjacent virtual pixels are from two different minimum translational repeating units.

Optionally, a center-connecting line connecting centers of two subpixels in the respective one of the plurality of first type virtual pixels has a same first connecting direction. A center-connecting line connecting centers of two subpixels in the respective one of the plurality of second type virtual pixels has a same second connecting direction. Optionally, the first connecting direction and the second connecting direction are different.

For example, a first line 701, connecting a center of the subpixel 411 of the plurality of first subpixels 401 in the i-th column and in the j-th row and a center of subpixel 413*b* of the plurality of third subpixels 403 in the i-th column and in the j-th row, has a direction different from a direction of a second line 711, connecting a center of the subpixel 412 of the plurality of second subpixels 402 in the (i+1)-th column and in the j-th row and a center of the subpixel 423*a* of the plurality of third subpixels 403 in the (i+1)-th column and in the j-th row.

In some embodiments, centers of all the third subpixels in a same column (including third subpixels from the first type virtual pixels and third subpixels from the second type virtual pixels) are in a straight line having a direction parallel to the column direction Y. Centers of all the first subpixels from the first type virtual pixels in a same column are in a straight line having a direction parallel to the column direction Y. Centers of all the second subpixels from the second type virtual pixels in a same column are in a straight line having a direction parallel to the column direction Y. Those three straight lines are not overlapping with each other.

In some embodiments, centers of all the first subpixels from the first type virtual pixels and centers of all the scone subpixel from the second type virtual pixels, in a same row, are in a straight line having a direction parallel to the row direction X. Centers of all the third subpixels in a same row (including third subpixels from first type virtual pixels and third subpixels from second type virtual pixels) are in a straight line having a direction parallel to the row direction X. Those two straight lines are not overlapping with each other.

In some embodiments, referring to FIG. 4, the method of driving the pixel arrangement structure includes deriving an first actual data signal of a subpixel of the plurality of first subpixels in the i-th column and in the j-th row, based on a theoretical data signal of a first logic subpixel of the first color from a first logic pixel in the (i−1)-th column and in the (j−1)-th row and a theoretical data signal of a first logic subpixel of the first color from a second logic pixel in the (i−1)-th column and the j-th row; deriving a second actual data signal of a subpixel of the plurality of third subpixels in the i-th column and in the j-th row, based on a theoretical data signal of a third logic subpixel of the third color from a third logic pixel in the i-th column and in the j-th row; deriving a third actual data signal of a subpixel of the plurality of second subpixels in an (i+1)-th column and in the j-th row, based on a theoretical data signal of a second logic subpixel of the second color from a fourth logic pixel in the (i+1)-th column and in the (j−1)-th row and a theoretical data signal of a second logic subpixel of the second color from a fifth logic pixel in the (i+1)-th column and in the j-th row; and deriving a fourth actual data signal of a subpixel of the plurality of third subpixels in the i-th column and in the (j−1)-th row, based on a theoretical data signal of a third logic subpixel of the third color from a sixth logic pixel in the i-th column and in the (j−1)-th row; wherein $2 \le i \le I$, $2 \le j \le J$.

In some embodiments, a plurality of logic pixels includes the first logic pixel, the second logic pixel, the third logic pixel, the fourth logic pixel, the fifth logic pixel, and the sixth logic pixel. Optionally, a respective one of the plurality of logic pixels includes a first logic subpixel of the first color, a second logic subpixel of the second color, and a third logic subpixel of the third color. So, a respective one of the plurality of logic pixels can independently display all kinds of colors. However, the respective one of the plurality of virtual pixels can only display some colors, for example, the respective one of the plurality of virtual pixel cannot display substantially white color.

In some embodiments, in the present disclosure, the theoretical data signal of the respective one of the plurality of logic pixels includes coordinates and brightness information defined by the image signal system, and is irrelevant to a physical structure of a display apparatus.

For example, when the theoretical data signal of the respective one of the plurality of logic pixels is to be displayed, a data driver will produce three theoretical data signals including a theoretical data signal of the first logic subpixel, a theoretical data signal of the second logic subpixel, and a theoretical data signal of the third logic subpixel. In the respective one of the plurality of logic pixels, when a gray scale of the first logic subpixel, a gray scale of the second logic subpixel, and a gray scale of the third logic subpixel are both 225, the respective one of the plurality of logic pixels can display the substantially white color.

Because the respective one of the plurality of virtual pixels includes only two subpixels, while the respective one of the plurality of logic pixel includes three subpixels, the amount of data produced by the data driver for the plurality of logic subpixels cannot match the number of subpixels in the pixel arrangement structure. Therefore, the amount of data produced by the data driver cannot be directly transmitted to the plurality of virtual pixels. Alternatively, the amount of data produced by the data driver should be converted using the Sup-Pixel Rendering to obtain actual data signals for the plurality of virtual pixels. The actual data signals are signals transmitted from data lines to the plurality of virtual pixels in the pixel arrangement structure.

Optionally, the plurality of logic pixels are arranged in RGBRGB-stripe arrangement. Optionally, the plurality of logic pixels are arranged in an array along the row direction and the column direction. For example, the plurality of logic pixels are not real-existing pixels. But the subpixels of the plurality of virtual pixels are real-existing subpixels in the pixel arrangement structure.

Optionally, the number of the plurality of logic pixels and the number of the plurality of virtual pixels are the same. A respective one of the plurality of logic pixels corresponds to a respective one of the plurality of virtual pixels.

Optionally, the respective one of the plurality of logic pixels includes a red subpixel, a green subpixel, and a blue subpixel. The respective one of the plurality of virtual pixels include a green subpixel, and a pixel selected from a red subpixel and a blue subpixel.

Optionally, a display panel has an array of the plurality of virtual pixels having h1 rows and h2 columns, so the number of virtual pixels is h1×h2. So, a virtual pixel of the plurality of virtual pixels in the i-th column and the j-th row corresponds to a logic pixel of the plurality of logic pixels in the i-th column and the j-th row. An actual data signal of the virtual pixel of the plurality of virtual pixels in the i-th column and the j-th row is derived based on a theoretical data signal of the logic pixel of the plurality of logic pixels in the i-th column and the j-th row.

In some embodiments, based different relations between the positions of the plurality of virtual pixels and the positions of the plurality of logic pixels, and different display requirements, an actual date signal of a subpixel of a selected color in the respective one of the plurality of the virtual pixels is calculated based on a theoretical data signal of a logic subpixel of the selected color from a respective one of the plurality of logic pixels and a theoretical data signal of a logic subpixel of the selected color from one of the plurality of logic pixels adjacent to the respective one of the plurality of logic pixels.

In some embodiments, the first actual data signal of the subpixel of the plurality of first subpixels in the i-th column and in the j-th row is represented by a following equation:

$$X_{i,j} = (\alpha_1 \cdot x_{i-1,j-1}^{\gamma} + \alpha_2 \cdot x_{i-1,j}^{\gamma})^{\frac{1}{\gamma}}; \tag{2.1}$$

wherein $X_{i,j}$ represents the first actual data signal of the subpixel of the plurality of first subpixels in the i-th column and in the j-th row; $x_{i-1,j-1}$ represents the theoretical data signal of the first logic subpixel of the first color from the first logic pixel in the (i−1)-th column and in the (j−1)-th row; $x_{i-1,j}$ represents the theoretical data signal of the first logic subpixel of the first color from the second logic pixel in the (i−1)-th column and the j-th row; $\alpha_1$ represents a weight of the $x_{i-1,j-1}$; $\alpha_2$ represents a weight of the $x_{i-1,j}$; and $\gamma$ is a constant.

In some embodiments, the ratio of $\alpha_1$ to $\alpha_2$ is 1:1. Optionally, $\alpha_1$ and $\alpha_2$ have a same value. For example, each of the $\alpha_1$ and the $\alpha_2$ is 0.5. Optionally, $\alpha_1$ and $\alpha_2$ have different values. For example, $\alpha_1$ is 0.4, and $\alpha_2$ is 0.6.

For example, two adjacent virtual pixels in a same row or a same column is symmetrical with respect to a center line between a first subpixel and a second subpixel of the two adjacent virtual pixels, and the third subpixels respectively in the two adjacent virtual pixels are symmetrical with respect to the center line of a first subpixel and a second subpixel of the two adjacent virtual pixels. Thus, the first subpixel is shared by two adjacent logical pixels in a 1:1 ratio, and the second subpixel is shared by two adjacent logical pixels in a 1:1 ratio.

In some embodiments, the second actual data signal of the subpixel of the plurality of third subpixels in the i-th column and in the j-th row is represented by a following equation:

$$G_{i,j}=g_{i,j} \quad (2.2);$$

wherein $G_{i,j}$ represents the second actual data signal of the subpixel of the plurality of third subpixels in the i-th column and in the j-th row; $g_{i,j}$ represents the theoretical data signal of the third logic subpixel of the third color from the third logic pixel in the i-th column and in the j-th row.

In some embodiments, the third actual data signal of the subpixel of the plurality of second subpixels in an (i+1)-th column and in the j-th row is represented by a following equation:

$$Y_{i+1,j}=(\beta_1\cdot y_{i+1,j-1}^{\gamma}+\beta_2\cdot y_{i+1,j}^{\gamma})^{\frac{1}{\gamma}}; \quad (2.3)$$

wherein $Y_{i+1,j}$ represents the third actual data signal of the subpixel of the plurality of second subpixels in an (i+1)-th column and in the j-th row; $y_{i+1,j-1}$ represents the theoretical data signal of the second logic subpixel of the second color from the fourth logic pixel in the (i+1)-th column and in the (j−1)-th row; $y_{i+1,j}$ represents the theoretical data signal of the second logic subpixel of the second color from the fifth logic pixel in the (i+1)-th column and in the j-th row; $\beta_1$ represents a weight of the $y_{i+1,j-1}$; and $\beta_2$ represents a weight of the $y_{i+1,j}$; and $\gamma$ is a constant.

In some embodiments, the ratio of $\beta_1$ to $\beta_2$ is 1:1. Optionally, $\beta_1$ and $\beta_2$ have a same value. For example, each of the $\beta_1$ and the $\beta_2$ is 0.5. Optionally, $\beta_1$ and $\beta_2$ have different values. For example, $\beta_1$ is 0.4, and $\beta_2$ is 0.6.

For example, two adjacent virtual pixels in a same row or a same column is symmetrical with respect to a center line between a first subpixel and a second subpixel of the two adjacent virtual pixels, and the third subpixels respectively in the two adjacent virtual pixels are symmetrical with respect to the center line of a first subpixel and a second subpixel of the two adjacent virtual pixels. Thus, the first subpixel is shared by two adjacent logical pixels in a 1:1 ratio, and the second subpixel is shared by two adjacent logical pixels in a 1:1 ratio.

In some embodiments, the fourth actual data signal of the subpixel of the plurality of third subpixels in the i-th column and in the (j−1)-th row is represented by a following equation:

$$G_{i,j-1}=g_{i,j-1} \quad (2.4);$$

wherein $G_{i,j-1}$ represents the fourth actual data signal of the subpixel of the plurality of third subpixels in the i-th column and in the (j−1)-th row; and $g_{i,j-1}$ represents the theoretical data signal of the third logic subpixel of the third color from the sixth logic pixel in the i-th column and in the (j−1)-th row.

In some embodiments, in order to prevent color shift from occurring on edges of a display area of a display panel, weights of theoretical data signals of logic subpixels of the plurality of logic subpixels on edges of the display area will be decreased, so $\alpha_1$ and $\alpha_2$ in the equation (2.1) may be less than 1, and $\beta_1$ and $\beta_2$ in the equation (2.3) may be less than 1.

In some embodiments, for multiple subpixels of first subpixels and multiple subpixels of second subpixels on edges of a figure displayed by the display panel, The $\alpha_1$, $\alpha_2$, $\beta_1$, and $\beta_2$ should also be adjusted to avoid color shift.

In some embodiments, when the display panel displays special figures or special patterns, distortion may be generated because the special figures or special patterns interferes with subpixels in the pixel arrangement structure, so, the $\alpha_1$, $\alpha_2$, $\beta_1$, and $\beta_2$ should be adjusted to avoid the distortion. For example, to ensure that brightness of the special figures or special patterns does not fluctuate greatly, each of the $\alpha_1$ and $\alpha_2$ is 1, and each of the $\beta_1$ and $\beta_2$ is 1.

In some embodiments, $\gamma$ represents relations between actual data signals and display brightness. In one example, when $X_{i,j}$ represents the first actual data signal of the subpixel of the plurality of first subpixels in the i-th column and in the j-th row, a brightness of the subpixel of the plurality of first subpixels in the i-th column and in the j-th row is represented by the following equation: $L_X=C_X\cdot X_{i,j}^{\gamma}$, wherein $L_X$ represents the brightness of the subpixel of the plurality of first subpixels in the i-th column and in the j-th row, and $C_X$ is determined by physical characteristics of the subpixel of the plurality of first subpixels in the i-th column and in the j-th row.

In another example, when $Y_{i+1,j}$ represents the third actual data signal of the subpixel of the plurality of second subpixels in the (i+1)-th column and in the j-th row, a brightness of the subpixel of the plurality of second subpixels in the (i+1)-th column and in the j-th row is represented by the following equation: $L_Y=C_Y\cdot Y_{i+1,j}^{\gamma}$, wherein $L_Y$ represents the brightness of the subpixel of the plurality of second subpixels in the (i+1)-th column and in the j-th row, and $C_Y$ is determined by physical characteristics of the subpixel of the plurality of second subpixels in the (i+1)-th column and in the j-th row.

In one example, when $x_{i-1,j-1}$ represents the theoretical data signal of the first logic subpixel of the first color from the first logic pixel in the (i−1)-th column and in the (j−1)-th row, a brightness of the first logic subpixel from the first logic pixel in the (i−1)-th column and in the (j−1)-th row is represented by the following equation: $L_x=C_x\cdot x_{i-1,j-1}^{\gamma}$, wherein $L_x$ represents the brightness of the first logic subpixel of the first color from the first logic pixel in the (i−1)-th column and in the (j−1)-th row, $C_x$ is determined by physical characteristics of the first logic subpixel from the first logic pixel in the (i−1)-th column and in the (j−1)-th row.

In another example, when represents the theoretical data signal of the second logic subpixel of the second color from the fourth logic pixel in the (i+1)-th column and in the (j−1)-th row, a brightness of the second logic subpixel of the second color from the fourth logic pixel in the (i+1)-th column and in the (j−1)-th row is represented by the following equation: $L_y=C_y\cdot y_{i+1,j-1}^{\gamma}$; wherein $L_y$ represents the brightness of the second logic subpixel of the second color from the fourth logic pixel in the (i+1)-th column and in the (j−1)-th row, $C_y$ is determined by physical characteristics of the second color from the fourth logic pixel in the (i+1)-th column and in the (j−1)-th row.

In some embodiments, in the equation (2.1) and equation (2.4), the subscript i and the subscript j represent pixel addressing coordinates (e.g. including pixel addressing coordinates of a subpixel in the respective one of the plurality of virtual pixels, and pixel addressing coordinates of a logic subpixel in the respective one of the plurality of logic pixels).

In some embodiments, according to the equation (2.1), the first actual data signal of the subpixel of the plurality of first subpixels in the i-th column and in the j-th row is determined by the theoretical data signal of the first logic subpixel of the first color from the first logic pixel in the (i−1)-th column and in the (j−1)-th row, and the theoretical data signal of the first logic subpixel of the first color from the second logic pixel in the (i−1)-th column and the j-th row. It is discovered that the first logic pixel in the (i−1)-th column and in the (j−1)-th row and the second logic pixel in the (i−1)-th column and the j-th row are in a same column, but in different rows.

In some embodiments, according to the equation (2.3), the third actual data signal of the subpixel of the plurality of second subpixels in the (i+1)-th column and in the j-th row is determined by the theoretical data signal of the second logic subpixel of the second color from the fourth logic pixel in the (i+1)-th column and in the (j−1)-th row, and the theoretical data signal of the second logic subpixel of the second color from the fifth logic pixel in the (i+1)-th column and in the j-th row. It is discovered that the fourth logic pixel in the (i+1)-th column and in the (j−1)-th row and the fifth logic pixel in the (i+1)-th column and in the j-th row are in a same column, but in different rows.

In some embodiments, according to the equation (2.2) and equation (2.4), the actual data signal of a respective one of the plurality of third subpixels is determined by the theoretical data signal of a third logic subpixel from a respective one of the plurality of logic pixels, because the respective one of the plurality of third subpixels corresponds to the third logic subpixel from the respective one of the plurality of logic pixels.

In some embodiments, referring to FIG. 3C, a respective one of the plurality of minimum translational repeating units 40 is arranged in an arrangement different from the arrangement of the respective one of the plurality of minimum translational repeating units 40 shown in FIG. 3B.

In some embodiments, the respective one of the plurality of minimum translational repeating units 40 includes one of the plurality of first subpixels 401, one of the plurality of second subpixels 402, and two of the plurality third subpixels 403 (i.e., one of the plurality of first subpixels 401 is insufficient to constitute the respective one of the plurality of minimum translational repeating units 40; one of the plurality of second subpixels 402 is insufficient to constitute the respective one of the plurality of minimum translational repeating units 40; one of the plurality of third subpixels 403 is insufficient to constitute the respective one of the plurality of minimum translational repeating units 40).

In some embodiments, the plurality of third subpixels 403 are grouped into a plurality of pairs of adjacent third subpixels. For example, a respective one pair of the plurality of pairs of adjacent third subpixels includes a first one 403*a* of a respective one pair of the plurality of pairs of adjacent third subpixels and a second one 403*b* of the respective one pair of the plurality of pairs of adjacent third subpixels.

In some embodiments, in the respective one of the plurality of minimum translational repeating units 40, an orthographic projection of a respective one of the plurality of first subpixels 401 on a plane perpendicular to the row direction X and an orthographic projection of a respective one of the plurality of second subpixels 402 on the plane perpendicular to the row direction X are between orthographic projections of a respective one pair of the plurality of pairs of adjacent third subpixels (e.g., 403*a* and 403*b*) on the plane perpendicular to the row direction X.

Optionally, in the respective one of the plurality of minimum translational repeating units 40, a center-connecting line connecting a center of the subpixel of the plurality of first subpixels 401 and a center of the subpixel of the plurality of second subpixels 402 has a length greater than a length of a center-connecting line connecting centers of the two subpixels of the plurality third subpixels 403 (e.g., 403*a* and 403*b*).

Optionally, in the respective one of the plurality of minimum translational repeating units 40, the center-connecting line connecting the center of the subpixel of the plurality of first subpixels 401 and the center of the subpixel of the plurality of second subpixels 402 is perpendicular to the center-connecting line connecting centers of the two subpixels of the plurality third subpixels 403 (e.g., 403*a* and 403*b*). Optionally, the center-connecting line connecting the center of the subpixel of the plurality of first subpixels 401 and the center of the subpixel of the plurality of second subpixels 402 intersects a midpoint of the center-connecting line connecting centers of the two subpixels of the plurality third subpixels 403 (e.g., 403*a* and 403*b*).

FIG. 5B shows a partial structure of the pixel arrangement structure having the respective one of the plurality of minimum translational repeating units 40 shown in FIG. 3C. In some embodiments, the plurality of minimum translational repeating units 40 includes a fifth minimum translational repeating unit 45. Optionally, the fifth minimum translational repeating unit 45 includes a subpixel 453*b* of the plurality of third subpixels 403 in the i-th column and in the j-th row, a subpixel 451 of the plurality of first subpixels 401 in the (i+1)-th column and in the (j+1)-th row, a subpixel 452 of the plurality of second subpixels 402 in the i-th row and in the (j+1)-th column, and a subpixel 453*a* of the plurality of third subpixels 403 in the i-th column and in the (j+1)-th row.

In some embodiments, referring to FIG. 3C and FIG. 5B, in the fifth minimum translational repeating unit 45, a fifth actual data signal of the subpixel 453*b* of the plurality of third subpixels 403 in the i-th column and in the j-th row is represented by a following equation:

$$G_{i,j}=g_{i,j};$$

wherein $G_{i,j}$ represents the fifth actual data signal of the subpixel 453*b* of the plurality of third subpixels 403 in the i-th column and in the j-th row, and $g_{i,j}$ represents the theoretical data signal of the third logic subpixel of the third color from the third logic pixel in the i-th column and in the j-th row.

In some embodiments, a sixth actual data signal of the subpixel 451 of the plurality of first subpixels 401 in the (i+1)-th column and in the (j+1)-th row is represented by the following equation:

$$X_{i+1,j+1} = (\alpha_1 \cdot x_{i,j}^{\gamma} + \alpha_2 \cdot x_{i,j+1}^{\gamma})^{\frac{1}{\gamma}};$$

wherein $X_{i+1,j+1}$ represents the sixth actual data signal of the subpixel 451 of the plurality of first subpixels 401 in the (i+1)-th column and in the (j+1)-th row; $x_{i,j}$ represents a theoretical data signal of a first logic subpixel of the first color from the third logic pixel in the i-th column and in the j-th row; $x_{i,j+1}$ represents a theoretical data signal of a first logic subpixel of the first color from a seventh logic pixel in the i-th column and in the (j+1)-th row; $\alpha_1$ represents a weight of the $x_{i,j}$; $\alpha_2$ represents a weight of the $x_{i,j+1}$; and $\gamma$ is a constant.

In some embodiments, a seventh actual data signal of the subpixel 452 of the plurality of second subpixels 402 in the i-th row and in the (j+1)-th column is represented by a following equation:

$$Y_{i,j+1} = (\beta_1 \cdot y_{i,j}^{\gamma} + \beta_2 \cdot y_{i,j+1}^{\gamma})^{\frac{1}{\gamma}};$$

wherein $Y_{i,j+1}$ represents the seventh actual data signal of the subpixel 452 of the plurality of second subpixels 402 in the i-th row and in the (j+1)-th; $y_{i,j}$ represents a theoretical data signal of a second logic subpixel of the second color from the third logic pixel in the i-th column and in the j-th row; $y_{i,j+1}$ represents a theoretical data signal of a second logic subpixel of the second color from the seventh logic pixel in the i-th column and in the (j+1)-th row; $\beta_1$ represents a weight of the $y_{i,j}$; $\beta_2$ represents a weight of the $y_{i,j+1}$; and $\gamma$ is a constant.

In some embodiments, an eighth actual data signal of the subpixel 453*a* of the plurality of third subpixels 403 in the i-th column and in the (j+1)-th row is represented by a following equation:

$$G_{i,j+1}=g_{i,j+1};$$

wherein $G_{i,j+1}$ represents the eighth actual data signal of the subpixel 453*a* of the plurality of third subpixels 403 in the i-th column and in the (j+1)-th, and $g_{i,j+1}$ represents a theoretical data signal of a third logic subpixel of the third color from the seventh logic pixel in the i-th column and in the (j+1)-th row.

In some embodiments, when the respective one of the plurality of minimum translational repeating units is arranged according to the FIG. 3C, actual data signals of four subpixels of the respective one of the plurality of minimum translational repeating units can be determined by theoretical data signals of two corresponding logic pixels of the plurality of logic subpixels. (e.g. the third logic pixel in the i-th column and in the j-th row and the seventh logic pixel in the i-th column and in the (j+1)-th row)

In some embodiments, referring to FIG. 3A and FIG. 3B, the first color and the second color are two different colors selected from red, and blue; and the third color is green.

In one example, the respective one of the plurality of first subpixels 401 has a red color. The respective one of the plurality of second subpixels 402 has a blue color. The respective one of the plurality of third subpixels 403 has a green color. For example, the first one 403*a* of the respective one pair of the plurality of pairs of adjacent third subpixels has the green color, a second one 403*b* of the respective one pair of the plurality of pairs of adjacent third subpixels has the green color. So, a first logic subpixel of the respective one of the plurality of logic pixels has the red color, a second logic subpixel of the respective one of the plurality of logic pixels has the blue color, and a third logic subpixel of the respective one of the plurality of logic pixels has the green color.

In another example, the respective one of the plurality of first subpixels 401 has the blue color. The respective one of the plurality of second subpixels 402 has the red color. The respective one of the plurality of third subpixels 403 has the green color. So, the first logic subpixel of the respective one of the plurality of logic pixels has the blue color, the second logic subpixel of the respective one of the plurality of logic pixels has the red color, and the third logic subpixel of the respective one of the plurality of logic pixels has a green color.

Referring to FIG. 3B and FIG. 5A, in some embodiments, i=2 and j=2, therefore, in even rows, the respective one of the plurality of first subpixels is in an even column, the respective one of the plurality of second subpixels is in an odd row. In odd rows, the respective one of the plurality of first subpixels is in an odd column, the respective one of the plurality of second subpixels is in an even column.

In one example, referring to FIG. 5A, in the first minimum translational repeating unit 41, the subpixel 411 of the plurality of first subpixels 401 is in the i-th column (e.g., the even column), and in the j-th row (e.g., the even row). The subpixel 412 of the plurality of second subpixels 402 is in the (i+1)-th column (e.g., the odd column), and in the j-th row (e.g., the even row).

In another example, in the second minimum translational repeating unit 42, a subpixel 421 of the plurality of first subpixels 401 is in the (i+1)-th column (e.g., the odd column), and in the (j+1)-th row (e.g., the odd row). A subpixel 422 of the plurality of second subpixels 402 is in the (i+2)-th column (e.g. the even column), and in the (j+1)-th row (e.g., the add row).

In some embodiments, in the second minimum translational repeating unit 42, the subpixel 421 of the plurality of first subpixels 401 in the (i+1)-th column and the (j+1)-th row, and a subpixel 423*b* of the plurality of third subpixels 403 in the (i+1)-th column and the (j+1)-th row belong to a virtual subpixel of the plurality of virtual subpixels in the (i+1)-th column and the (j+1)-th row. The subpixel 422 of the plurality of second subpixels 402 in the (i+2)-th column and in the (j+1)-th row belongs to a virtual subpixel of the plurality of virtual subpixels in the (i+2)-th column and in the (j+1)-th row. The subpixel 423*a* of the plurality of third subpixels 403 in the (i+1)-th column and in the j-th row belongs to the second virtual pixel 710 in the (i+1)-th column and in the j-th row.

In some embodiments, in the second minimum translational repeating unit 42, a ninth actual data signal of the subpixel 421 of the plurality of first subpixels 401 in the (i+1)-th column and the (j+1)-th row is represented by the following equation:

$$X_{i+1,j+1} = (\alpha_1 \cdot x_{i,j}^{\gamma} + \alpha_2 \cdot x_{i,j+1}^{\gamma})^{\frac{1}{\gamma}};$$

wherein $X_{i+1,j+1}$ represents the ninth actual data signal of the subpixel 421 of the plurality of first subpixels 401 in the (i+1)-th column and the (j+1)-th row; $x_{i,j}$ represents a theoretical data signal of a first logic subpixel of the first color from the third logic pixel in the i-th column and in the j-th row; $x_{i,j+1}$ represents the theoretical data signal of the first logic subpixel of the first color from the seventh logic pixel in the i-th column and in the (j+1)-th row; $\alpha_1$ represents a weight of the $x_i$ $\alpha_2$ represents a weight of the $x_{i,j+1}$; and $\gamma$ is a constant.

In some embodiments, a tenth actual data signal of the subpixel 423*b* of the plurality of third subpixels 403 in the (i+1)-th column and the (j+1)-th row is represented by a following equation:

$$G_{i+1,j+1}=g_{i+1,j+1};$$

wherein $G_{i+1,j+1}$ represents the tenth actual data signal of the subpixel 423*b* of the plurality of third subpixels 403 in the (i+1)-th column and the (j+1)-th row; and $g_{i+1,j+1}$ represents a theoretical data signal of a third logic subpixel of the third color from an eighth logic pixel in the (i+1)-th column and in the (j+1)-th row.

In some embodiments, an eleventh actual data signal of the subpixel 422 of the plurality of second subpixels 402 in the (i+2)-th column and in the (j+1)-th row is represented by a following equation:

$$Y_{i+2,j+1} = (\beta_1 \cdot y_{i+2,j}^{\gamma} + \beta_2 \cdot y_{i+2,j+1}^{\gamma})^{\frac{1}{\gamma}};$$

wherein $Y_{i+2,j+1}$ represents the eleventh actual data signal of the subpixel 422 of the plurality of second subpixels 402 in the (i+2)-th column and in the (j+1)-th row; $y_{i+2,j}$ represents a theoretical data signal of a second logic subpixel of the second color from a ninth logic pixel in the (i+2)-th column and in the j-th row; and $y_{i+2,j+1}$ represents a theoretical data signal of a second logic subpixel of the second color from a tenth logic pixel in the (i+2)-th column and in the (j+1)-th row, $\beta_1$ represents a weight of the $y_{i+2,j}$; and $\beta_2$ represents a weight of the $y_{i+2,j+1}$, and $\gamma$ is a constant.

In some embodiments, a twelfth actual data signal of the subpixel 423*a* of the plurality of third subpixels 403 in the (i+1)-th column and in the j-th row is represented by a following equation:

$$G_{i+1,j}=g_{i+1,j};$$

wherein $G_{i+1,j}$ represents twelfth actual data signal of the subpixel 423*a* of the plurality of third subpixels 403 in the (i+1)-th column and in the j-th row; and $g_{i+1,j}$ represents a theoretical data signal of a third logic subpixel of the third color from the fifth logic pixel in the (i+1)-th column and in the j-th row.

Figure 6:
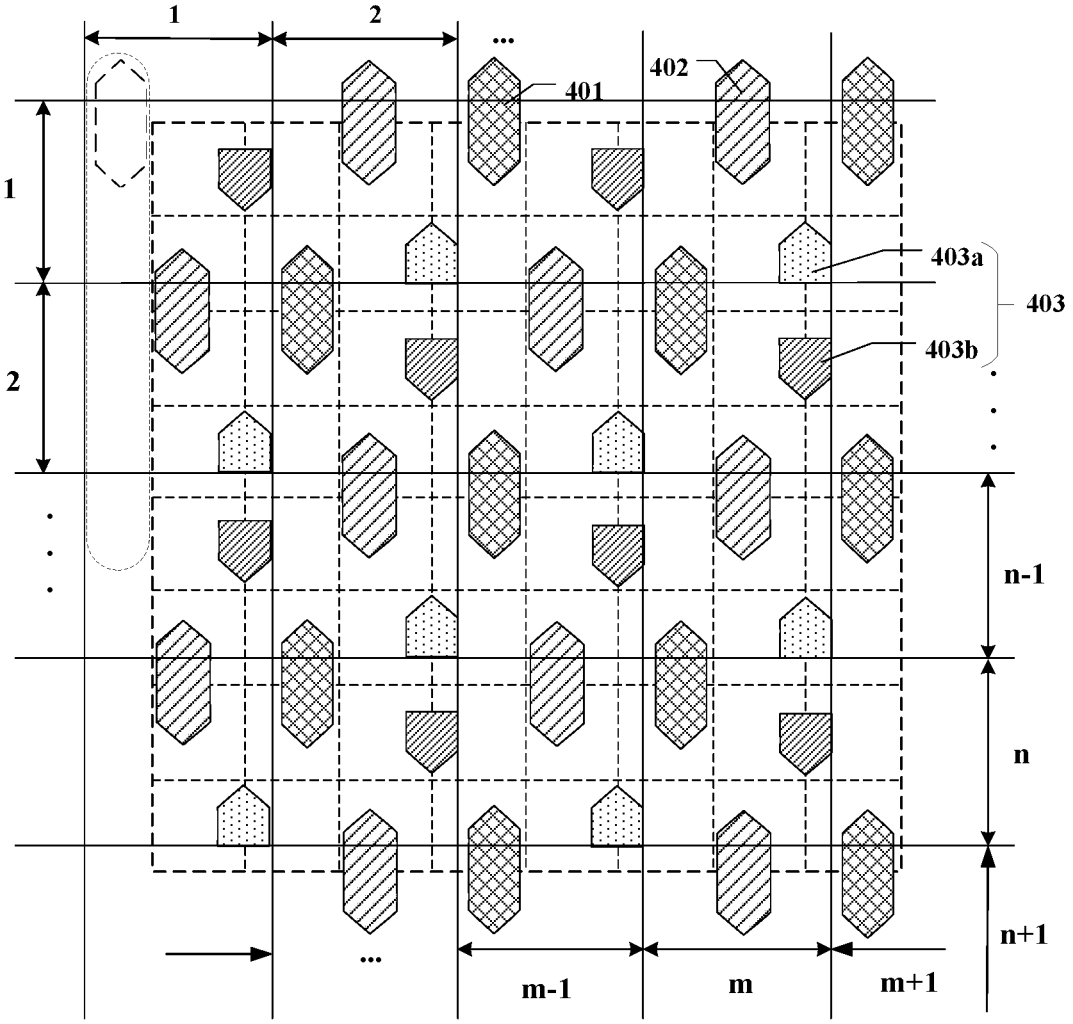
FIG. 6 is a schematic diagram of a partial structure of a pixel arrangement structure in some embodiments according to the present disclosure

FIG. 6 is a schematic diagram of a partial structure of a pixel arrangement structure in some embodiments according to the present disclosure. Referring to FIG. 6, in odd rows, the plurality of first subpixels 401 are in odd columns, the plurality of second subpixels 402 are in the even columns. In even rows, the plurality of first subpixels 401 are in even columns, the plurality of second subpixels 402 are in odd columns.

Optionally, the plurality of virtual pixels are arranged in an array having (m+1) columns and (n+1) rows. Optionally, each of m and n is positive integer, and each of m and n has an even value.

Optionally, no first subpixel of the plurality of first subpixels 401 is arranged in the first column of the pixel arrangement structure, referring to FIG. 6, two first subpixels of the plurality of first subpixels 401 surrounded by a dotted line means that the two first subpixels are not disposed in the first column of the pixel arrangement structure. For example, the first column of the pixel arrangement structure includes only multiple second subpixels of the plurality of second subpixels 402 and multiple third subpixels of the plurality of third subpixels 403.

Optionally, a (m+1)-th column of the pixel arrangement structure includes only multiple first subpixels of the plurality of first subpixels 401.

Optionally, a (n+1)-th row of the pixel arrangement structure includes only multiple first subpixels of the plurality of first subpixels 401 and multiple second subpixels of the plurality of second subpixels 402.

In some embodiments, an actual data signal of a subpixel of a plurality of first subpixels in a (m+1)-th column and a first row is represented by a following equation:

$$X_{m+1,1}=x_{m,1};$$

wherein $X_{m+1,1}$ represents the actual data signal of the subpixel of the plurality of first subpixels in the (m+1)-th column and the first row, and $x_{m,1}$ represents a theoretical data signal of a first logic subpixel of the first color from a logic pixel in a m-th column and in the first row.

Apart from the subpixel of the plurality of first subpixels in the (m+1)-th column and the first row, remaining subpixels of the plurality of first subpixels in the (m+1)-th column are represented by a following equation:

$$X_{m+1,j} = (\alpha_1 \cdot x_{m,j-1}^{\gamma} + \alpha_2 \cdot x_{m,j}^{\gamma})^{\frac{1}{\gamma}};$$

wherein j is an integer; j=3, 5, 7, . . . , n−1; $X_{m+1,j}$ represents the actual data signal of a subpixel of the plurality of first subpixels in the (m+1)-th column and j-th row not including the subpixel of the plurality of first subpixels in the (m+1)-th column and the first row; represents a theoretical data signal of the first logic pixel of the first color from a logic pixel in the m-th column and in the (j−1)-th row; $x_{m,j}$ represents a theoretical data signal of the first logic pixel of the first color from a logic pixel in the m-th column and in the j-th row.

Because n has an even value, in the (n+1)-th row, multiple first subpixels of the plurality of first subpixels 401 are in odd columns, multiple first subpixels of the plurality of second subpixels 402 are in even columns.

Because there is no first subpixel in the first column, in the (n+1)-th row, there is no first subpixel in the (n+1)-th row and in the first column, and there is no subpixel disposed in the (n+1)-th row and in the first column.

In some embodiments, an actual data signal of a subpixel of the plurality of first subpixels in the (n+1)-th row is represented by a following equation:

$$X_{i+1,n+1}=x_{i,n};$$

wherein, i is an integer; i=2, 4, 6, . . . , m; $X_{i+1,n+1}$ represents the actual data signal of a subpixel of the plurality of first subpixels in the (i+1)-th column and in the (n+1)-th row; $x_{i,n}$ represents a theoretical data signal of the first logic pixels of the first color from a logic pixel in the i-th column and in the n-th row.

In some embodiments, an actual data signal of a subpixel of the plurality of second subpixels in the (n+1)-th row is represented by a following equation:

$$Y_{i,n+1}=y_{i,n};$$

wherein, i is an integer; i=2, 4, 6, . . . , m; $Y_{i,n+1}$ represents the actual data signal of a subpixel of the plurality of second subpixels in the i-th column and in the (n+1)-th row; $y_{i,n}$ represents a theoretical data signal of the second logic pixels of the second color from a logic pixel in the i-th column and in the n-th row.

In some embodiments, referring to FIG. 3B, the respective one of the plurality of minimum translational repeating units 40 includes one of the plurality of first subpixels 401, one of the plurality of second subpixels 402, and two of the plurality third subpixels 403. Optionally, the one of the plurality of first subpixels 401 and the one of the plurality of second subpixels 402 in the respective one of the plurality of minimum translational repeating units 40 is arranged along the row direction X.

Optionally, the plurality of third subpixels 403 are grouped into a plurality of pairs of adjacent third subpixels. For example, the respective one of the plurality of pairs of adjacent third subpixels includes a first one 403*a* of the respective one pair of the plurality of pairs of adjacent third subpixels, a second one 403*b* of the respective one pair of the plurality of pairs of adjacent third subpixels. Optionally, the first one 403*a* of the respective one pair of the plurality of pairs of adjacent third subpixels and the second one 403*b* of the respective one pair of the plurality of pairs of adjacent third subpixels are arranged along the column direction Y.

Optionally, in the respective one of the plurality of minimum translational repeating units 40, orthographic projections of a respective one pair of the plurality of pairs of adjacent third subpixels on a plane perpendicular to the column direction Y are between an orthographic projection of a respective one of the plurality of first subpixels on the plane perpendicular to the column direction Y and an orthographic projection of a respective one of the plurality of second subpixels on the plane perpendicular to the column direction Y.

Optionally, in the respective one of the plurality of minimum translational repeating units 40, the one of the plurality of first subpixels 401 and the one of the plurality of second subpixels 402 are arranged in a same order. Optionally, in the same column, multiple subpixels of the plurality of first subpixels 401 and multiple subpixels of the plurality of second subpixels 402 are alternatively arranged.

Optionally, in the respective one of the plurality of minimum translational repeating units 40, the one of the plurality of first subpixels 401 is on a first side of the one pair of the plurality of pairs of adjacent third subpixels away from the one of the plurality of second subpixels 402, and the one of the plurality of second subpixels 402 is on a second side of the one pair of the plurality of pairs of adjacent third subpixels away from the one of the plurality of first subpixels 401.

Referring to FIG. 3A and FIG. 5A, in one example, in the first minimum translational repeating unit 41, along the row direction X, the subpixel 411 of the plurality of first subpixels 401 in the i-th column and in the j-th row is on a first side of a group, including the subpixel 413*a* of the plurality of third subpixels in the i-th column and in the (j−1)-th row and the subpixel 413*b* of the plurality of third subpixels in the i-th column and in the j-th row, away from the subpixel 412 of the plurality of second subpixels 402 in the (i+1)-th column and in the j-th row, e.g., the first side is a left side of the group including the subpixel 413*a* and the subpixel 413*b*.

In another example, in the first minimum translational repeating unit 41, along the row direction X, the subpixel 412 of the plurality of second subpixels 402 in the (i+1)-th column and in the j-th row is on a second side of the group the subpixel 413*a* and the subpixel 413*b* away from the subpixel 411 of the plurality of first subpixels 401 in the i-th column and in the j-th row, e.g., the second side is a right side of the group including the subpixel 413*a* and the subpixel 413*b*.

In one example, in the second minimum translational repeating unit 42, along the row direction X, the subpixel 421 of the plurality of first subpixels 401 in the (i+1)-th column and the (j+1)-th row is on a first side of a group, including the subpixel 423*a* of the plurality of third subpixels 403 in the (i+1)-th column and in the j-th row and the subpixel 423*b* of the plurality of third subpixels 403 in the (i+1)-th column and the (j+1)-th row, away from the subpixel 422 of the plurality of second subpixels 402 in the (i+2)-th column and in the (j+1)-th row.

In another example, in the second minimum translational repeating unit 42, along the row direction X, the subpixel 422 of the plurality of second subpixels 402 in the (i+2)-th column and in the (j+1)-th row is on a second side of the group, including the subpixel 423*a* of the plurality of third subpixels 403 in the (i+1)-th column and in the j-th row and the subpixel 423*b* of the plurality of third subpixels 403 in the (i+1)-th column and the (j+1)-th row, away from the subpixel 421 of the plurality of first subpixels 401 in the (i+1)-th column and the (j+1)-th row.

In some embodiments, along the row direction X, there are at least one subpixel of the plurality of the second subpixels 402 and two subpixels of the plurality of the third subpixels 403 between any two adjacent subpixels of the plurality of first subpixels 401.

In some embodiments, along the row direction, there are at least one subpixels of the plurality of first subpixels 401, and two subpixels of the plurality of the third subpixels 403 between any two adjacent subpixels of the plurality of second subpixels 402.

Referring to FIG. 3B, in some embodiments, in the respective one of the plurality of minimum translational repeating units 40, a first center-connecting line 501 connects a first center C1 of one subpixel of the plurality of first subpixels 401 and a second center C2 of one subpixel of the plurality of second subpixels 402. A second center-connecting line 502 connects two centers of one pair of the plurality of pairs of adjacent third subpixel, for example, the second center-connecting line 502 connects a third center C3 of the first one 403*a* of the respective one pair of the plurality of pairs of adjacent third subpixels and a fourth center C4 of the second one 403*b* of the respective one pair of the plurality of pairs of adjacent third subpixels.

Optionally, the first center-connecting line 501 has a length greater than the second center-connecting line 502. Optionally, the first center-connecting line 501 is perpendicular to the second center-connecting line 502. Optionally, the first center-connecting line 501 is parallel to the row direction X. Optionally, the second center-connecting line 502 is parallel to the column direction Y. Optionally, the first center-connecting line 501 intersects a midpoint of the second center-connecting line 502.

Optionally, the first center C1 of the one subpixel of the plurality of first subpixels 401 is a center of gravity of the one subpixel of the plurality of first subpixels 401. Optionally, the second center C2 of the one subpixel of the plurality of second subpixels 402 is a center of gravity of the one subpixel of the plurality of second subpixels 402. Optionally, the third center C3 of the first one 403*a* of the respective one pair of the plurality of pairs of adjacent third subpixels is a center of gravity of the first one 403*a* of a respective one pair of the plurality of pairs of adjacent third subpixels. Optionally, the fourth center C4 of the second one 403*b* of the respective one pair of the plurality of pairs of adjacent third subpixels is a center of gravity of second one 403*b* of the respective one pair of the plurality of pairs of adjacent third subpixels Optionally, in the respective one of the plurality of minimum translational repeating units 40, the first center C1 of the one subpixel of the plurality of first subpixels 401 and the second center C2 of the one pixels of the plurality of second subpixels 402 are mirror symmetric with respect to the second center-connecting line 502. The third center C3 of the first one 403*a* of the respective one pair of the plurality of pairs of adjacent third subpixels and the fourth center C4 of the second one 403*b* of the respective one pair of the plurality of pairs of adjacent third subpixels are mirror symmetric with respect to the first center-connecting line 501.

For example, the first center C1 of the one subpixel of the plurality of first subpixels 401, the second center C2 of the one pixels of the plurality of second subpixels 402, the third center C3 of the first one 403*a* of the respective one pair of the plurality of pairs of adjacent third subpixels, and the fourth center C4 of the second one 403*b* of the respective one pair of the plurality of pairs of adjacent third subpixels are four vertices of a diamond shape having the first center-connecting line 501 and the second center-connecting line 502 as its diagonals.

In some embodiments, an area of the respective one of the plurality of first subpixels 401 is greater than an area of the respective one of the plurality of third subpixels 403. An area of the respective one of the plurality of second subpixels 402 is greater than the area of the respective one of the plurality of third subpixels 403.

Optionally, the area of the respective one of the plurality of first subpixels 401 equals to a sum of areas of the respective one of the plurality of pairs of adjacent third pixels. The area of the respective one of the plurality of second subpixels 402 equals to the sum of areas of the respective one of the plurality of pairs of adjacent third pixels.

Optionally, an area of the respective one of the plurality of subpixels is determined by luminous efficiency of luminescent materials forming the respective one of the plurality of subpixels. In one example, the respective one of the plurality of subpixels is formed by a luminescent material having a high luminous efficiency, the area of the respective one of the plurality of subpixels can be relatively small. In another example, the respective one of the plurality of subpixels is formed by a luminescent material having a low luminous efficiency, the area of the respective one of the plurality of subpixels should be relatively large.

Optionally, the respective one of the plurality of first subpixel 401 and the respective one of the plurality of second subpixels 402 have a same shape and a same area. Two subpixels of the respective one of the plurality of pairs of adjacent third subpixels have a same shape and a same area.

Optionally, the respective one of the plurality of first subpixels 401 has a substantial hexagonal shape. Optionally, the respective one of the plurality of second subpixels 402 has a substantial hexagonal shape. Optionally, any two sides of the substantial hexagonal shape facing each other are substantially parallel to each other.

As used herein, the term "substantial hexagonal shape" can include shapes or geometries having six sides (regardless of whether the six sides include straight lines, curved lines or otherwise.

As used herein, the term "substantially parallel" means that an angle is in the range of 0 degree to approximately 45 degrees, e.g., 0 degree to approximately 5 degrees, 0 degree to approximately 10 degrees, 0 degree to approximately 15 degrees, 0 degree to approximately 20 degrees, 0 degree to approximately 25 degrees, 0 degree to approximately 30 degrees. For example, an angle of any two sides of the substantial hexagonal shape facing each other is in the range of 0 degree to approximately 45 degrees.

Optionally, each of the respective one of the plurality of pairs of adjacent third subpixels has a substantial pentagonal shape. Optionally, the substantial pentagonal shape has two substantially parallel sides, and a base side substantially perpendicular to the two substantially parallel sides and connecting the substantially parallel sides.

Optionally, a base side of the first one 403*a* of the respective one of the plurality of pairs of adjacent third subpixels is in direct adjacent to a base side of the second one 403*b* of the respective one of a plurality of pairs of adjacent third subpixels.

Optionally, a pair of sides having a longest length among six sides of the respective one of the plurality of first subpixels 401, a pair of sides having a longest length among six sides of the respective one of the plurality of second subpixels 402, and the two substantially parallel sides of the each of the respective one of a plurality of pairs of adjacent third subpixels are substantially parallel.

Various appropriate shapes may be used for forming the respective one of the plurality of first subpixels 401. Example of shapes suitable for forming the respective one of the plurality of first subpixels 401 include, but are not limited to a rectangular shape and an elliptic shape.

Various appropriate shapes may be used for forming the respective one of the plurality of second subpixels 402. Example of shapes suitable for forming the respective one of the plurality of second subpixels 402 include, but are not limited to a rectangular shape and an elliptic shape.

Various appropriate shapes may be used for forming the respective one of the plurality of third subpixels 403. Example of shapes suitable for forming the respective one of the plurality of third subpixels 403 include, but are not limited to a rectangular shape, a square shape, and a diamond shape.

Optionally, the shape of the respective one of the plurality of first subpixels 401 is a shape of an illuminating area of the respective one of the plurality of first subpixels 401. Optionally, the shape of the respective one of the plurality of second subpixels 402 is a shape of an illuminating area of the respective one of the plurality of second subpixels 402. Optionally, the shape of the respective one of the plurality of third subpixels 403 is a shape of an illuminating area of the respective one of the plurality of third subpixels 403.

Optionally, a first width W1 of the respective one of the plurality of first subpixels 401 along the column direction Y is greater than a second width W2 of the respective one of the plurality of first subpixels 401 along the row direction X. Optionally, a third width W3 of the respective one of the plurality of second subpixels 402 along the column direction Y is greater than a fourth width W4 of the respective one of the plurality of second subpixels 402 along the row direction X.

In one example, when the respective one of the plurality of first subpixels 401 has a rectangular shape, a side of the rectangular shape along the column direction Y is longer than a side of the rectangular shape along the row direction X. In another example, when the respective one of the plurality of first subpixels 401 has an elliptic shape, a line connecting two focal points of the elliptic shape is substantially parallel to the column direction Y.

Optionally, the respective one of the plurality of first subpixels 401 is mirror symmetric with respect to an extension line of the first center-connecting line 501. Optionally, the respective one of the plurality of second subpixels 402 is mirror symmetric with respect to an extension line of the first center-connecting line 501. Optionally, the first one 403*a* and the second one 403*b* of the respective one pair of the plurality of pairs of adjacent third subpixels are mirror symmetric with respective to the first center-connecting line 501.

In some embodiments, the plurality of repeating rows are misaligned along the column direction, therefore a minimum translational repeating unit in a respective one of the plurality of repeating rows is misaligned with minimum translational repeating units in a direct adjacent repeating row of the plurality of repeating rows along the column direction.

For example, referring to FIG. 3A, an extension of a center-connecting line connecting two centers of two third subpixels in the first minimum translational repeating unit 41 in the p-th repeating row of the plurality of repeating rows is not overlapping with a center-connecting line connecting two centers of two third subpixels in the second minimum translational repeating unit 42 in the (p+1)-th repeating row of the plurality of repeating rows, and is not overlapping with a center-connecting line connecting two centers of two third subpixels in the third minimum translational repeating unit 43 in the (p+1)-th repeating row of the plurality of repeating rows In some embodiments, P has an even value. Optionally, rows ranked in odd number of the plurality of repeating rows have a same arrangement and are aligned along the column direction. For example, referring to FIG. 3A, the (p−1)-th repeating row and the (p+1)-th repeating row have a same arrangement respective to the plurality of minimum translational repeating units.

Optionally, rows ranked in even number of the plurality of repeating rows has a same arrangement and are aligned along the column direction. For example, the p-th repeating row and the (p+2)-th repeating row have a same arrangement respective to the plurality of minimum translational repeating units. Optionally, the rows ranked in odd number of the plurality of repeating rows and the rows ranked in even number of the plurality of repeating rows are misaligned along the column direction.

Optionally, an extension of a center-connecting line connecting central points of a pair of adjacent third subpixel in a minimum translational repeating unit in a respective one of the plurality of repeating rows intersects a midpoint of a center-connecting line connecting a center of a first subpixel, in a direct adjacent repeating row of the plurality of repeating rows and in direct adjacent to the pair of adjacent third subpixel, and a center of a second subpixel, in the direct adjacent repeating row of the plurality of repeating rows and in direct adjacent to the pair of adjacent third subpixel.

For example, the (p+1)-th repeating row further includes the third minimum translational repeating unit 43. The third minimum translational repeating unit 43 is in direct adjacent to the second minimum translational repeating unit 42. The third minimum translational repeating unit 43 includes a subpixel 431 of the plurality of first subpixel 401, a subpixel 432 of the plurality of second subpixels 402, a subpixel 433*a* of the plurality of third subpixels 403, and a subpixel 433*b* of the plurality of third subpixels 403. The subpixel 433*a* of the plurality of third subpixels 403 and the subpixel 433*b* of the plurality of third subpixels 403 constitutes one of the plurality of pairs of adjacent third subpixels. The subpixel 421 of the plurality of first subpixel 401 in the second minimum translational repeating unit 42 is directly adjacent to the subpixel 413*a* and the subpixel 413*b* of the plurality of third subpixels 403 in the first minimum translational repeating unit 41, the subpixel 432 of the plurality of second subpixels 402 in the third minimum translational repeating unit 43 is directly adjacent to the subpixel 413*a* and the subpixel 413*b* of the plurality of third subpixels 403 in the first minimum translational repeating unit 41. An extension of the center-connecting line connecting the centers of the subpixel 413*a* and the subpixel 413*b* of the plurality of third subpixels 403 in the first minimum translational repeating unit 41 in the p-th repeating row is between the subpixel 421 of the plurality of first subpixel 401 in the second minimum translational repeating unit 42 and the subpixel 432 of the plurality of second subpixels 402 in the third minimum translational repeating unit 43 in the (p+1)-th repeating row.

For example, the (p+2)-th repeating row includes the fourth minimum translational repeating unit 44. The fourth minimum translational repeating unit 44 includes a subpixel 441 of the plurality of first subpixel 401, a subpixel 442 of the plurality of second subpixels 402, a subpixel 443*a* of the plurality of third subpixels 403, and a subpixel 443*b* of the plurality of third subpixels 403. The subpixel 443*a* of the plurality of third subpixels 403 and the subpixel 443*b* of the plurality of third subpixels 403 constitutes one of the plurality of pairs of adjacent third subpixels. The p-th repeating row and the (p+1)-th repeating row are directly adjacent to each other. The (p+1)-th repeating row and the (p+2)-th repeating row are directly adjacent to each other.

Along the column direction Y, the first minimum translational repeating unit 41 is directly adjacent to the second minimum translational repeating unit 42, and directly adjacent to the third minimum translational repeating unit 43. The fourth minimum translational repeating unit 44 is directly adjacent to the second minimum translational repeating unit 42, and directly adjacent to the third minimum translational repeating unit 43.

The extension of the center-connecting line connecting the centers of the subpixel 413*a* and the subpixel 413*b* of the plurality of third subpixels 403 in the first minimum translational repeating unit 41 in the p-th repeating row is overlapping with an extension of the center-connecting line connecting the centers of the subpixel 443*a* and the subpixel 443*b* of the plurality of third subpixels 403 in the fourth minimum translational repeating unit 44. So, the centers of the subpixel 413*a* and the subpixel 413*b* of the plurality of third subpixels 403 in the first minimum translational repeating unit 41 and the centers of the subpixel 443*a* and the subpixel 443*b* of the plurality of third subpixels 403 in the fourth minimum translational repeating unit 44 are in the same line.

A center-connecting line connecting the center of the subpixel 411 of the plurality of first subpixels 401 in the first minimum translational repeating unit 41 and the center of the subpixel 441 of the plurality of first subpixels 401 in the fourth minimum translational repeating unit 44 is parallel to the center-connecting line connecting the centers of the subpixel 413*a* and the subpixel 413*b* of the plurality of third subpixels 403 in the first minimum translational repeating unit 41.

A center-connecting line connecting the center of the subpixel 412 of the plurality of second subpixels 402 in the first minimum translational repeating unit 41 and the center of the subpixel 442 of the plurality of second subpixels 402 in the fourth minimum translational repeating unit 44 is parallel to the center-connecting line connecting the centers of the subpixel 413*a* and the subpixel 413*b* of the plurality of third subpixels 403 in the first minimum translational repeating unit 41.

Figure 7A:
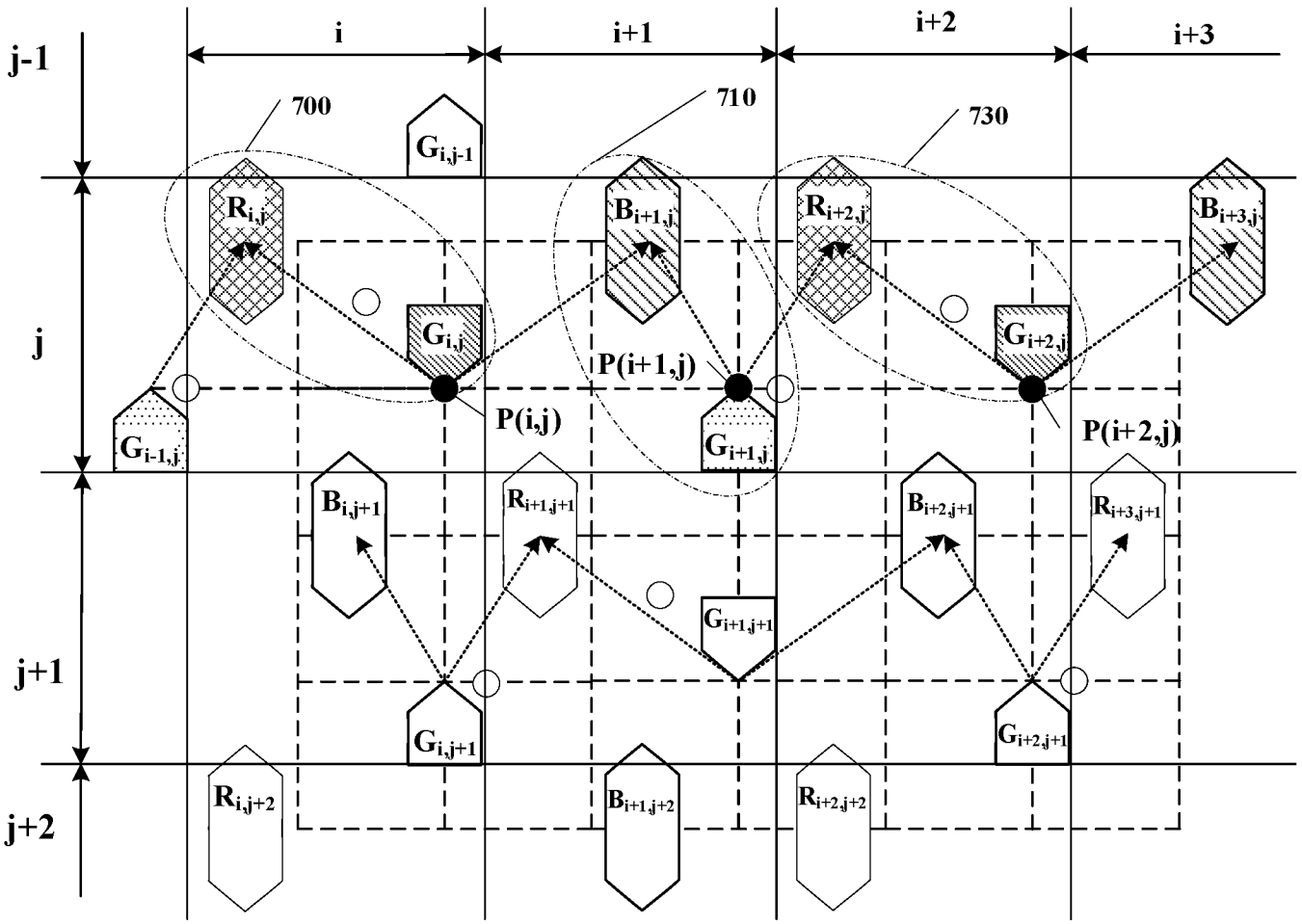
FIG. 7A is a schematic diagram illustrating that a pixel arrangement structure is displaying a horizontal line having a substantially white color using Sup-Pixel Rendering in some embodiments according to the present disclosure.
Figure 7B:
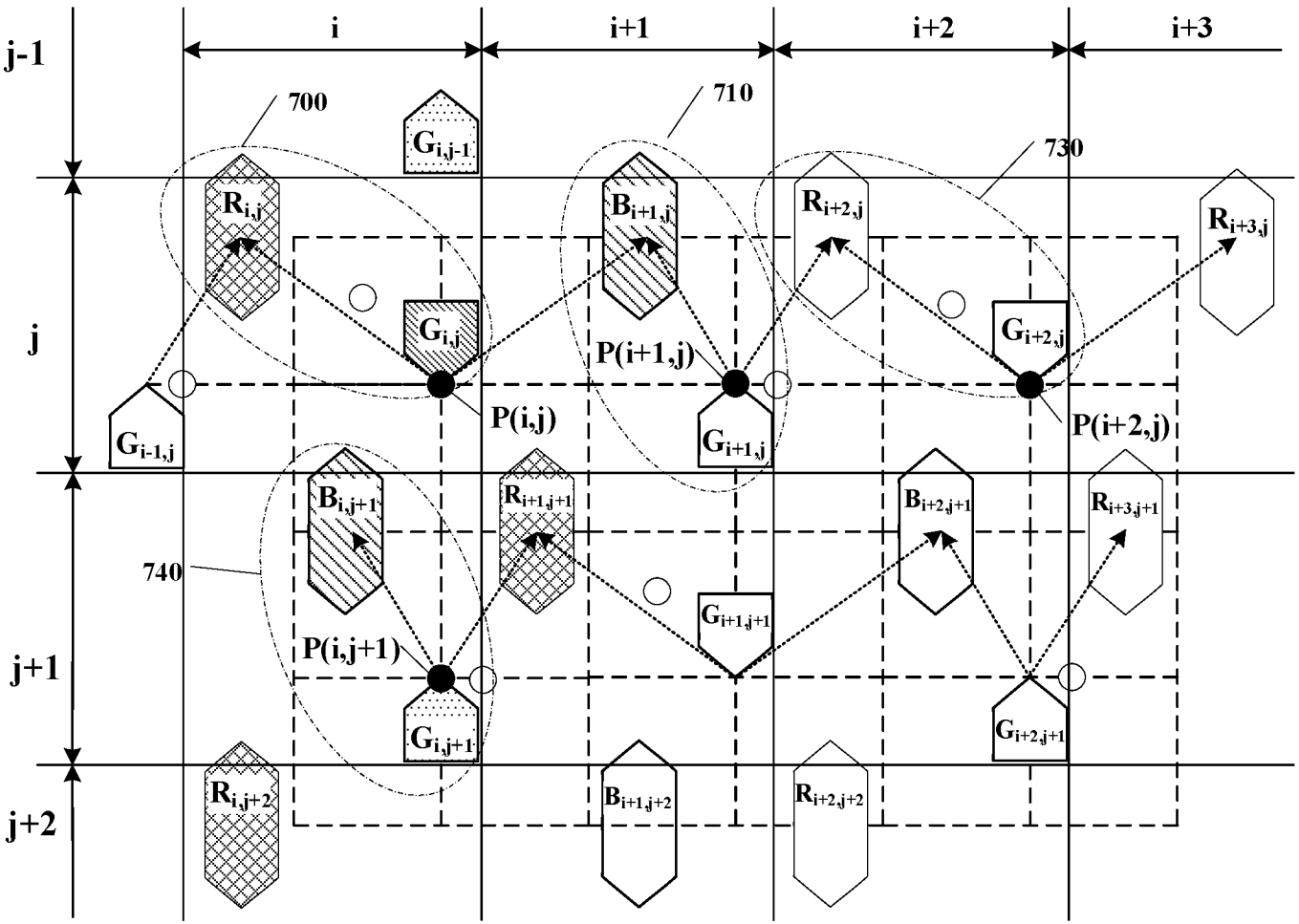
FIG. 7B is a schematic diagram illustrating that a pixel arrangement structure is displaying a vertical line having a substantially white color using Sup-Pixel Rendering in some embodiments according to the present disclosure.

FIG. 7A is a schematic diagram illustrating that a pixel arrangement structure is displaying a horizontal line having a substantially white color using Sup-Pixel Rendering in some embodiments according to the present disclosure. FIG. 7B is a schematic diagram illustrating that a pixel arrangement structure is displaying a vertical line having a substantially white color using Sup-Pixel Rendering in some embodiments according to the present disclosure.

In some embodiments, referring to FIG. 7A, the pixel arrangement structure includes the first virtual pixel 700 of the plurality of virtual pixels in the i-th column and in the j-th row, the second virtual pixel 710 of the plurality of virtual pixels in the (i+1)-th column and in the j-th row, a fourth virtual pixel 730 of the plurality of virtual pixels in the (i+2)-th column and in the j-th row.

Optionally, the first virtual pixel 700 includes a subpixel $R_{i,j}$ of the plurality of first subpixels 401 in the i-th column and in the j-th row, and a subpixel $G_{i,j}$ of the plurality of third subpixels 403 in the i-th column and in the j-th row.

Optionally, the second virtual pixel 710 includes a subpixel $B_{i+1,j}$ of the plurality of second subpixels 402 in the (i+1)-th column and in the j-th row, and a subpixel $G_{i+1,j}$ of the plurality of third subpixels 403 in the (i+1)-th column and in the j-th row.

Optionally, the fourth virtual pixel 730 includes a subpixel $R_{i+2,j}$ of the plurality of first subpixels 401 in the (i+2)-th column and in the j-th row, and a subpixel $G_{i+2,j}$ of the plurality of third subpixels 403 in the (i+2)-th column and in the j-th row.

Optionally, algorithms represented by the equations from (1.1) to (1.4) for Sup-Pixel Rendering are used to drive the pixel arrangement structure to display a horizontal line having the substantially white color.

When a horizontal line having the substantially white color is displayed on the j-th row, all the subpixels in the j-th row emit light. For example, the first virtual pixel 700, the second virtual pixel 710 and the fourth virtual pixel 730 emit light. And brightness of all the subpixels in the j-th row are 100% (e.g., grey scales of all the subpixels in the j-th row are 225). Optionally, a subpixel $G_{i-1,j}$ of the plurality of third subpixels 403 and the subpixel $B_{i+3,j}$ emit light when the horizontal line having the substantially white color is displayed on the j-th row. And brightness of the subpixel $G_{i-1,j}$ and the subpixel $B_{i+3,j}$ are 100%. So, the display panel displays the horizontal line with substantially white color in the j-th row.

Referring to FIG. 7B, in some embodiments, the pixel arrangement structure further includes a fifth virtual pixel 740 of the plurality of virtual pixels in the i-th column and in the (j+1)-th row. Optionally, the fifth virtual pixel 740 of the plurality of virtual pixels includes a subpixel $B_{i,j+1}$ of the plurality of second subpixels 402 in the i-th column and in the (j+1)-th row, and a subpixel $G_{i,j+1}$ of the plurality of third subpixels 403 in the i-th column and in the (j+1)-th row.

Optionally, algorithms represented by the equations from (1.1) to (1.4) for Sup-Pixel Rendering are used to drive the pixel arrangement structure to display the vertical line having the substantially white color. When the vertical line having the substantially white color is displayed in the i-th column, all the subpixels in the i-th column emit light. And all the first subpixels and the second subpixels in the (i+1)-th column emit light.

For example, the subpixel $R_{i,j}$ of the plurality of first subpixels 401 in the first virtual pixel 700, the subpixel $G_{i,j}$ of the plurality of third subpixels 403 in the first virtual pixel 700, the subpixel $B_{i+1,j}$ of the plurality of second subpixels 402 in the second virtual pixel 710, the subpixel $B_{i,j+1}$ of the plurality of second subpixels 402 in the fifth virtual pixel 740, and the subpixel $G_{i,j+1}$ of the plurality of third subpixels 403 in the fifth virtual pixel 740 emit light.

Optionally, brightness of all the first subpixels and all the second subpixels in the i-th column are 50% (e.g., grey scales of all the first subpixels and all the second subpixels in the i-th column are 128). Brightness of all the third subpixels in the i-th column are 100% (e.g., grey scales of all the third subpixels in the i-th column are 255). Brightness of all the first subpixels and all the second subpixels in the (i+1)-th column are 50%.

For example, the subpixel $R_{i,j}$ of the plurality of first subpixels 401 in the first virtual pixel 700, the subpixel $B_{i+1,j}$ of the plurality of second subpixels 402 in the second virtual pixel 710, and the subpixel $B_{i,j+1}$ of the plurality of second subpixels 402 in the fifth virtual pixel 740 have the 50% brightness. The subpixel $G_{i,j}$ of the plurality of third subpixels 403 in the first virtual pixel 700; the subpixel $G_{i,j+1}$ of the plurality of third subpixels 403 in the fifth virtual pixel 740 have the 100% brightness. And the subpixel $G_{i+1,j}$ of the plurality of the third subpixels 403 in the second virtual pixel 710 does not emit light. So, the display panel may display the vertical line with the substantially white color in the i-th column.

Optionally, FIG. 7B also shows a subpixel $G_{i,j-1}$ of the plurality of third subpixels 403 in the i-th column and in the (j−1)-th row, a subpixel $R_{i+1,j+1}$ of the plurality of first subpixels 401 in the (i+1)-th column and in the (i+1)-th row, a subpixel $R_{i,j+2}$ of the plurality of first subpixels 401 in the i-th column and in the (j+2)-th row, a subpixel $B_{i+1,j+2}$ of the plurality of second subpixels 402 in the (i+1)-th column and in the (j+2)-th row. When the i-th column is displaying the substantially white color, the subpixel $G_{i,j-1}$, the subpixel $R_{i+1,j+1}$, the subpixel $R_{i,j+2}$, and the subpixel $B_{i+1,j+2}$ emit light. Optionally, the subpixel $R_{i+1,j+1}$, the subpixel $R_{i,j+2}$, the subpixel $B_{i+1,j+2}$ have the 50% brightness, and the subpixel $G_{i,j-1}$ has the 100% brightness.

In some embodiments, in the subpixel arrangement structure, the bright center of a respective one of the plurality of virtual pixels is between a first subpixel and a third subpixel in a same virtual pixel. For example, the bright center of the respective one of the plurality of virtual pixels is at a spot at one third of a line connecting the center of the first subpixel and the center of the third subpixel, and the spot is closer to the third subpixel.

In some embodiments, referring to FIG. 7A and FIG. 7B, a white circular shape between a first subpixel and a third subpixel represents a bright center of one of the plurality of virtual pixels. A black circular shape P represents a logic bright center of one of the plurality of logic pixels.

Optionally, P(i,j) represents a bright center of the third logic pixel of the plurality of logic pixels in the i-th column and in the j-th row. Referring to equations (1.1) to (1.3), theoretical data signals of the third logic pixel in the i-th column and in the j-th row are assigned to the subpixel $R_{i,j}$ of the plurality of first subpixels 401 in the first virtual pixel 700, the subpixel $G_{i,j}$ of the plurality of third subpixels 403 in the first virtual pixel 700, and the subpixel $B_{i+1,j}$ of the plurality of second subpixels 402 in the second virtual pixel 710, so when the subpixel $R_{i,j}$ of the plurality of first subpixels 401, the subpixel $G_{i,j}$ of the plurality of third subpixels 403, and the subpixel $B_{i+1,j}$ of the plurality of second subpixels 402 emit light, a bright center locates between the subpixel $R_{i,j}$ of the plurality of first subpixels 401 and the subpixel $G_{i,j}$ of the plurality of third subpixels 403.

Optionally, P(i+1,j) represents a bright center of the fifth logic pixel of the plurality of logic pixels in the (i+1)-th column and in the j-th row. Referring to equations (1.1), (1.3), and (1.4), theoretical data signals of the fifth logic pixel in the (i+1)-th column and in the j-th row are assigned to the subpixel $R_{i+2,j}$ of the plurality of first subpixels 401 in fourth virtual pixel 730, the subpixel $B_{i+1,j}$ of the plurality of second subpixels 402 in the second virtual pixel 710, and the subpixel $G_{i+1,j}$ of the plurality of third subpixels 403 in the second virtual pixel 710, so when the subpixel $R_{i+2,j}$ of the plurality of first subpixels 401, the subpixel $B_{i+1,j}$ of the plurality of second subpixels 402, and the subpixel $G_{i+1,j}$ of the plurality of third subpixels 403 emit light, a bright center locates between the subpixel $R_{i+2,j}$ of the plurality of first subpixels 401 and subpixel $G_{i+1,j}$ of the plurality of third subpixels 403.

Optionally, P(i+2,j) represents a bright center of the ninth logic pixel of the plurality of logic pixel in the (i+2)-th column and in the j-th row. Theoretical data signals of the ninth logic pixel in the (i+2)-th column and in the j-th row are assigned to the subpixel $R_{i+2,j}$ of the plurality of first subpixels 401 in the fourth virtual pixel 730, the subpixel $G_{i+2,j}$ of the plurality of third subpixels 403 in the fourth virtual pixel 730, and a subpixel $B_{i+3,j}$ of the plurality of second subpixels 402 in the (i+3)-th column and in the j-th row, so when the subpixel $R_{i+2,j}$ of the plurality of first subpixels 401, the subpixel $G_{i+2,j}$ of the plurality of third subpixels 403, and the subpixel $B_{i+3,j}$ of the plurality of second subpixels 402 emit light, a bright center locates between the subpixel $R_{i+2,j}$ of the plurality of first subpixels 401 and subpixel $G_{i+2,j}$ of the plurality of third subpixels 403.

Optionally, referring to FIG. 7B, P(i,j+1) represents a bright center of the seventh logic pixel in the i-th column and in the (j+1)-th row. Theoretical data signals of the seventh logic pixel i-th column and in the (j+1)-th row are assigned to the subpixel $B_{i,j+1}$ of the plurality of second subpixels 402 in the fifth virtual pixel 740, the subpixel $G_{i,j+1}$ of the plurality of third subpixels 403 in the fifth virtual pixel 740, and the subpixel $R_{i+1,j+1}$ of the plurality of first subpixels 401 in the (i+1)-th column and in the (i+1)-th row, so when the subpixel $B_{i,j+1}$ of the plurality of second subpixels 402, the subpixel $G_{i,j+1}$ of the plurality of third subpixels 403, and the subpixel $R_{i+1,j+1}$ of the plurality of first subpixels 401 emit light, a bright center locates between the subpixel $R_{i+1,j+1}$ of the plurality of first subpixels 401 and subpixel $G_{i,j+1}$ of the plurality of third subpixels 403.

Referring to FIG. 7A, when the j-th column is displaying the horizontal line with the substantially white color, bright centers of the virtual subpixels in the j-th column are not in a same straight line. Referring to FIG. 7B, when the i-th row is displaying the vertical line with the substantially white color, bright centers of the virtual subpixels in the i-th row are not in a same straight line.

Referring to FIG. 7A and FIG. 7B, blank subpixels do not emit light. And dotted lines with arrow represent subpixel addressing.

Figure 7C:
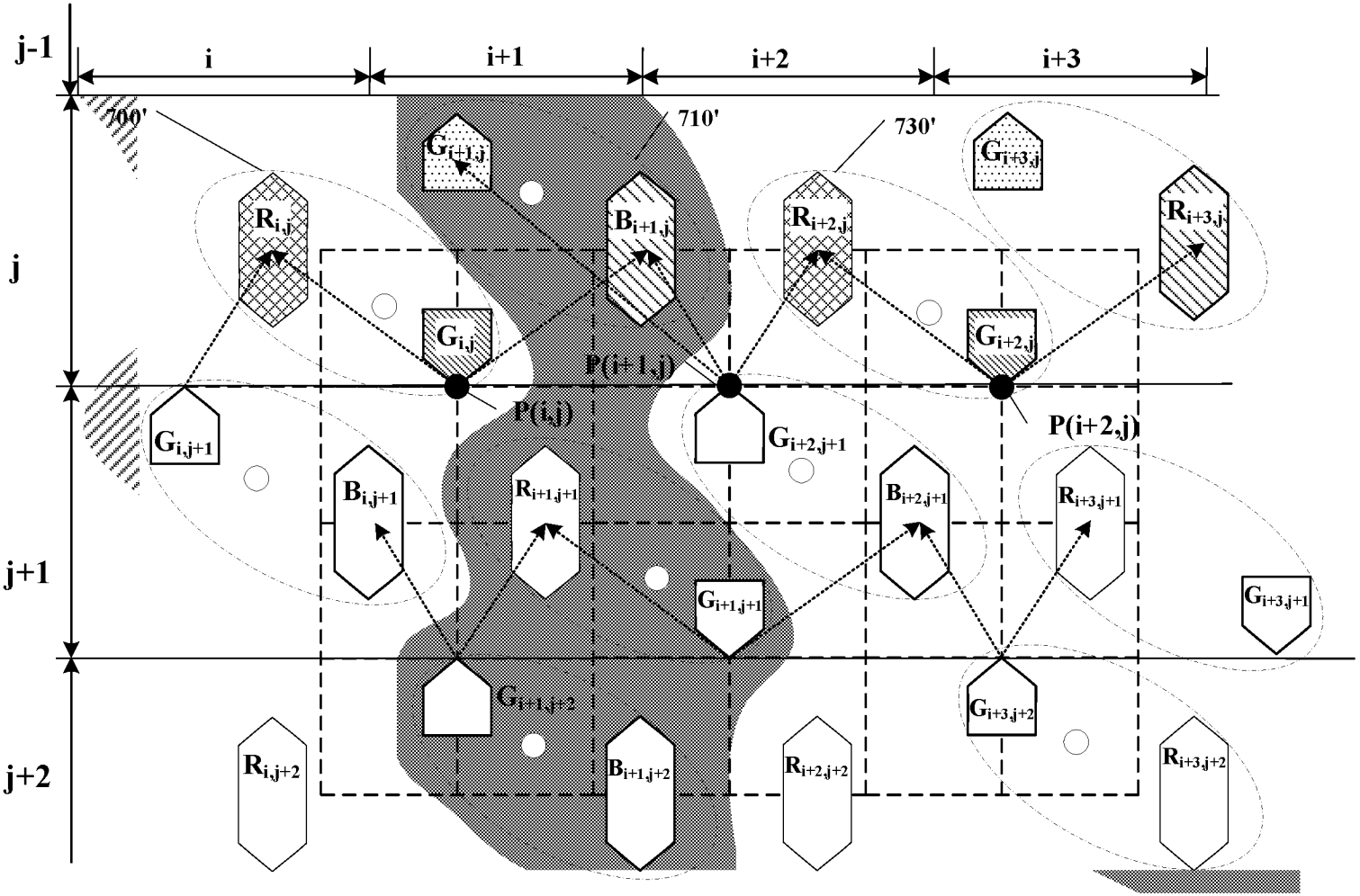
FIG. 7C is a schematic diagram illustrating that a pixel arrangement structure is displaying a horizontal line having a substantially white color using Sup-Pixel Rendering in some embodiments according to the present disclosure.
Figure 7D:
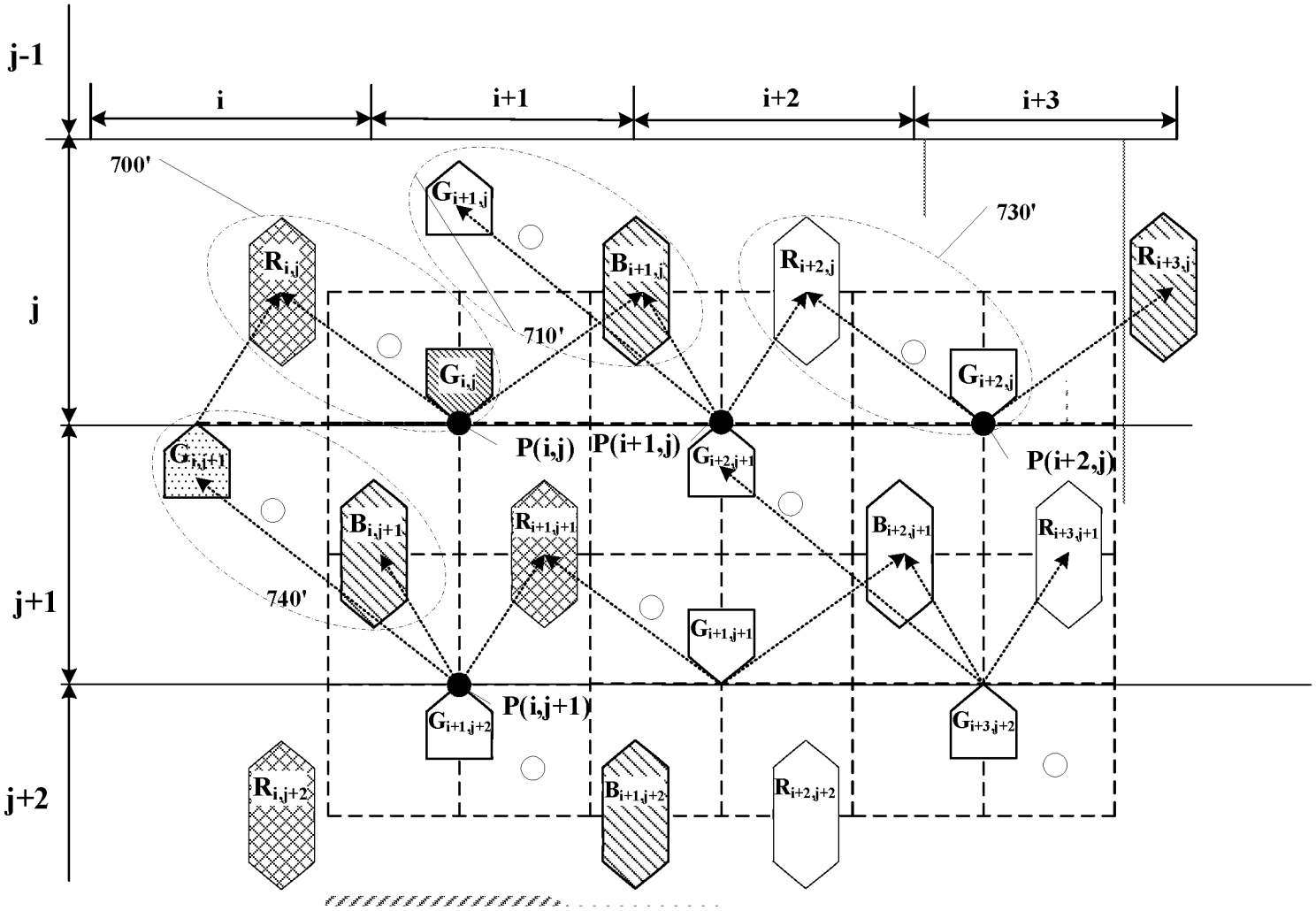
FIG. 7D is a schematic diagram illustrating that a pixel arrangement structure is displaying a vertical line having a substantially white color using Sup-Pixel Rendering in some embodiments according to the present disclosure.

FIG. 7C is a schematic diagram illustrating that a pixel arrangement structure is displaying a horizontal line having a substantially white color using Sup-Pixel Rendering in some embodiments according to the present disclosure. FIG. 7D is a schematic diagram illustrating that a pixel arrangement structure is displaying a vertical line having a substantially white color using Sup-Pixel Rendering in some embodiments according to the present disclosure.

Referring to FIG. 7A and FIG. 7B, four subpixels of the respective one of the plurality of minimum translational repeating units 40 belong to three different virtual subpixels. Optionally, referring to FIG. 7C and FIG. 7D, the four subpixels of the respective one of the plurality of minimum translational repeating units belongs to two different virtual subpixels.

Referring to FIG. 7C, in some embodiments, the respective one of the plurality minimum translational repeating units 40 includes a first virtual pixel 700' of the plurality of virtual pixels, and a second virtual pixel 710' of the plurality of virtual pixels. Optionally, the first virtual pixel 700' includes a subpixel of the plurality of first subpixels 401, and a subpixel of the plurality of third subpixels 403. Optionally, the second virtual pixel 710' includes a subpixel of the plurality of second subpixels 402, and a subpixel of the plurality of third subpixels 403. The subpixel of the plurality of third subpixels 403 in the first virtual pixel 700' and the subpixel of the plurality of third subpixels 403 in the second virtual pixel 710' are grouped into one of the plurality of pairs of adjacent third subpixels.

For example, one subpixel of the plurality of first subpixels 401 and one subpixel of the plurality of third subpixels 403 of the same minimum translational repeating unit constitute the first virtual pixel 700' in the i-th column and in the j-th row, one subpixel of the plurality of second subpixels 402 and the other subpixel of the plurality of third subpixels 403 of the same minimum translational repeating unit constitute the second virtual pixel 710' in the (i+1)-th column and in the j-th row.

In some embodiments, referring to FIG. 7C, the pixel arrangement structure includes the first virtual pixel 700' in the i-th column and in the j-th row, the second virtual pixel 710' in the (i+1)-th column and in the j-th row, a fourth virtual pixel 730' in the (i+2)-th column and in the j-th row.

Optionally, the first virtual pixel 700' includes a subpixel $R_{i,j}$ of the plurality of first subpixels 401 in the i-th column and in the j-th row, and a subpixel $G_{i,j}$ of the plurality of third subpixels 403 in the i-th column and in the j-th row.

Optionally, the second virtual pixel 710' includes a subpixel $B_{i+1,j}$ of the plurality of second subpixels 402 in the (i+1)-th column and in the j-th row, and a subpixel $G_{i+1,j}$ of the plurality of third subpixels 403 in the (i+1)-th column and in the j-th row.

Optionally, the fourth virtual pixel 730' includes a subpixel $R_{i+2,j}$ of the plurality of first subpixels 401 in the (i+2)-th column and in the j-th row, and a subpixel $G_{i+2,j}$ of the plurality of third subpixels 403 in the (i+2)-th column and in the j-th row.

Optionally, algorithms represented by the equations from (1.1) to (1.4) for Sup-Pixel Rendering are used to drive the pixel arrangement structure to display a horizontal line having the substantially white color.

When a horizontal line having the substantially white color is displayed on the j-th row, all the subpixels in the j-th row emit light. For example, the first virtual pixel 700', the second virtual pixel 710' and the fourth virtual pixel 730' emit light. And brightness of all the subpixels in the j-th row are 100% (e.g., grey scale of all the subpixels in the j-th row are 225). So, the display panel can display the horizontal line with substantially white color in j-th row.

Referring to FIG. 7D, in some embodiments, the pixel arrangement structure further includes a fifth virtual pixel 740' of the plurality of virtual pixels in the i-th column and in the (j+1)-th row. Optionally, the fifth virtual pixel 740' of the plurality of virtual pixels includes a subpixel $B_{i,j+1}$ of the plurality of second subpixels 402 in the i-th column and in the (j+1)-th row, and a subpixel $G_{i,j+1}$ of the plurality of third subpixels 403 in the i-th column and in the (j+1)-th row.

Optionally, algorithms represented by the equations from (1.1) to (1.4) for Sup-Pixel Rendering are used to drive the pixel arrangement structure to display the vertical line having the substantially white color. When the vertical line having the substantially white color is displayed in the i-th column, all the subpixels in the i-th column emit light. And all the first subpixels and all the second subpixels in the (i+1)-th column emit light.

For example, the subpixel $R_{i,j}$ of the plurality of first subpixels 401 in the first virtual pixel 700', the subpixel $G_{i,j}$ of the plurality of third subpixels 403 in the first virtual pixel 700', the subpixel $B_{i+1,j}$ of the plurality of second subpixels 402 in the second virtual pixel 710', the subpixel $B_{i+1,j+1}$ of the plurality of second subpixels 402 in the fifth virtual pixel 740', and the subpixel $G_{i,j+1}$ of the plurality of third subpixels 403 in the fifth virtual pixel 740' emit light.

Optionally, brightness of all the first subpixels and all the second subpixels in the i-th column are 50% (e.g., grey scales of all the first subpixels and all the second subpixels in the i-th column are 128). Brightness of all the third subpixels in the i-th column are 100% (e.g., grey scales of all the third subpixels in the i-th column are 255). Brightness of all the first subpixels and all the second subpixels in the (i+1)-th column are 50%.

For example, the subpixel $R_{i,j}$ of the plurality of first subpixels 401 in the first virtual pixel 700', the subpixel $B_{i+1,j}$ of the plurality of second subpixels 402 in the second virtual pixel 710', and the subpixel $B_{i,j+1}$ of the plurality of second subpixels 402 in the fifth virtual pixel 740' have the 50% brightness. The subpixel $G_{i,j}$ of the plurality of third subpixels 403 in the first virtual pixel 700'; the subpixel $G_{i,j+1}$ of the plurality of third subpixels 403 in the fifth virtual pixel 740' have the 100% brightness. And the subpixel $G_{i+1,j}$ of the plurality of the third subpixels 403 in the second virtual pixel 710' does not emit light. So, the display panel may display the vertical line with the substantially white color in the i-th column.

Optionally, FIG. 7D also shows a subpixel $R_{i+1,j+1}$ of the plurality of first subpixels 401 in the (i+1)-th column and in the (i+1)-th row, a subpixel $R_{i,j+2}$ of the plurality of first subpixels 401 in the i-th column and in the (j+2)-th row, a subpixel $B_{i+i,j+2}$ of the plurality of second subpixels 402 in the (i+1)-th column and in the (j+2)-th row. When the i-th column is displaying the substantially white color, the subpixel $R_{i+1,j+1}$, the subpixel $R_{i,j+2}$, and the subpixel $B_{i+1,j+2}$ emit light. Optionally, the subpixel $R_{i+1,j+1}$, the subpixel $R_{i,j+2}$, the subpixel $B_{i+1,j+2}$ have the 50% brightness.

In some embodiments, referring to FIG. 7C and FIG. 7D, a bright center of the first virtual pixel 700' of the plurality of virtual pixels is a white circular shape between the subpixel $R_{i,j}$ of the plurality of first subpixels 401 and the subpixel $G_{i,j}$ of the plurality of third subpixels 403. A bright center of the second virtual pixel 710' of the plurality of virtual subpixels is a white circular shape between the subpixel $B_{i+1,j}$ of the plurality of second subpixels 402 and the subpixel $G_{i+1,j}$ of the plurality of the third subpixels 403.

Optionally, A black circular shape P represents a logic bright center of one of the plurality of logic pixels. Optionally, P(i,j) represents a bright center of the third logic pixel of the plurality of logic pixels in the i-th column and in the j-th row. Referring to equations (1.1) to (1.3), theoretical data signals of the third logic pixel in the i-th column and in the j-th row are assigned to the subpixel $R_{i,j}$ of the plurality of first subpixels 401 in the first virtual pixel 700', the subpixel $G_{i,j}$ of the plurality of third subpixels 403 in the first virtual pixel 700', and the subpixel $B_{i+1,j}$ of the plurality of second subpixels 402 in the second virtual pixel 710', so when the subpixel $R_{i,j}$ of the plurality of first subpixels 401, the subpixel $G_{i,j}$ of the plurality of third subpixels 403, and the subpixel $B_{i+1,j}$ of the plurality of second subpixels 402 emit light, a bright center locates between the subpixel $R_{i,j}$ of the plurality of first subpixels 401 and the subpixel $G_{i,j}$ of the plurality of third subpixels 403.

Optionally, P(i+1,j) represents a bright center of the fifth logic pixel of the plurality of logic pixels in the (i+1)-th column and in the j-th row. Referring to equations (1.1), (1.3), and (1.4), theoretical data signals of the fifth logic pixel in the (i+1)-th column and in the j-th row are assigned to the subpixel $R_{i+2,j}$ of the plurality of first subpixels 401 in fourth virtual pixel 730', the subpixel $B_{i+1,j}$ of the plurality of second subpixels 402 in the second virtual pixel 710', and the subpixel $G_{i+1,j}$ of the plurality of third subpixels 403 in the second virtual pixel 710', so when the subpixel $R_{i+2,j}$ of the plurality of first subpixels 401, the subpixel $B_{i+1,j}$ of the plurality of second subpixels 402, and the subpixel $G_{i+1,j}$ of the plurality of third subpixels 403 emit light, a bright center should locate between subpixel $G_{i+1,j}$ of the plurality of third subpixels 403 in the second virtual pixel 710' and the subpixel $R_{i+2,j}$ of the plurality of first subpixels 401 in the fourth virtual subpixel 730'. Because the subpixel $B_{i+1,j}$ of the plurality of second subpixels 402 is also between the subpixel $G_{i+1,j}$ of the plurality of third subpixels 403 and the subpixel $R_{i+2,j}$ of the plurality of first subpixels 401, the bright center locates between the subpixel $G_{i+1,j}$ of the plurality of third subpixels 403 and the subpixel $B_{i+1,j}$ of the plurality of second subpixels 402.

Optionally, P(i+2,j) represents a bright center of the ninth logic pixel of the plurality of logic pixel in the (i+2)-th column and in the j-th row. Theoretical data signals of the ninth logic pixel in the (i+2)-th column and in the j-th row are assigned to the subpixel $R_{i+2,j}$ of the plurality of first subpixels 401 in the fourth virtual pixel 730', the subpixel $G_{i+2,j}$ of the plurality of third subpixels 403 in the fourth virtual pixel 730', and a subpixel $B_{i+3,j}$ of the plurality of second subpixels 402 in the (i+3)-th column and in the j-th row, so when the subpixel $R_{i+2,j}$ of the plurality of first subpixels 401, the subpixel $G_{i+2,j}$ of the plurality of third subpixels 403, and the subpixel $B_{i+3,j}$ of the plurality of second subpixels 402 emit light, a bright center locates between the subpixel $R_{i+2,j}$ of the plurality of first subpixels 401 and subpixel $G_{i+2,j}$ of the plurality of third subpixels 403.

Optionally, referring to FIG. 7D, P(i,j+1) represents a bright center of the seventh logic pixel in the i-th column and in the (j+1)-th row. Theoretical data signals of the seventh logic pixel in the i-th column and in the (j+1)-th row are assigned to the subpixel $B_{i,j+1}$ of the plurality of second subpixels 402 in the fifth virtual pixel 740', the subpixel $G_{i+1,j}$ of the plurality of third subpixels 403 in the fifth virtual pixel 740', and the subpixel $R_{i+1,j+1}$ of the plurality of first subpixels 401 in the (i+1)-th column and in the (i+1)-th row, so when the subpixel $B_{i,j+1}$ of the plurality of second subpixels 402, the subpixel $G_{i+1,j}$ of the plurality of third subpixels 403, and the subpixel $R_{i+1,j+1}$ of the plurality of first subpixels 401 emit light, a bright center locates between the subpixel $B_{i,j+1}$ of the plurality of second subpixels 402 and subpixel $G_{i+1,j}$ of the plurality of third subpixels 403.

Referring to FIG. 7C, when the j-th column is displaying the horizontal line with the substantially white color, bright centers of the virtual subpixels in the j-th column are not in a same straight line. Referring to FIG. 7D, when the i-th row is displaying the vertical line with the substantially white color, bright centers of the virtual subpixels in the i-th row are not in a same straight line.

Referring to FIG. 7C and FIG. 7D, blank subpixels do not emit light. And dotted lines with arrow represent subpixel addressing.

Figure 8A:
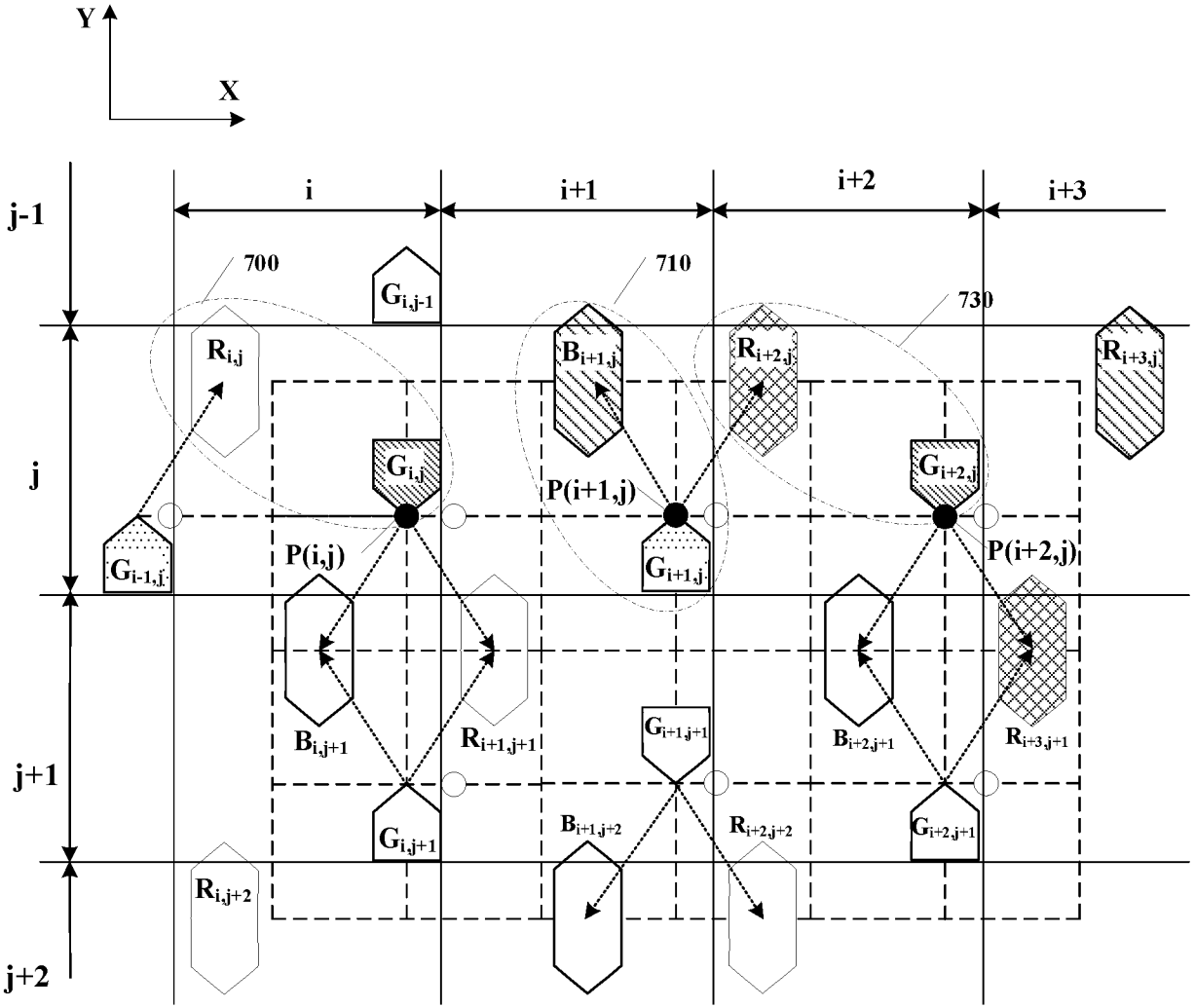
FIG. 8A is a schematic diagram illustrating that a pixel arrangement structure is displaying a horizontal line having a substantially white color using a method of driving a pixel arrangement structure in some embodiments according to the present disclosure.
Figure 8B:
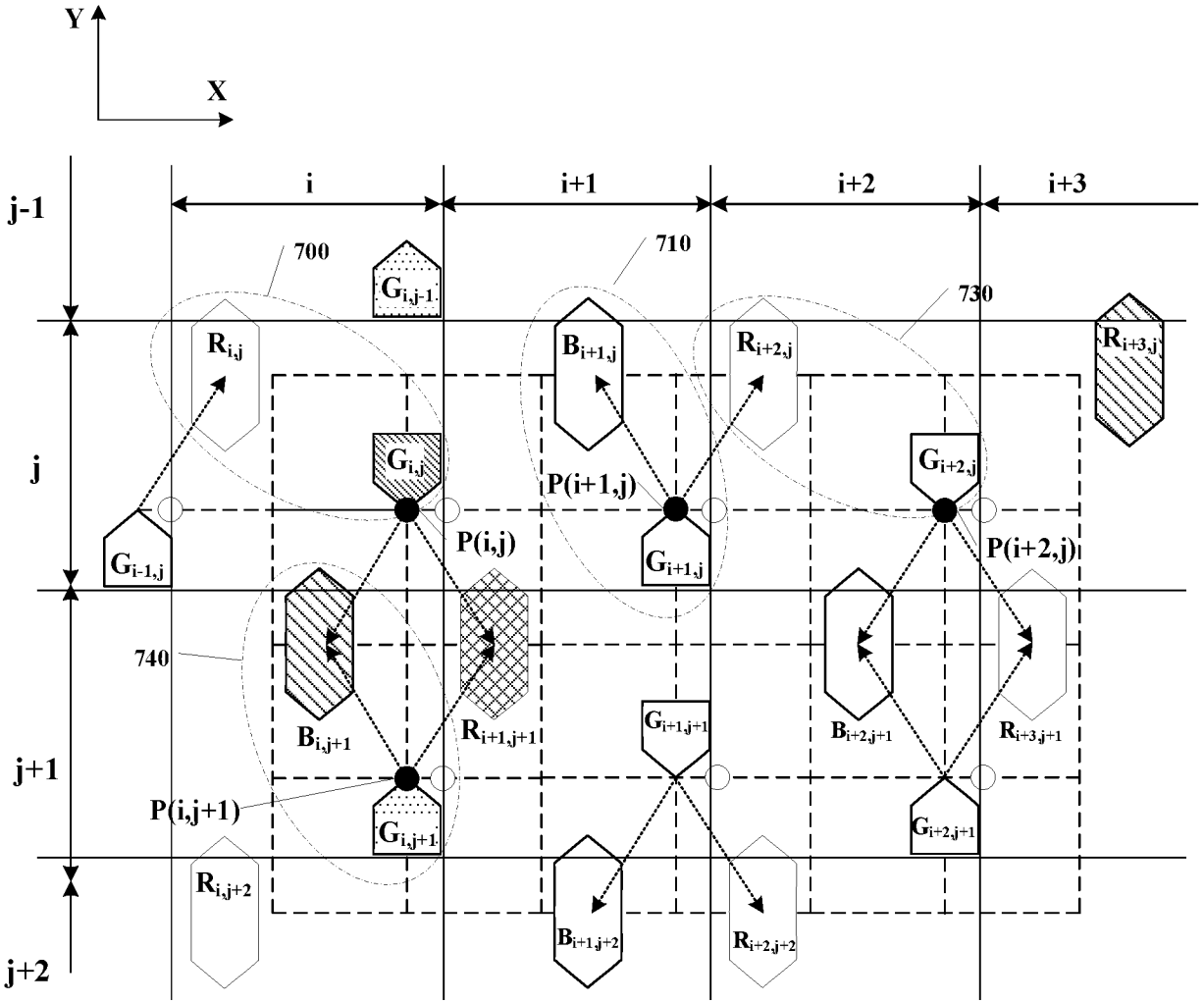
FIG. 8B is a schematic diagram illustrating that a pixel arrangement structure is displaying a vertical line having a substantially white color using a method of driving a pixel arrangement structure in some embodiments according to the present disclosure.

FIG. 8A is a schematic diagram illustrating that a pixel arrangement structure is displaying a horizontal line having a substantially white color using a method of driving a pixel arrangement structure in some embodiments according to the present disclosure. FIG. 8B is a schematic diagram illustrating that a pixel arrangement structure is displaying a vertical line having a substantially white color using a method of driving a pixel arrangement structure in some embodiments according to the present disclosure.

In some embodiments, algorithms represented by the equations from (2.1) to (2.4) representing a method of driving the pixel arrangement structure to display a horizontal line having the substantially white color.

Referring to FIG. 8A, when a horizontal line having the substantially white color is displayed on the j-th row, all the subpixels in the j-th row emit light. For example, the first virtual pixel 700, the second virtual pixel 710 and the fourth virtual pixel 730 emit light. And all the first subpixels and all the second subpixel in the (j+1)-th row emit light, for example, the subpixel $B_{i,j+1}$ of the plurality of second subpixels 402 in the i-th column and in the (j+1)-th row, the subpixel $R_{i+1,j+1}$ of the plurality of first subpixels 401 in the (i+1)-th column and in the (j+1)-th row, the subpixel $B_{i+2,j+1}$ of the plurality of second subpixels 402 in the (i+2)-th column and in the (j+1)-th row, the subpixel $R_{i+3,j+1}$ of the plurality of first subpixels 401 in the (i+3)-th column and in the (j+1)-th row emit light.

Optionally, brightness of all the first subpixels and all the second subpixels in the j-th row are 50% (e.g., grey scales of all the first subpixels and all the second subpixels in the j-th row are 128), brightness of all the third subpixels in the j-th row are 100% (e.g., grey scales of all the third subpixels in the j-th row are 225). Optionally, brightness of all the first subpixels and all the second subpixels in the (j+1)-th row are 50%. For example, the subpixel $B_{i,j+1}$ of the plurality of second subpixels 402, the subpixel $R_{i+1,j+1}$ of the plurality of first subpixels 401, the subpixel $B_{i+2,j+1}$ of the plurality of second subpixels 402, and the subpixel $R_{i+3,j+1}$ of the plurality of first subpixels 401 have a 50% brightness. So, the display panel displays the horizontal line with substantially white color in the j-th row.

Optionally, FIG. 8A also shows a subpixel $G_{i-1,j}$ of the plurality of third subpixels 403 in the (i−1)-th column and in the j-th row, when the j-th row is displaying the horizontal line with substantially white color, the subpixel $G_{i-1,j}$ of the plurality of third subpixels 403 also emits light, and a brightness of the subpixel $G_{i-1,j}$ of the plurality of third subpixels 403 is 100%.

In some embodiments, algorithms represented by the equations from (2.1) to (2.4) representing the method of driving the pixel arrangement structure to display a vertical line having the substantially white color. Referring to FIG. 8B, when the vertical line having the substantially white color is displayed in the i-th column, all the second subpixels and all the third subpixels in the i-th column emit light. All the first subpixels in the (i+1)-th column emit light.

For example, the subpixel $G_{i,j}$ of the plurality of third subpixels 403 in the first virtual pixel 700, the subpixel $B_{i,j+1}$ of the plurality of second subpixels 402 in the fifth virtual pixel 740, the subpixel $G_{i,j+1}$ of the plurality of third subpixels 403 in the fifth virtual pixel 740, the subpixel $G_{i,j-1}$ of the plurality of third subpixels 403 in the i-th column and in the (j−1)-th row, the subpixel $R_{i+1,j+1}$ of the plurality of first subpixels 401 in the (i+1)-th column and in the (j+1)-th row emit light.

Optionally, brightness of all the second subpixels and all the third subpixels in the i-th column are 100% (e.g., grey scales of all the second subpixels and all the third subpixels in the i-th column are 255). Brightness of all the first subpixels in the (i+1)-th column are 100% (e.g., grey scales of all the third subpixels in the (i+1)-th column are 255).

For example, the brightness of subpixel $G_{i,j}$ of the plurality of third subpixels 403 in the first virtual pixel 700, the subpixel $B_{i,j+1}$ of the plurality of second subpixels 402 in the fifth virtual pixel 740, the subpixel $G_{i,j+1}$ of the plurality of third subpixels 403 in the fifth virtual pixel 740, the subpixel $G_{i,j-1}$ of the plurality of third subpixels 403 in the i-th column and in the (j−1)-th row, and the subpixel $R_{i+1,j+1}$ of the plurality of first subpixels 401 in the (i+1)-th column and in the (j+1)-th are 100%. So, the display panel displays the vertical line with substantially white color in the i-th column.

Optionally, in order for the i-th column to display the vertical line with substantially white color, all the first subpixels in the i-th column do not emit light.

In some embodiments, referring to FIG. 8A and FIG. 8B, a white circular shape between a first subpixel and a third subpixel represents a bright center of one of the plurality of virtual pixels. A black circular shape P represents a logic bright center of one of the plurality of logic pixels.

For example, P(i,j) represents a bright center of the third logic pixel of the plurality of logic pixels in the i-th column and in the j-th row. P(i+1,j) represents a bright center of the fifth logic pixel of the plurality of logic pixels in the (i+1)-th column and in the j-th row. P(i+2,j) represents a bright center of the ninth logic pixel of the plurality of logic pixel in the (i+2)-th column and in the j-th row. P(i,j+1) represents a bright center of the seventh logic pixel in the i-th column and in the (j+1)-th row.

Referring to equations (2.1) to (2.3), theoretical data signals of the third logic pixel in the i-th column and in the j-th row are assigned to the subpixel $G_{i,j}$ of the plurality of third subpixels 403 in the first virtual pixel 700, the subpixel $B_{i,j+1}$ of the plurality of second subpixels 402 in the i-th column and in the (j+1)-th row, the subpixel $R_{i+1,j+1}$ of the plurality of first subpixel 401 in the (i+1)-th column and in the (j+1)-th row, so when the subpixel of the plurality of third subpixels 403, the subpixel $B_{i,j+1}$ of the plurality of second subpixels 402, and the $R_{i+1,j+1}$ of the plurality of first subpixel 401 emit light, the bright center locates between the subpixel $G_{i,j}$ of the plurality of third subpixels 403 and the $R_{i+1,j+1}$ of the plurality of first subpixel 401.

Optionally, theoretical data signals of the fifth logic pixel in the (i+1)-th column and in the j-th row are assigned to the subpixel $B_{i+1,j}$ of the plurality of second subpixels 402 in the second virtual pixel 710, the subpixel $G_{i+1,j}$ of the plurality of third subpixels 403 in the second virtual pixel 710, and the subpixel $R_{i+2,j}$ of the plurality of first subpixels 401 in fourth virtual pixel 730, so when the subpixel $B_{i+1,j}$ of the plurality of second subpixels 402, subpixel $G_{i+1,j}$ of the plurality of third subpixels 403, and the subpixel $R_{i+2,j}$ of the plurality of first subpixels 401 emits light, the bright center locates between the subpixel $R_{i+2,j}$ of the plurality of first subpixels 401 and subpixel $G_{i+1,j}$ of the plurality of third subpixels 403.

Optionally, theoretical data signals of the ninth logic pixel in the (i+2)-th column and in the j-th row are assigned to the subpixel $G_{i+2,j}$ of the plurality of third subpixels 403 in the fourth virtual pixel 730, the subpixel $B_{i+2,j+1}$ of the plurality of second subpixels 402 in the (i+2)-th column and in the (j+1)-th row, and the subpixel $R_{i+3,j+1}$ of the plurality of first subpixels 401 in the (i+3)-th column and in the (j+1)-th row, so when the subpixel $G_{i+2,j}$ of the plurality of third subpixels 403, the plurality of second subpixels 402, and the subpixel $R_{i+3,j+1}$ of the plurality of first subpixels 401 emit light, a bright center locates between the subpixel $G_{i+2,j}$ of the plurality of third subpixels 403 and the subpixel $R_{i+3,j+1}$ of the plurality of first subpixels 401.

Optionally, theoretical data signals of the seventh logic pixel in the i-th column and in the (j+1)-th row are assigned to the subpixel $B_{i,j+1}$ of the plurality of second subpixels 402 in the fifth virtual pixel 740, the subpixel $G_{i,j+1}$ of the plurality of third subpixels 403 in the fifth virtual pixel 740, and the subpixel $R_{i+1,j+1}$ of the plurality of first subpixels 401 in the (i+1)-th column and in the (i+1)-th row, so when the subpixel $B_{i,j+1}$ of the plurality of second subpixels 402, the subpixel $G_{i,j+1}$ of the plurality of third subpixels 403, and the subpixel $R_{i+1,j+1}$ of the plurality of first subpixels 401 emit light, a bright center locates between the subpixel $R_{i+1,j+1}$ of the plurality of first subpixels 401 and subpixel $G_{i,j+1}$ of the plurality of third subpixels 403.

Referring to FIG. 8A, when the j-th row is displaying the horizontal line with the substantially white color, bright centers of the virtual subpixels in the j-th column are in a same straight line. Referring to FIG. 8B, when the i-th column is displaying the vertical line with the substantially white color, bright centers of the virtual subpixels in the i-th row are in a same straight line.

Referring to FIG. 8A and FIG. 8B, blank subpixels do not emit light. And dotted lines with arrow represent subpixel addressing.

Figure 9A:
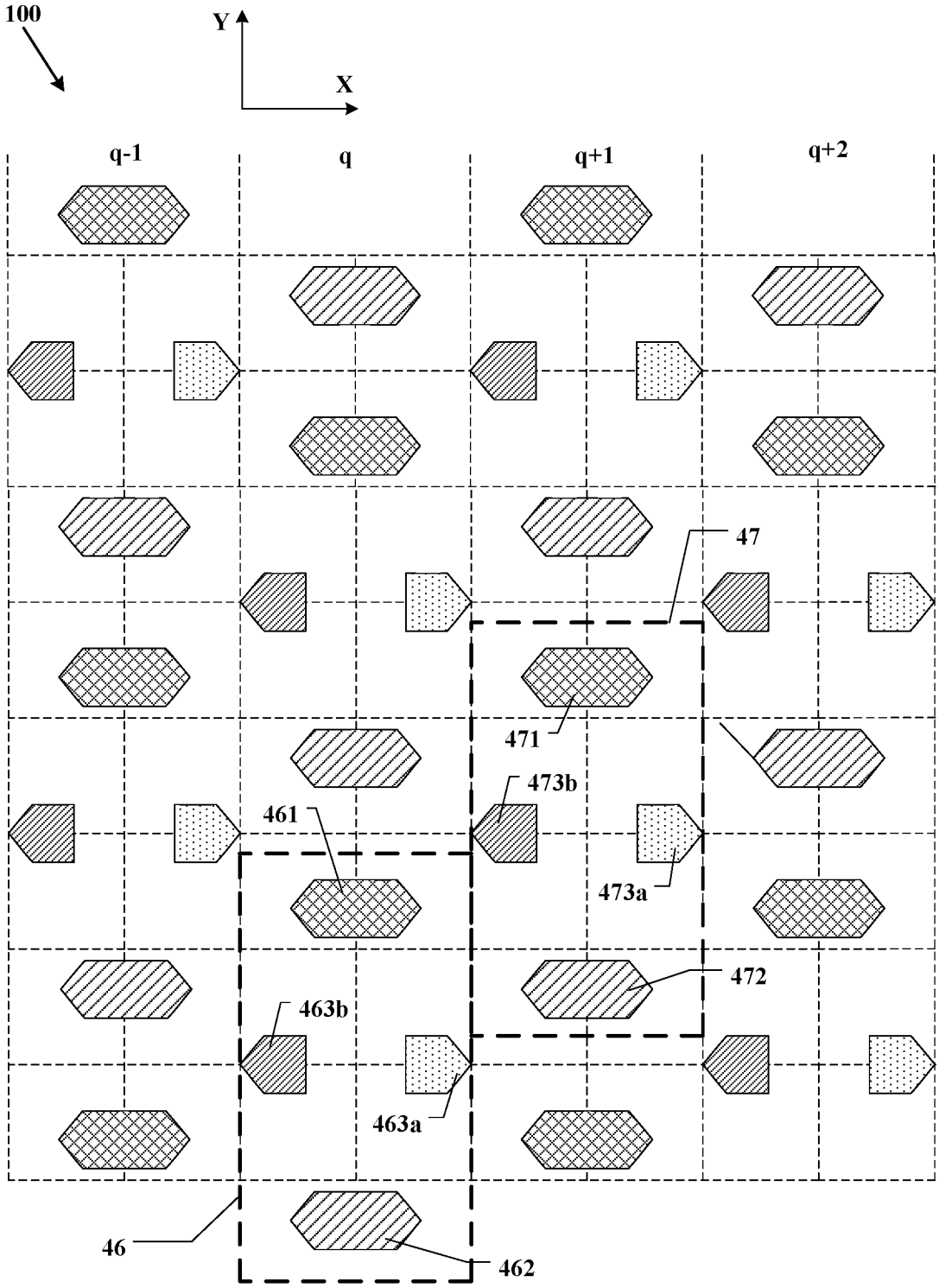
FIG. 9A is a schematic diagram of a partial structure of a pixel arrangement structure in some embodiments according to the present disclosure.

FIG. 9A is a schematic diagram of a partial structure of a pixel arrangement structure in some embodiments according to the present disclosure. FIG. 9B is a schematic diagram of a structure of a respective one of a plurality of minimum translational repeating units in some embodiments according to the present disclosure. FIG. 10 is a flow chart of a method of driving a pixel arrangement structure in some embodiments according to the present disclosure.

In some embodiments, referring to FIG. 9B, a respective one of the plurality of minimum translational repeating units 40 is arranged in an arrangement different from the arrangement of the respective one of the plurality of minimum translational repeating units 40 shown in FIG. 3B and the arrangement shown in FIG. 3C.

In some embodiments, the respective one of the plurality of minimum translational repeating units 40 includes one of the plurality of first subpixels 401, one of the plurality of second subpixels 402, and two of the plurality third subpixels 403 (i.e., one of the plurality of first subpixels 401 is insufficient to constitute the respective one of the plurality of minimum translational repeating units 40; one of the plurality of second subpixels 402 is insufficient to constitute the respective one of the plurality of minimum translational repeating units 40; one of the plurality of third subpixels 403 is insufficient to constitute the respective one of the plurality of minimum translational repeating units 40).

In some embodiments, the plurality of third subpixels 403 are grouped into a plurality of pairs of adjacent third subpixels. For example, a respective one pair of the plurality of pairs of adjacent third subpixels includes a first one 403*a* of a respective one pair of the plurality of pairs of adjacent third subpixels and a second one 403*b* of the respective one pair of the plurality of pairs of adjacent third subpixels.

FIG. 9A shows a partial structure of the pixel arrangement structure 100 having the plurality of minimum translational repeating units 40 shown in FIG. 9B. The plurality of minimum translational repeating units 40 are arranged along the column direction Y and along the row direction X. Optionally, a selected number of minimum translational repeating units of the plurality of minimum translational repeating units 40 arranged in a same column constitute a repeating column of the plurality of repeating columns. For example, FIG. 9A shows four repeating columns, e.g., a (q−1)-th repeating column, a q-th repeating column, a (q+1)-th repeating column, and a (q+2)-th repeating column. q is a positive integer equal to or greater than 2. Optionally, the plurality of repeating columns are arranged along the row direction X.

Optionally, the column direction Y and the row direction X are different directions. Optionally, the column direction Y is perpendicular to the row direction X.

Optionally, referring to FIG. 9A, the q-th repeating column includes a sixth minimum translational repeating unit 46. The (q+1)-th repeating column includes a seventh minimum translational repeating unit 47.

In one example, the sixth minimum translational repeating unit 46 includes a subpixel 463*b* of the plurality of third subpixels 403, a subpixel 461 of the plurality of first subpixels 401, a subpixel 462 of the plurality of second subpixels 402, and a subpixel 463*a* of the plurality of third subpixels 403.

In another example, the seventh minimum translational repeating unit 47 includes a subpixel 473*b* of the plurality of third subpixels 403, a subpixel 471 of the plurality of first subpixels 401, a subpixel 472 of the plurality of second subpixels 402, and a subpixel 473*a* of the plurality of third subpixels 403.

For example, the subpixel 471 of the plurality of first subpixels 401 and the subpixel 473*b* of the plurality of third subpixels 403 both in the seventh minimum translational repeating unit 47 constitute a virtual pixel of the plurality of virtual pixels. The subpixel 472 of the plurality of second subpixels 402 in seventh minimum translational repeating unit 47 and the subpixel 463*a* of the plurality of third subpixels 403 in the sixth minimum translational repeating unit 46 constitutes virtual pixel of the plurality of virtual pixels.

Figure 11:
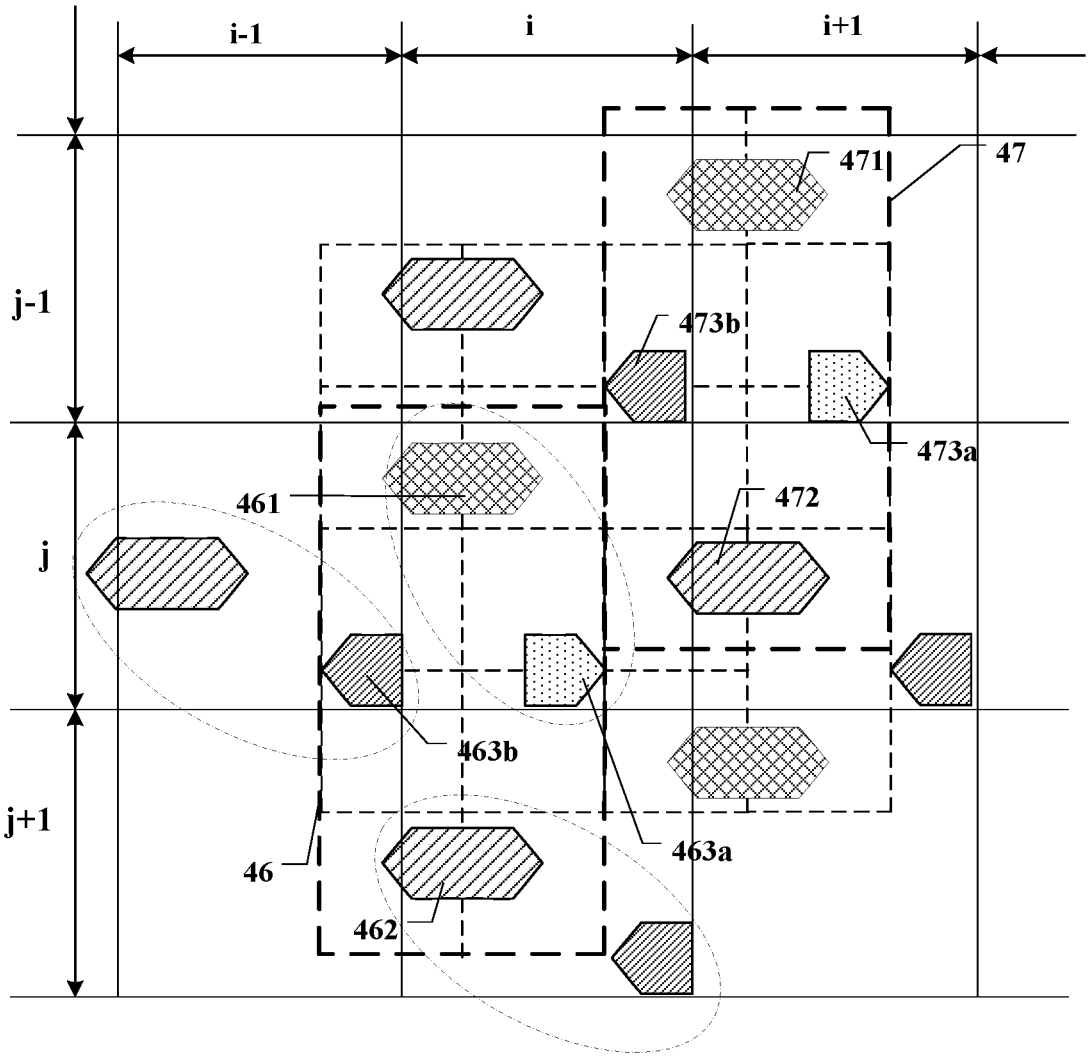
FIG. 11 is a schematic diagram of a partial structure of a pixel arrangement structure in some embodiments according to the present disclosure.

FIG. 11 is a schematic diagram of a partial structure of a pixel arrangement structure in some embodiments according to the present disclosure. Referring to FIG. 11, a plurality of virtual subpixels are arranged in an array along the row direction X and the column direction Y. Optionally, in a same minimum translational repeating unit, a subpixel of the plurality of first subpixels 401 and a subpixel of the two subpixels of the plurality of third subpixels 403 constitutes a virtual pixel in the i-th column and in the j-th row, a subpixel of the plurality of second subpixels 402 is in a virtual pixel in the i-th column and in the (j+1)-th row, the other subpixel of the two subpixels of the plurality of third subpixels 403 is in a virtual pixel in the (i−1)-th column and in the j-th row.

For example, in the sixth minimum translational repeating unit 46, the subpixel 461 of the plurality of first subpixels 401 and the subpixel 463*a* of the plurality of third subpixels 403 constitutes a virtual pixel in the i-th column and in the j-th row, the subpixel 462 of the plurality of second subpixels 402 is in a virtual pixel in the i-th column and in the (j+1)-th row, the subpixel 463*b* of the plurality third subpixels 403 is in a virtual pixel in the (i−1)-th column and j-th row. So, in the sixth minimum translational repeating unit 46, the subpixel 461 of the plurality of first subpixels 401, the subpixel 463*a* of the plurality of third subpixels 403, and the subpixel 463*b* of the plurality third subpixels 403 are in a same row (e.g., the j-th row); the subpixel 462 of the plurality of second subpixels 402 is in (j+1)-th row; the subpixel 461 of the plurality of first subpixels 401, the subpixel 462 of the plurality of second subpixels 402, and the subpixel 463*a* of the plurality of third subpixels 403 are in the same column (e.g., i-th column); the subpixel 463*b* of the plurality third subpixels 403 is in (i−1)-th column.

Optionally, the arrangement of the pixel arrangement structure shown in FIG. 9A is obtained by rotating the arrangement of the pixel arrangement structure shown in FIG. 3A along a clockwise direction for 90 degrees.

FIG. 10 shows a flow chart of a method of driving a pixel arrangement structure. Referring to FIG. 10, in some embodiments, the pixel arrangement structure has a plurality of subpixels including a plurality of first subpixels of a first color, a plurality of second subpixels of a second color, and a plurality of third subpixels of a third color. Optionally, the plurality of third subpixels are arranged in an array of I columns and J rows. Optionally, the pixel arrangement structure includes a plurality of minimum translational repeating units. Optionally, a respective one of the plurality of minimum translational repeating units includes one of the plurality of first subpixels, one of the plurality of second subpixels, and two of the plurality third subpixels.

In some embodiments, the plurality of third subpixels are grouped into a plurality of virtual pixels arranged along a row direction and a column direction. Optionally, the plurality of third subpixels are grouped into a plurality of pairs of adjacent third subpixels. Optionally, a respective one of the plurality of virtual pixels includes a subpixel selected from the respective one of the plurality of pairs of adjacent third subpixels; and a subpixel selected from the respective one of the plurality of first subpixels and the respective one of the second subpixels.

Optionally, a first virtual pixel of the plurality of virtual pixels in the i-th column and in the j-th row of an array of the plurality of virtual pixels includes the subpixel of the plurality of first subpixels in the i-th column and in the j-th row and the subpixel of the plurality of third subpixels in the i-th column and in the j-th row in a same minimum translational repeating unit. Optionally, a second virtual pixel of the plurality of virtual pixels in the i-th column and in the (j+1)-th row of the array of the plurality of virtual pixels includes the subpixel of the plurality of second subpixels in the i-th column and in the (j+1)-th row in the same minimum translational repeating unit. Optionally, a third virtual pixel of the plurality of virtual pixels in the (i−1)-th column and in the j-th row of the array of the plurality of virtual pixels includes the subpixel of the plurality of third subpixels in the (i−1)-th column and in the j-th row in the same minimum translational repeating unit. Optionally, the subpixel of the plurality of third subpixels in the i-th column and in the j-th row and the subpixel of the plurality of third subpixels in the (i−1)-th column and in the j-th row are grouped into one of the plurality of pairs of adjacent third subpixels.

In some embodiments, the method of driving the pixel arrangement structure includes deriving an first actual data signal of a subpixel of the plurality of first subpixels in an i-th column and in a j-th row, based on a theoretical data signal of a first logic subpixel of the first color from a first logic pixel in a (i−1)-th column and in a (j−1)-th row and a theoretical data signal of a first logic subpixel of the first color from a second logic pixel in the i-th column and the (j−1)-th row; deriving a second actual data signal of a subpixel of the plurality of third subpixels in the i-th column and in the j-th row, based on a theoretical data signal of a third logic subpixel of the third color from a third logic pixel in the i-th column and in the j-th row; deriving a third actual data signal of a subpixel of the plurality of second subpixels in the i-th column and in a (j+1)-th row, based on a theoretical data signal of a second logic subpixel of the second color from a fourth logic pixel in the (i−1)-th column and in the (j+1)-th row and a theoretical data signal of a second logic subpixel of the second color from a fifth logic pixel in the i-th column and in the (j+1)-th row; and deriving a fourth actual data signal of a subpixel of the plurality of third subpixels in the (i−1)-th column and in the j-th row, based on a theoretical data signal of a third logic subpixel of the third color from a sixth logic pixel in the (i−1)-th column and in the j-th row; wherein $2 \le i \le I$, $2 \le j \le J$.

Optionally, the first actual data signal of the subpixel of the plurality of first subpixels in the i-th column and in the j-th row is represented by a following equation:

$$X_{i,j} = (\alpha_1 \cdot x_{i-1,j-1}^{\gamma} + \alpha_2 \cdot x_{i,j-1}^{\gamma})^{\frac{1}{\gamma}}; \tag{3.1}$$

wherein $X_{i,j}$ represents the first actual data signal of a subpixel of the plurality of first subpixels in an i-th column and in a j-th row; $x_{i-1,j-1}$ represents the theoretical data signal of the first logic subpixel of the first color from the first logic pixel in the (i−1)-th column and in the (j−1)-th row; $x_{i,j-1}$ represents the theoretical data signal of the first logic subpixel of the first color from the second logic pixel in the i-th column and the (j−1)-th row; $\alpha_1$ represents a weight of the $x_{i-1,j-1}$; $\alpha_2$ represents a weight of the $x_{i,j-1}$; and $\gamma$ is a constant.

Optionally, $\alpha_1$ and $\alpha_2$ have a same value. For example, each of the $\alpha_1$ and the $\alpha_2$ is 0.5. Optionally, $\alpha_1$ and $\alpha_2$ have different values. For example, $\alpha_1$ is 0.4, and $\alpha_2$ is 0.6.

Optionally, the second actual data signal of the subpixel of the plurality of third subpixels in the i-th column and in the j-th row is represented by a following equation:

$$G_{i,j} = g_{i,j} \tag{3.2};$$

wherein $G_{i,j}$ represents the second actual data signal of the subpixel of the plurality of third subpixels in the i-th column and in the j-th row; $g_{i,j}$ represents the theoretical data signal of the third logic subpixel of the third color from the third logic pixel in the i-th column and in the j-th row.

Optionally, the third actual data signal of the subpixel of the plurality of second subpixels in the i-th column and in the (j+1)-th row is represented by a following equation:

$$Y_{i,j+1} = (\beta_1 \cdot y_{i-1,j+1}^{\gamma} + \beta_2 \cdot y_{i,j+1}^{\gamma})^{\frac{1}{\gamma}}; \tag{3.3}$$

wherein $Y_{i,j+1}$ represents third actual data signal of the subpixel of the plurality of second subpixels in the i-th column and in the (j+1)-th row; $y_{i-1,j+1}$ represents the theoretical data signal of the second logic subpixel of the second color from the fourth logic pixel in the (i−1)-th column and in the (j+1)-th row; $y_{i,j+1}$ represents the theoretical data signal of the second logic subpixel of the second color from the fifth logic pixel in the i-th column and in the (j+1)-th row; $\beta_1$ represents a weight of the $y_{i-1,j+1}$; $\beta_2$ represents a weight of the $y_{i,j+1}$; and $\gamma$ is a constant.

Optionally, $\beta_1$ and $\beta_2$ have a same value. For example, each of the $\alpha_1$ and the $\alpha_2$ is 0.5. Optionally, $\beta_1$ and $\beta_2$ have different values. For example, $\beta_1$ is 0.4, and $\beta_2$ is 0.6.

Optionally, the fourth actual data signal of the subpixel of the plurality of third subpixels in the (i−1)-th column and in the j-th row is represented by a following equation:

$$G_{i-1,j} = g_{i-1,j} \tag{3.4};$$

wherein $G_{i-1,j}$ represents the fourth actual data signal of the subpixel of the plurality of third subpixels in the (i−1)-th column and in the j-th row; and $g_{i-1,j}$ represents theoretical data signal of the third logic subpixel of the third color from the sixth logic pixel in the (i−1)-th column and in the j-th row.

In some embodiments, γ represents relations between actual data signals and display brightness. Optionally, γ is 2.2.

In some embodiments, referring to FIG. 9B, in the respective one of the plurality of minimum translational repeating units 40, a subpixel of the plurality of first subpixels 401 and a subpixel of the plurality of second subpixels 402 are arranged along the column direction Y, two subpixels of the plurality of third subpixels 403 are arranged along the row direction X.

In some embodiments, orthographic projections of two subpixels of the plurality third subpixels 403 (e.g., 403*a* and 403*b*) on a plane perpendicular to the row direction X are between orthographic projections of the subpixel of the plurality of first subpixels 401 and the subpixel of the plurality of second subpixels 402 on the plane perpendicular to the row direction X.

In some embodiments, q has an even value. Optionally, columns ranked in odd number of the plurality of repeating columns have a same arrangement and are aligned along the column direction. For example, referring to FIG. 9A, the (q−1)-th repeating column and the (q+1)-th repeating column have a same arrangements. Optionally, columns ranked in even number of the plurality of repeating columns has a same arrangement and are aligned along the column direction. For example, the q-th repeating column and the (q+2)-th repeating column have a same arrangement. Optionally, the columns ranked in odd number of the plurality of repeating columns and the columns ranked in even number of the plurality of repeating columns are misaligned along the column direction.

Optionally, an extension of a center-connecting line connecting central points of a pair of adjacent third subpixel in a minimum translational repeating unit in a respective one of the plurality of repeating columns intersects a midpoint of a center-connecting line connecting a center of a first subpixel, in a direct adjacent repeating columns of the plurality of repeating columns and in direct adjacent to the pair of adjacent third subpixel, and a center of a second subpixel, in the direct adjacent repeating column of the plurality of repeating columns and in direct adjacent to the pair of adjacent third subpixel.

Figure 12A:
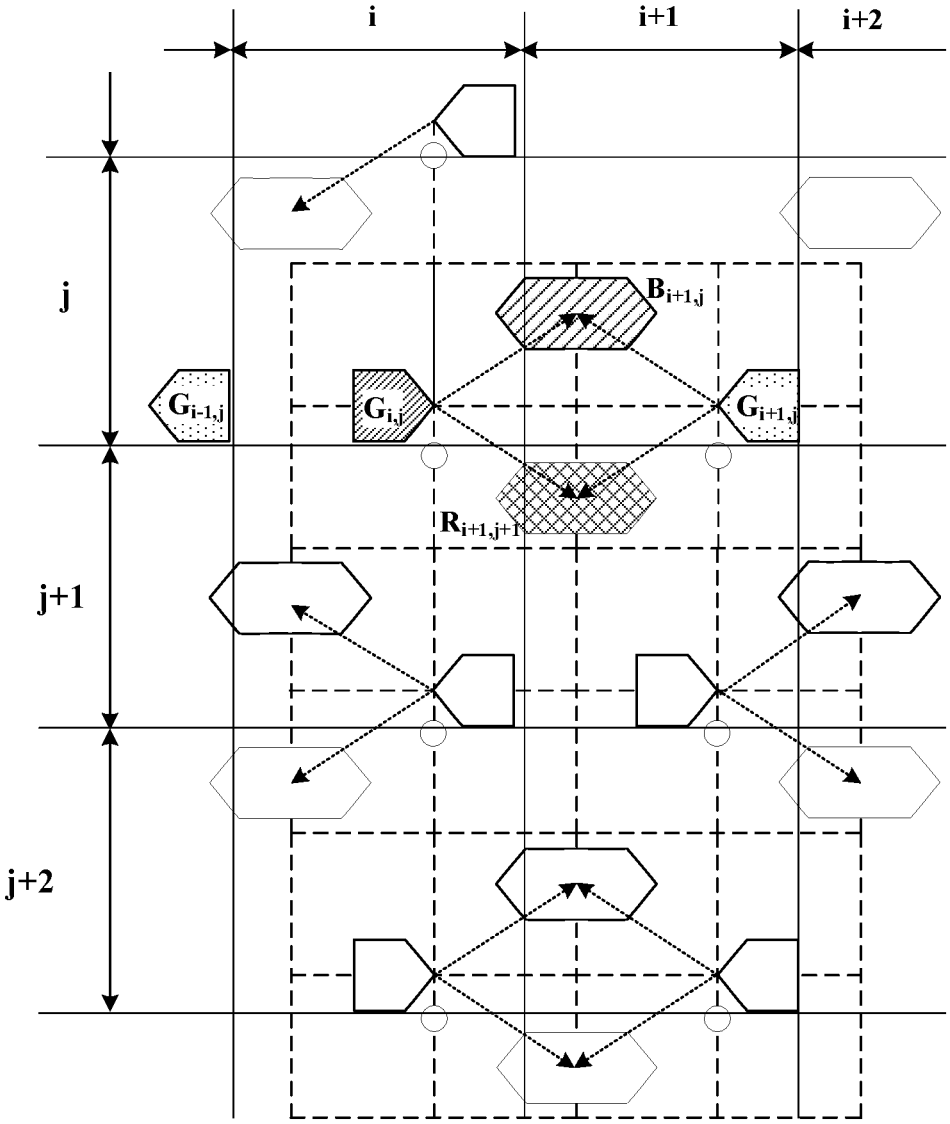
FIG. 12A is a schematic diagram illustrating that a pixel arrangement structure is displaying a horizontal line having a substantially white color using a method of driving a pixel arrangement structure in some embodiments according to the present disclosure.
Figure 12B:
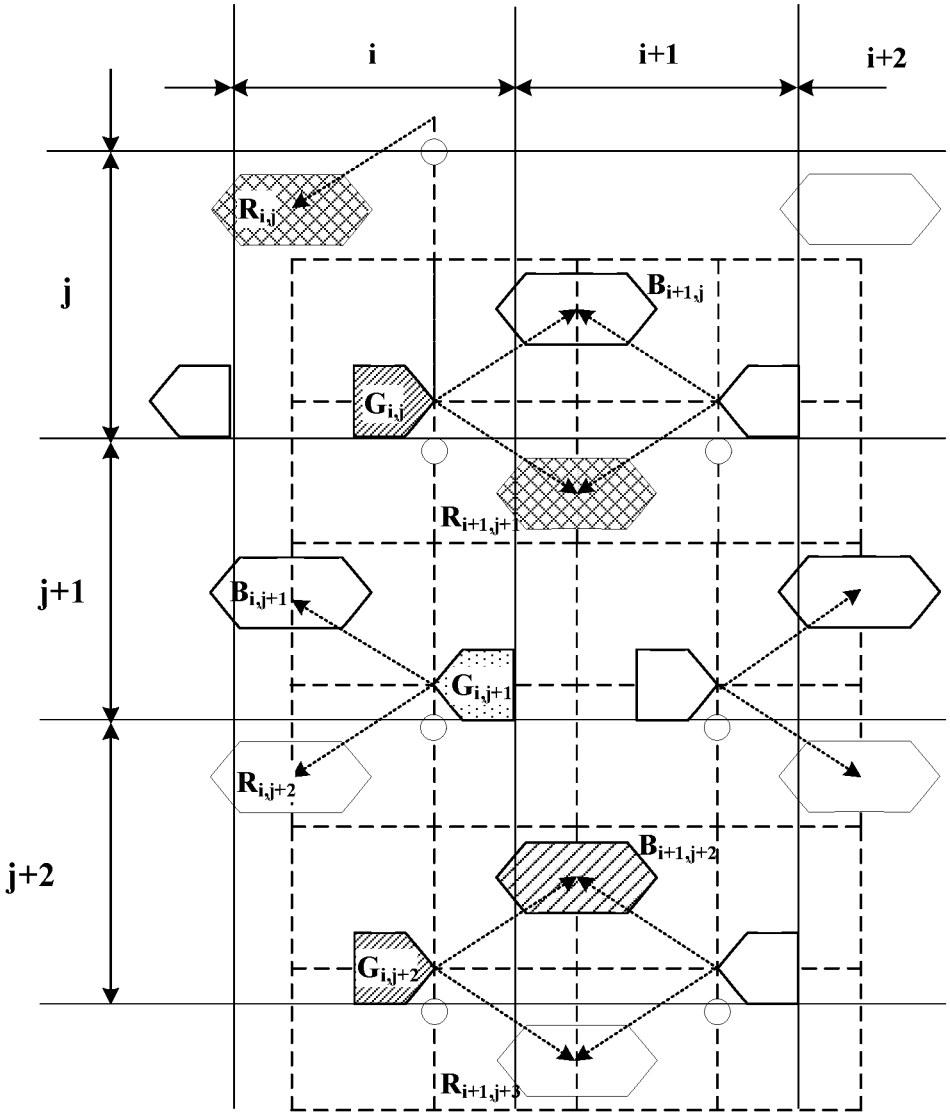
FIG. 12B is a schematic diagram illustrating that a pixel arrangement structure is displaying a vertical line having a substantially white color using a method of driving a pixel arrangement structure in some embodiments according to the present disclosure.

FIG. 12A is a schematic diagram illustrating that a pixel arrangement structure is displaying a horizontal line having a substantially white color using a method of driving a pixel arrangement structure in some embodiments according to the present disclosure. FIG. 12B is a schematic diagram illustrating that a pixel arrangement structure is displaying a vertical line having a substantially white color using a method of driving a pixel arrangement structure in some embodiments according to the present disclosure.

Referring to FIG. 12A, algorithms represented by the equations from (3.1) to (3.4) representing the method of driving the pixel arrangement structure are used to display horizontal line having the substantially white color. Optionally, a horizontal line having the substantially white color is displayed on the j-th row, all the second subpixels and all the third subpixels in the j-th row emit light, and all the first subpixels in the (j+1)-th row emit light.

For example, a subpixels $G_{i-1,j}$ of the plurality of third subpixels 403 in the (i−1)-th column and in the j-th row, a subpixels $G_{i,j}$ of the plurality of third subpixels 403 in the i-th column and in the j-th row, a subpixels $B_{i+1,j}$ of the plurality of second subpixels 402 in the (i+1)-th column and in the j-th row, a subpixel $G_{i+1,j}$ of the plurality of third subpixels 403 in the (i+1)-th column and in the j-th row, and a subpixel $R_{i+1,j+1}$ of the plurality of first subpixels 401 in the (i+1)-th column and in the (j+1)-th row are emit light. Brightness of all the second subpixels and all the third subpixels in the j-th row are 100%. Brightness of all the first subpixels in the (j+1)-th row are 100%. So, the display panel can display the horizontal light having the substantially white color in the j-th row.

Optionally, when the j-th row is displaying the horizontal light having the substantially white color, all the first subpixels in the j-th row do not emit light.

Referring to FIG. 12B, algorithms represented by the equations from (3.1) to (3.4) representing the method of driving the pixel arrangement structure are used to display vertical line having the substantially white color. Optionally, a vertical line having the substantially white color is displayed on the i-th column, all the subpixels in the i-th column emit light, and all the first subpixels and all the second subpixels in the (i+1)-th column are emit light.

For example, the subpixel $R_{i,j}$ of the plurality of first subpixels 401 in the (i+1)-th column and in the (j+1)-th row, the subpixels $G_{i,j}$ of the plurality of third subpixels 403 in the i-th column and in the j-th row, a subpixel $B_{i,j+1}$ of the plurality of second subpixels 402 in the j-th column and in the (j+1)-th row, a subpixel $G_{i,j+1}$ of the plurality of third subpixels 403 in the i-th column and in the (j+1)-th row, a subpixel $R_{i,j+2}$ of the plurality of first subpixels 401 in the i-th column and in the (j+2)-th row, a subpixel of $G_{i,j+2}$ of the plurality of third subpixels 403 in the i-th column and in the (j+2)-th row, the subpixel $B_{i+1,j}$ of the plurality of second subpixels 402 in the (i+1)-th column and in the j-th row, a subpixel $R_{i+1,j+1}$ of the plurality of first subpixels 401 in the (i+1)-th column and in the (j+1)-th row, a subpixel $B_{i+1,j+2}$ of the plurality of second subpixels 402 in the (i+1)-th column and in the (j+2)-th row, a subpixel $R_{i+1,j+3}$ of the plurality of first subpixel 401 in the (i+1)-th column and in the (j+3)-th row emit light.

Optionally, Brightness of all the first subpixels and all the second subpixels in the i-th column are 50% (e.g., grey scales of all the first subpixels and all the second subpixels in the i-th column are 128). Brightness of all the third subpixels in the i-th column are 100% (e.g., grey scales of all the third subpixels in the i-th column are 255). All the first subpixels and all the second subpixels in the (i+1)-th column are 50%. So, the display panel can display the vertical light having the substantially white color in the i-th column.

In some embodiments, referring to FIG. 12A and FIG. 12B, a white circular shape between a first subpixel and a third subpixel represents a bright center of one of the plurality of virtual pixels. A black circular shape P represents a logic bright center of one of the plurality of logic pixels.

Referring to FIG. 12A, when the j-th row is displaying the horizontal line with the substantially white color, bright centers of the virtual subpixels in the j-th column are in a same straight line. Referring to FIG. 12B, when the i-th column is displaying the vertical line with the substantially white color, bright centers of the virtual subpixels in the i-th row are in a same straight line.

In another aspect, the present disclosure also provides a driving chip for driving a pixel arrangement structure having a plurality of subpixels. In some embodiments, referring to FIG. 3A and FIG. 3B, the plurality of subpixels includes a plurality of first subpixels of a first color, a plurality of second subpixels of a second color, and a plurality of third subpixels of a third color. Optionally, the plurality of third subpixels are arranged in an array of I columns and J rows. Optionally, the pixel arrangement structure includes a plurality of minimum translational repeating units. Optionally, a respective one of the plurality of minimum translational repeating units includes one of the plurality of first subpixels, one of the plurality of second subpixels, and two of the plurality third subpixels. Optionally, an arrangement of the respective one of the plurality of minimum translational repeating units are shown in the FIG. 3B.

Figure 13:
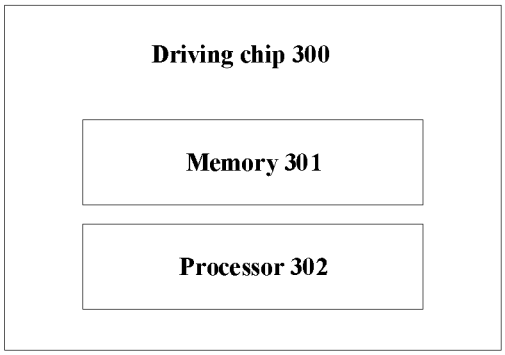
FIG. 13 is a schematic diagram of a structure of a driving chip in some embodiments according to the present disclosure.

FIG. 13 is a schematic diagram of a structure of a driving chip in some embodiments according to the present disclosure. Optionally, referring to FIG. 13, the driving chip 300 includes a memory 301; and one or more processors 302. Optionally, the memory and the one or more processors 302 are connected with each other.

Optionally, referring to FIG. 8A and FIG. 8B, the memory stores computer-executable instructions for controlling the one or more processors to derive an first actual data signal of a subpixel of the plurality of first subpixels in an i-th column and in a j-th row, based on a theoretical data signal of a first logic subpixel of the first color from a first logic pixel in a (i−1)-th column and in a (j−1)-th row and a theoretical data signal of a first logic subpixel of the first color from a second logic pixel in the (i−1)-th column and the j-th row; derive a second actual data signal of a subpixel of the plurality of third subpixels in the i-th column and in the j-th row, based on a theoretical data signal of a third logic subpixel of the third color from a third logic pixel in the i-th column and in the j-th row; derive a third actual data signal of a subpixel of the plurality of second subpixels in an (i+1)-th column and in the j-th row, based on a theoretical data signal of a second logic subpixel of the second color from a fourth logic pixel in the (i+1)-th column and in the (j−1)-th row and a theoretical data signal of a second logic subpixel of the second color from a fifth logic pixel in the (i+1)-th column and in the j-th row; and derive a fourth actual data signal of a subpixel of the plurality of third subpixels in the i-th column and in the (j−1)-th row, based on a theoretical data signal of a third logic subpixel of the third color from a sixth logic pixel in the i-th column and in the (j−1)-th row; wherein $2 \leq i \leq I$, $2 \leq j \leq J$.

In some embodiments, the present disclosure also provides another driving chip for driving a pixel arrangement structure having a plurality of subpixels, referring to FIG. 9A and FIG. 9B, the plurality of subpixels includes a plurality of first subpixels of a first color, a plurality of second subpixels of a second color, and a plurality of third subpixels of a third color. Optionally, the plurality of third subpixels are arranged in an array of I columns and J rows. Optionally, the pixel arrangement structure includes a plurality of minimum translational repeating units. Optionally, a respective one of the plurality of minimum translational repeating units includes one of the plurality of first subpixels, one of the plurality of second subpixels, and two of the plurality third subpixels. Optionally, an arrangement of the respective one of the plurality of minimum translational repeating units are shown in the FIG. 9B.

Optionally, referring to FIG. 13, the driving chip 300 includes a memory 301; and one or more processors 302. Optionally, the memory and the one or more processors 302 are connected with each other.

Optionally, referring to FIG. 12A and FIG. 12B, the memory stores computer-executable instructions for controlling the one or more processors to derive an first actual data signal of a subpixel of the plurality of first subpixels in an i-th column and in a j-th row, based on a theoretical data signal of a first logic subpixel of the first color from a first logic pixel in a (i−1)-th column and in a (j−1)-th row and a theoretical data signal of a first logic subpixel of the first color from a second logic pixel in the i-th column and the (j−1)-th row; derive a second actual data signal of a subpixel of the plurality of third subpixels in the i-th column and in the j-th row, based on a theoretical data signal of a third logic subpixel of the third color from a third logic pixel in the i-th column and in the j-th row; derive a third actual data signal of a subpixel of the plurality of second subpixels in the i-th column and in a (j+1)-th row, based on a theoretical data signal of a second logic subpixel of the second color from a fourth logic pixel in the (i−1)-th column and in the (j+1)-th row and a theoretical data signal of a second logic subpixel of the second color from a fifth logic pixel in the i-th column and in the (j+1)-th row; and derive a fourth actual data signal of a subpixel of the plurality of third subpixels in the (i−1)-th column and in the j-th row, based on a theoretical data signal of a third logic subpixel of the third color from a sixth logic pixel in the (i−1)-th column and in the j-th row; wherein $2 \leq i \leq I$, $2 \leq j \leq J$.

Various appropriate memory may be used in the present driving chip. Examples of appropriate memory include, but are not limited to, various types of processor-readable media such as random access memory (RAM), read-only memory (ROM), non-volatile random access memory (NVRAM), programmable read-only memory (PROM), erasable programmable read-only memory (EPROM), electrically erasable PROM (EEPROM), flash memory, magnetic or optical data storage, registers, magnetic disk or tape, optical storage media such as compact disk (CD) or DVD (digital versatile disk), and other non-transitory media. Optionally, the memory is a non-transitory memory. Various appropriate processors may be used in the present virtual image display apparatus. Examples of appropriate processors include, but are not limited to, a general-purpose processor, a central processing unit (CPU), a microprocessor, a digital signal processor (DSP), a controller, a microcontroller, a state machine, etc.

Various appropriate processors may be used in the present driving chip. Examples of processors include a central processing unit (CPU), a microprocessor unit (MPU), a microcontroller unit (MCU), an application-specific instruction set processor (ASIP), a graphics processing unit (GPU), physics processing unit (PPU), a digital system processor (DSP), a reduced instruction set (RISC) processor, an image processor, a coprocessor, a floating-point unit, a network processor, a multi-core processor, a front-end processor, a field-programmable gate array (FPGA), a video processing unit, a vision processing unit, a tensor processing unit (TPU), a neural processing unit (NPU), a system on a chip (SOC), and others.

Figure 14:
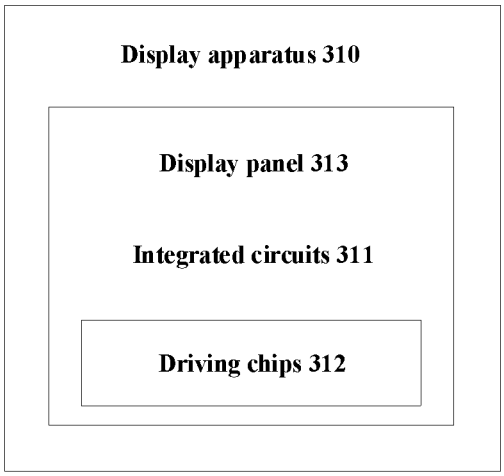
FIG. 14 is a schematic diagram of a structure of a display apparatus in some embodiments according to the present disclosure.

In another aspect, the present disclosure also provides a display apparatus. FIG. 14 is a schematic diagram of a structure of a display apparatus in some embodiments according to the present disclosure. Referring to FIG. 14, the display apparatus 310 includes the driving chip 312 described herein, one or more integrated circuits 311 connected to the driving chip; and the pixel arrangement structure described herein having the plurality of subpixels.

Optionally, the one or more integrated circuits 311 includes data driving circuits. Optionally, the data driving circuits are configured to output data signals. For example, the data signal includes theoretical data signals which corresponds to logic subpixels in the plurality of logic pixels. For example, a respective one of the plurality of logic pixels includes a first logic subpixel, a second logic subpixel, and the third logic subpixel.

Optionally, the driving chip is configured to receive the theoretical data signals, and derive actual data signals based on the received theoretical data signals. The actual data signals corresponds to subpixels in the plurality of virtual pixels.

Optionally, the display apparatus 310 further includes a display panel 313. The pixel arrangement structure is disposed in the display panel 313. Optionally, the display panel 313 is an LCD panel, or an OLED display panel.

Optionally, the one or more integrated circuits 311 and the driving chip 312 can be integrated on the display panel 313. Optionally, the one or more integrated circuits 311 and the driving chip 312 can be connected to the display panel 313 through flexible circuit board.

Optionally, the display apparatus 310 can be any products having a display function, such as a mobile phone, a tablet computer, a television, a display device, a notebook computer, a digital photo frame, a navigator, and etc.

In another aspect, the present disclosure also provides a computer-program product. In some embodiments, the computer-program product includes a non-transitory tangible computer-readable medium having computer-readable instructions thereon. Optionally, the computer-readable instructions are executable by a processor to cause the processor to drive a pixel arrangement structure having a plurality of first subpixels of a first color, a plurality of second subpixels of a second color, and a plurality of third subpixels of a third color. Optionally, the plurality of third subpixels are arranged in an array of I columns and J rows. Optionally, the pixel arrangement structure includes a plurality of minimum translational repeating units. Optionally, a respective one of the plurality of minimum translational repeating units includes one of the plurality of first subpixels, one of the plurality of second subpixels, and two of the plurality third subpixels.

Optionally, referring to FIG. 8A and FIG. 8B, wherein driving the pixel arrangement structure includes executing the computer-readable instructions by the processor to cause the processor to derive an first actual data signal of a subpixel of the plurality of first subpixels in an i-th column and in a j-th row, based on a theoretical data signal of a first logic subpixel of the first color from a first logic pixel in a (i−1)-th column and in a (j−1)-th row and a theoretical data signal of a first logic subpixel of the first color from a second logic pixel in the (i−1)-th column and the j-th row; derive a second actual data signal of a subpixel of the plurality of third subpixels in the i-th column and in the j-th row, based on a theoretical data signal of a third logic subpixel of the third color from a third logic pixel in the i-th column and in the j-th row; derive a third actual data signal of a subpixel of the plurality of second subpixels in an (i+1)-th column and in the j-th row, based on a theoretical data signal of a second logic subpixel of the second color from a fourth logic pixel in the (i+1)-th column and in the (j−1)-th row and a theoretical data signal of a second logic subpixel of the second color from a fifth logic pixel in the (i+1)-th column and in the j-th row; and deriving a fourth actual data signal of a subpixel of the plurality of third subpixels in the i-th column and in the (j−1)-th row, based on a theoretical data signal of a third logic subpixel of the third color from a sixth logic pixel in the i-th column and in the (j−1)-th row; wherein $2 \le i \le I$, $2 \le j \le J$.

Optionally, referring to FIG. 12A and FIG. 12B, driving the pixel arrangement structure including executing the computer-readable instructions the processor to cause the processor to derive an first actual data signal of a subpixel of the plurality of first subpixels in an i-th column and in a j-th row, based on a theoretical data signal of a first logic subpixel of the first color from a first logic pixel in a (i−1)-th column and in a (j−1)-th row and a theoretical data signal of a first logic subpixel of the first color from a second logic pixel in the i-th column and the (j−1)-th row; derive a second actual data signal of a subpixel of the plurality of third subpixels in the i-th column and in the j-th row, based on a theoretical data signal of a third logic subpixel of the third color from a third logic pixel in the i-th column and in the j-th row; derive a third actual data signal of a subpixel of the plurality of second subpixels in the i-th column and in a (j+1)-th row, based on a theoretical data signal of a second logic subpixel of the second color from a fourth logic pixel in the (i−1)-th column and in the (j+1)-th row and a theoretical data signal of a second logic subpixel of the second color from a fifth logic pixel in the i-th column and in the (j+1)-th row; and derive a fourth actual data signal of a subpixel of the plurality of third subpixels in the (i−1)-th column and in the j-th row, based on a theoretical data signal of a third logic subpixel of the third color from a sixth logic pixel in the (i−1)-th column and in the j-th row; wherein $2 \le i \le I$, $2 \le j \le J$.

In another aspect, the present disclosure also provides a pixel arrangement structure includes a plurality of minimum translational repeating units arranged in rows and columns, with each of the minimum translational repeating units including one first subpixel, one second subpixel, and two third subpixels. Optionally, in one minimum translational repeating unit, the two third subpixels are in a column direction and form a third subpixel group. Optionally, the third subpixel group, the first subpixel, and the second subpixel are in a row direction. Optionally, an area of the first subpixel is larger than an area of each of the two third subpixels. Optionally, an area of the second subpixel is larger than the area of each of the two third subpixels. Optionally, two adjacent rows of the minimum translational repeating units in a column direction are staggered.

In some embodiments, for the pixel arrangement structure described herein, a staggered distance in the row direction of the two adjacent rows of the minimum translational repeating units in the column direction is greater than a maximum span in the row direction of a group selected from one or a combination of a first subpixel, a second subpixel and a third subpixel group.

In some embodiments, for the pixel arrangement structure described herein, in one minimum translational repeating unit, a farthest distance in the column direction between the two third subpixels in the third subpixel group is larger than a farthest distance in the column direction of any two points of the first subpixel, and the farthest distance in the column direction between the two third subpixels in the third subpixel group is larger than a farthest distance in the column direction of any two points of the second subpixel.

In some embodiments, for the pixel arrangement structure described herein, in one minimum translational repeating unit, a longest span in the column direction between the two third subpixels in the third subpixel group is larger than a longest span in the column direction of the first subpixel, and the longest span in the column direction between the two third subpixels in the third subpixel group is larger than a longest span in the column direction of the second subpixel.

In some embodiments, for the pixel arrangement structure described herein, adjacent subpixels of one first subpixel do not comprise a first subpixel, and adjacent subpixels of one second subpixel do not comprise a second subpixel.

In some embodiments, for the pixel arrangement structure described herein, in the row and column direction, two first subpixels are separated by other subpixels except a first subpixel, and two second subpixels are separated by other subpixels except a second subpixel, and any two third subpixel groups are separated by other subpixels except a third subpixel group.

In some embodiments, for the pixel arrangement structure described herein, two adjacent minimum translational repeating units in the column direction are arranged as a group selected from one or a combination of: one third subpixel group in one of the two adjacent minimum translational repeating units is between a maximum span in the row direction of one first subpixel and one second subpixel of the other one of the two adjacent minimum translational repeating units; one first subpixel in one of the two adjacent minimum translational repeating units is between a maximum span in the row direction of one third subpixel group and one second subpixel of the other one of the two adjacent minimum translational repeating units; and one second subpixel in one of the two adjacent minimum translational repeating units is between a maximum span in the row direction of one first subpixel and one third subpixel group of the other one of the two adjacent minimum translational repeating units.

In some embodiments, for the pixel arrangement structure described herein, in one minimum translational repeating unit, two third subpixels, one first subpixel and one second subpixel are arranged as a group selected from one or a combination of: a minimum distance in the column direction of the two third subpixels is less than a maximum span in the column direction of the one first subpixel; and a minimum distance in the column direction of the two third subpixels is less than a maximum span in the column direction of the one second subpixel.

In some embodiments, for the pixel arrangement structure described herein, in three adjacent rows of the plurality of the minimum translational repeating units, the three adjacent rows includes a first row, a second row, and a third row in this order along the column direction. Optionally, subpixels in the first row is arranged substantially the same as subpixels in the third row.

In some embodiments, for the pixel arrangement structure described herein, in three adjacent rows of the plurality of the minimum translational repeating units, the three adjacent rows including a first row, a second row, and a third row in this order along the column direction. Optionally, a shortest distance in the column direction between two centers of the two third subpixels in the third subpixel group is shorter than a shortest distance in the column direction between a center of a third subpixel in the first row and a center of a third subpixel in the third row.

In some embodiments, for the pixel arrangement structure described herein, sides of the first subpixel in the column direction are arranged in parallel with sides of the second subpixel in the column direction.

In some embodiments, for the pixel arrangement structure described herein, the third subpixel is a green pixel, the first subpixel is one of a red pixel or a blue pixel, and the second subpixel is the other of the red pixel or the blue pixel.

In some embodiments, for the pixel arrangement structure described herein, orders of the third subpixel group, the first subpixel and the second subpixel in each minimum translational repeating unit are the same.

In some embodiments, for the pixel arrangement structure described herein, in one minimum translational repeating unit, a longest span in the column direction between the two third subpixels in the third subpixel group is larger than a longest span in the column direction of the first subpixel. Optionally, the longest span in the column direction between the two third subpixels in the third subpixel group is larger than a longest span in the column direction of the second subpixel.

In some embodiments, for the pixel arrangement structure described herein, adjacent subpixels of one first subpixel do not include a first subpixel, and adjacent subpixels of one second subpixel do not include a second subpixel.

In some embodiments, for the pixel arrangement structure described herein, in the row and column direction, two first subpixels are separated by other subpixels except a first subpixel, and two second subpixels are separated by other subpixels except a second subpixel, and any two third subpixel groups are separated by other subpixels except a third subpixel group.

In some embodiments, for the pixel arrangement structure described herein, two adjacent minimum translational repeating units in the column direction are arranged as a group selected from one or a combination of: one third subpixel group in one of the two adjacent minimum translational repeating units is between a maximum span in the row direction of one first subpixel and one second subpixel of the other one of the two adjacent minimum translational repeating units; one first subpixel in one of the two adjacent minimum translational repeating units is between a maximum span in the row direction of one third subpixel group and one second subpixel of the other one of the two adjacent minimum translational repeating units; and one second subpixel in one of the two adjacent minimum translational repeating units is between a maximum span in the row direction of one first subpixel and one third subpixel group of the other one of the two adjacent minimum translational repeating units.

In some embodiments, for the pixel arrangement structure described herein, in one minimum translational repeating unit, two third subpixels, one first subpixel and one second subpixel are arranged as a group selected from one or a combination of: a minimum distance in the column direction of the two third subpixels is less than a maximum span in the column direction of the one first subpixel; and a minimum distance in the column direction of the two third subpixels is less than a maximum span in the column direction of the one second subpixel.

In another aspect, the present disclosure also provides a display substrate including the pixel arrangement structure described herein.

In another aspect, the present disclosure also provides a display apparatus including the display substrate described herein.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A display apparatus, comprising a plurality of subpixels, the plurality of subpixels comprising a plurality of first subpixels, a plurality of second subpixels, and a plurality of third subpixels;

wherein the plurality of third subpixels are arranged in an array of I columns and J rows; and the display apparatus comprises a plurality of repeating units, a respective repeating unit of the plurality of repeating units comprising one of the plurality of first subpixels, one of the plurality of second subpixels, and two of the plurality third subpixels;

the two of the plurality third subpixels in the respective repeating unit are arranged along a first direction, the one of the plurality of first subpixels and the one of the plurality of second subpixels in the respective repeating unit are arranged along a second direction, or the two of the plurality third subpixels in the respective repeating unit are arranged along the second direction, the one of the plurality of first subpixels and the one of the plurality of second subpixels in the respective repeating unit are arranged along the first direction, the first direction and the second direction are non-parallel to each other;

the plurality of repeating units are arranged along the first direction, forming multiple repeating groups, the multiple repeating group arranged along the second direction;

the display apparatus comprises a plurality of virtual pixels, a respective virtual pixel comprises a respective third subpixel of the plurality third subpixels, and at least one of a respective first subpixel of plurality of first subpixels or a respective second subpixel of the plurality of second subpixels;

the plurality of virtual pixels are arranged in an array comprising a plurality of rows of virtual pixels arranged along the first direction and a plurality of columns of virtual pixels arranged along the second direction;

the two of the plurality third subpixels in the respective repeating unit are in two adjacent rows of virtual pixels, respectively, and in a same column of virtual pixels, a first virtual pixel comprising at least one third subpixel belonging to a first adjacent repeating group of the multiple repeating group and a second virtual pixel comprising at least one third subpixel belonging to a second adjacent repeating group of the multiple repeating group are in a same column of virtual pixels, the first adjacent repeating group and the second adjacent repeating group directly adjacent to each other; and the display apparatus further comprises a driving circuit configured to drive image display according to the array of virtual pixels, at least a virtual pixel shares a first subpixel or a second subpixel belonging to an adjacent virtual pixel so that when the virtual pixel is driven to display image, the first subpixel or the second subpixel belonging to the adjacent virtual pixel also emits light;

wherein the one of the plurality of first subpixels in the respective repeating unit is a first subpixel in an i-th column and in a j-th row, the one of the plurality of second subpixels in the respective repeating unit is a second subpixel in an (i+1)-th column and in the j-th row, the two of the plurality third subpixels in the respective repeating unit are a third subpixel in the i-th column and in a (j−1)-th row and a third subpixel in the i-th column and in the j-th row, respectively; and the two of the plurality third subpixels in the respective repeating unit belong to a virtual pixel in the i-th column and in the j-th row and a virtual pixel in the i-th column and in a (j−1)-th row, respectively, the one of the plurality of first subpixels in the respective repeating unit belongs to a virtual pixel in an (i−1)-th column and in the (j−1)-th row, the one of the plurality of second subpixels in the respective repeating unit belongs to a virtual pixel in the (i+1)-th column and in the j-th row;

wherein the driving circuit is configured to:

derive a first actual data signal of a subpixel of the plurality of first subpixels in an i-th column and in a j-th row, based on a theoretical data signal of a first logic subpixel from a first logic pixel in the (i−1)-th column and in a (j−1)-th row and a theoretical data signal of a first logic subpixel from a second logic pixel in the (i−1)-th column and the j-th row;

derive a second actual data signal of a subpixel of the plurality of third subpixels in the i-th column and in the j-th row, based on a theoretical data signal of a third logic subpixel from a third logic pixel in the i-th column and in the j-th row;

derive a third actual data signal of a subpixel of the plurality of second subpixels in an (i+1)-th column and in the j-th row, based on a theoretical data signal of a second logic subpixel from a fourth logic pixel in the (i+1)-th column and in the (j−1)-th row and a theoretical data signal of a second logic subpixel from a fifth logic pixel in the (i+1)-th column and in the j-th row; and derive a fourth actual data signal of a subpixel of the plurality of third subpixels in the i-th column and in the (j−1)-th row, based on a theoretical data signal of a third logic subpixel from a sixth logic pixel in the i-th column and in the (j−1)-th row;

wherein $2 \le i \le I$ $2 \le j \le J$.

2. The display apparatus of claim 1, wherein the first logic pixel in a (i−1)-th column and in a (j−1)-th row, the second logic pixel in the (i−1)-th column and the j-th row, the third logic pixel in the i-th column and in the j-th row, the fourth logic pixel in the (i+1)-th column and in the (j−1)-th row, the fifth logic pixel in the (i+1)-th column and in the j-th row, and the sixth logic pixel in the i-th column and in the (j−1)-th row, are pixels in a true red-green-blue (RGB) pixel mode;

the theoretical data signal of the first logic subpixel from the first logic pixel in the (i−1)-th column and in the (j−1)-th row is a data signal of a subpixel in the true RGB pixel mode of a same color as the first subpixel in the i-th column and in the j-th row, the subpixel in a first logic pixel corresponding to a virtual pixel comprising the first subpixel in the i-th column and in the j-th row or a virtual pixel sharing the first subpixel in the i-th column and in the j-th row;

the theoretical data signal of the first logic subpixel from the second logic pixel in the (i−1)-th column and the j-th row is a data signal of a subpixel in the true RGB pixel mode of a same color as the first subpixel in the i-th column and in the j-th row, the subpixel in a first logic pixel corresponding to a virtual pixel comprising the first subpixel in the i-th column and in the j-th row or a virtual pixel sharing the first subpixel in the i-th column and in the j-th row;

the theoretical data signal of the third logic subpixel from the third logic pixel in the i-th column and in the j-th row is a data signal of a subpixel in the true RGB pixel mode of a same color as the third subpixel in the i-th column and in the j-th row, the subpixel in a first logic pixel corresponding to a virtual pixel comprising the third subpixel in the i-th column and in the j-th row;

the theoretical data signal of the second logic subpixel from the fourth logic pixel in the (i+1)-th column and in the (j−1)-th row is a data signal of a subpixel in the true RGB pixel mode of a same color as the second subpixel in an (i+1)-th column and in the j-th row, the subpixel in a fourth logic pixel corresponding to a virtual pixel comprising the second subpixel in an (i+1)-th column and in the j-th row or a virtual pixel sharing the second subpixel in an (i+1)-th column and in the j-th row;

the theoretical data signal of the second logic subpixel from the fifth logic pixel in the (i+1)-th column and in the j-th row is a data signal of a subpixel in the true RGB pixel mode of a same color as the second subpixel in an (i+1)-th column and in the j-th row, the subpixel in a fifth logic pixel corresponding to a virtual pixel comprising the second subpixel in an (i+1)-th column and in the j-th row or a virtual pixel sharing the second subpixel in an (i+1)-th column and in the j-th row; and the theoretical data signal of the third logic subpixel from the sixth logic pixel in the i-th column and in the (j−1)-th row is a data signal of a subpixel in the true RGB pixel mode of a same color as the third subpixel in the i-th column and in the (j−1)-th row, the subpixel in a sixth logic pixel corresponding to a virtual pixel comprising the third subpixel in the i-th column and in the (j−1)-th row or a virtual pixel sharing the third subpixel in the i-th column and in the (j−1)-th row.

3. The display apparatus of claim 1, wherein the first actual data signal of the subpixel of the plurality of first subpixels in the i-th column and in the j-th row is represented by a following equation:

$$X_{i,j} = (\alpha_1 \cdot x_{i-1,j-1}^{\gamma} + \alpha_2 \cdot x_{i-1,j}^{\gamma})^{\frac{1}{\gamma}};$$

wherein $X_{i,j}$ represents the first actual data signal of the subpixel of the plurality of first subpixels in the i-th column and in the j-th row; $x_{i-1,j-1}$ represents the theoretical data signal of the first logic subpixel of a first color from the first logic pixel in the (i−1)-th column and in the (j−1)-th row; $x_{i-1,j}$ represents the theoretical data signal of the first logic subpixel of the first color from the second logic pixel in the (i−1)-th column and the j-th row; $\alpha_1$ represents a weight of the $x_{i-1,j-1}$; $\alpha_2$ represents a weight of the $x_{i-1,j}$; and $\gamma$ is a constant;

the second actual data signal of the subpixel of the plurality of third subpixels in the i-th column and in the j-th row is represented by a following equation:

$$G_{i,j}=g_{i,j};$$

wherein $G_{i,j}$ represents the second actual data signal of the subpixel of the plurality of third subpixels in the i-th column and in the j-th row; $g_{i,j}$ represents the theoretical data signal of the third logic subpixel of a third color from the third logic pixel in the i-th column and in the j-th row;

the third actual data signal of the subpixel of the plurality of second subpixels in an (i+1)-th column and in the j-th row is represented by a following equation:

$$Y_{i+1,j} = (\beta_1 \cdot y_{i+1,j-1}^{\gamma} + \beta_2 \cdot y_{i+1,j}^{\gamma})^{\frac{1}{\gamma}};$$

wherein $Y_{i+1,j}$ represents the third actual data signal of the subpixel of the plurality of second subpixels in an (i+1)-th column and in the j-th row; $y_{i+1,j-1}$ represents the theoretical data signal of the second logic subpixel of the second color from the fourth logic pixel in the (i+1)-th column and in the (j−1)-th row; $y_{i+1,j}$ represents the theoretical data signal of the second logic subpixel of the second color from the fifth logic pixel in the (i+1)-th column and in the j-th row; $\beta_1$ represents a weight of the $y_{i+1,j-1}$; $\beta_2$ represents a weight of the $y_{i+1,j}$, and $\gamma$ is a constant;

the fourth actual data signal of the subpixel of the plurality of third subpixels in the i-th column and in the (j−1)-th row is represented by a following equation:

$$G_{i,j-1}=j_{i,j-1};$$

wherein $G_{i,j-1}$ represents the fourth actual data signal of the subpixel of the plurality of third subpixels in the i-th column and in the (j−1)-th row; and $g_{i,j-1}$ represents the theoretical data signal of the third logic subpixel of the third color from the sixth logic pixel in the i-th column and in the (j−1)-th row.

4. The display apparatus of claim 3, wherein each of the $\alpha_1$ and the $\alpha_2$ is 0.5; and each of the $\beta_1$ and the $\beta_2$ is 0.5.

5. The display apparatus of claim 1, wherein the one of the plurality of first subpixels in the respective repeating unit is a first subpixel in an i-th column and in a j-th row, the one of the plurality of second subpixels in the respective repeating unit is a second subpixel in the i-th column and in the (j+1)-th row, the two of the plurality third subpixels in the respective repeating unit are a third subpixel in a (i−1)-th column and in the j-th row and a third subpixel in the i-th column and in the j-th row, respectively; and the two of the plurality third subpixels in the respective repeating unit belong to a virtual pixel in the i-th column and in the j-th row and a virtual pixel in the (i−1)-th column and in the j-th row, respectively, the one of the plurality of first subpixels in the respective repeating unit belongs to a virtual pixel in the (i−1)-th column and in the (j−1)-th row, the one of the plurality of second subpixels in the respective repeating unit belongs to a virtual pixel in the i-th column and in the (j+1)-th row; and in a respective repeating unit, the first subpixel in the i-th column and in the j-th row and the third subpixel in the i-th column and in the j-th row belong to a virtual pixel in the i-th column and in the j-th row, the second subpixel in the i-th column and in the (j+1)-th row belongs to virtual pixel in the i-th column and in the (j+1)-th row, the third subpixel in the (i−1)-th column and in the j-th row belongs to virtual pixel in the (i−1)-th column and in the j-th row.

6. The display apparatus of claim 5, wherein the driving circuit is configured to:

derive a first actual data signal of a subpixel of the plurality of first subpixels in an i-th column and in a j-th row, based on a theoretical data signal of a first logic subpixel from a first logic pixel in a (i−1)-th column and in a (j−1)-th row and a theoretical data signal of a first logic subpixel from a second logic pixel in the i-th column and the (j−1)-th row;

derive a second actual data signal of a subpixel of the plurality of third subpixels in the i-th column and in the j-th row, based on a theoretical data signal of a third logic subpixel from a third logic pixel in the i-th column and in the j-th row;

derive a third actual data signal of a subpixel of the plurality of second subpixels in the i-th column and in the (j+1)-th row, based on a theoretical data signal of a second logic subpixel from a fourth logic pixel in the (i−1)-th column and in the (j+1)-th row and a theoretical data signal of a second logic subpixel from a fifth logic pixel in the i-th column and in the (j+1)-th row; and derive a fourth actual data signal of a subpixel of the plurality of third subpixels in the (i−1)-th column and in the j-th row, based on a theoretical data signal of a third logic subpixel from a sixth logic pixel in the (i−1)-th column and in the j-th row;

wherein $2 \leq i \leq I$, $2 \leq j \leq J$.

7. The display apparatus of claim 6, wherein the first logic pixel in a (i−1)-th column and in a (j−1)-th row, the second logic pixel in the i-th column and the (j−1)-th row, the third logic pixel in the i-th column and in the j-th row, the fourth logic pixel in the (i−1)-th column and in the (j+1)-th row, the fifth logic pixel in the i-th column and in the (j+1)-th row, and the sixth logic pixel in the (i−1)-th column and in the j-th row, are pixels in a true red-green-blue (RGB) pixel mode;

the theoretical data signal of the first logic subpixel from the first logic pixel in the (i−1)-th column and in the (j−1)-th row is a data signal of a subpixel in the true RGB pixel mode of a same color as the first subpixel in the i-th column and in the j-th row, the subpixel in a first logic pixel corresponding to a virtual pixel comprising the first subpixel in the i-th column and in the j-th row or a virtual pixel sharing the first subpixel in the i-th column and in the j-th row;

the theoretical data signal of the first logic subpixel from the second logic pixel in the i-th column and the (j−1)-th row is a data signal of a subpixel in the true RGB pixel mode of a same color as the first subpixel in the i-th column and in the j-th row, the subpixel in a first logic pixel corresponding to a virtual pixel comprising the first subpixel in the i-th column and in the j-th row or a virtual pixel sharing the first subpixel in the i-th column and in the j-th row;

the theoretical data signal of the third logic subpixel from the third logic pixel in the i-th column and in the j-th row is a data signal of a subpixel in the true RGB pixel mode of a same color as the third subpixel in the i-th column and in the j-th row, the subpixel in a first logic pixel corresponding to a virtual pixel comprising the third subpixel in the i-th column and in the j-th row;

the theoretical data signal of the second logic subpixel from the fourth logic pixel in the (i−1)-th column and in the (j+1)-th row is a data signal of a subpixel in the true RGB pixel mode of a same color as the second subpixel in the i-th column and in the (j+1)-th row, the subpixel in a fourth logic pixel corresponding to a virtual pixel comprising the second subpixel in the i-th column and in the (j+1)-th row or a virtual pixel sharing the second subpixel in the i-th column and in the (j+1)-th row;

the theoretical data signal of the second logic subpixel from the fifth logic pixel in the i-th column and in the (j+1)-th row is a data signal of a subpixel in the true RGB pixel mode of a same color as the second subpixel in the i-th column and in the (j+1)-th row, the subpixel in a fifth logic pixel corresponding to a virtual pixel comprising the second subpixel in the i-th column and in the (j+1)-th row or a virtual pixel sharing the second subpixel in the i-th column and in the (j+1)-th row; and the theoretical data signal of the third logic subpixel from the sixth logic pixel in the (i−1)-th column and in the j-th row is a data signal of a subpixel in the true RGB pixel mode of a same color as the third subpixel in the (i−1)-th column and in the j-th row, the subpixel in a sixth logic pixel corresponding to a virtual pixel comprising the third subpixel in the (i−1)-th column and in the j-th row or a virtual pixel sharing the third subpixel in the (i−1)-th column and in the j-th row.

8. The display apparatus of claim 1, wherein the first direction and the second direction are co-planar directions that are substantially perpendicular to each other.

9. The display apparatus of claim 1, wherein adjacent repeating units of the plurality of repeating units are staggered along the first direction.

10. The display apparatus of claim 1, wherein, in a central region of the display apparatus, odd-numbered repeating units have a same arrangement, even-numbered repeating units have a same arrangement, a virtual extension of a line connecting centers of two third subpixels in a same repeating unit of the respective repeating group is between a center of a first subpixel and a center of a second subpixel, the first subpixel and the second subpixel being directly adjacent to the two third subpixels in the same repeating unit, respectively, the first subpixel and the second subpixel being in two adjacent repeating groups directly adjacent to the respective repeating group, respectively.

11. The display apparatus of claim 1, wherein, when the two of the plurality third subpixels in the respective repeating unit are arranged along the first direction, the one of the plurality of first subpixels and the one of the plurality of second subpixels in the respective repeating unit are arranged along the second direction, the two of the plurality third subpixels are between the one of the plurality of first subpixels and the one of the plurality of second subpixels along the second direction;

wherein, when the two of the plurality third subpixels in the respective repeating unit are arranged along the second direction, the one of the plurality of first subpixels and the one of the plurality of second subpixels in the respective repeating unit are arranged along the first direction, the two of the plurality third subpixels are between the one of the plurality of first subpixels and the one of the plurality of second subpixels along the first direction.

12. A display apparatus, comprising a plurality of subpixels, the plurality of subpixels comprising a plurality of first subpixels, a plurality of second subpixels, and a plurality of third subpixels;

wherein the plurality of third subpixels are arranged in an array of I columns and J rows; and the display apparatus comprises a plurality of repeating units, a respective repeating unit of the plurality of repeating units comprising one of the plurality of first subpixels, one of the plurality of second subpixels, and two of the plurality third subpixels;

the two of the plurality third subpixels in the respective repeating unit are arranged along a first direction, the one of the plurality of first subpixels and the one of the plurality of second subpixels in the respective repeating unit are arranged along a second direction, or the two of the plurality third subpixels in the respective repeating unit are arranged along the second direction, the one of the plurality of first subpixels and the one of the plurality of second subpixels in the respective repeating unit are arranged along the first direction, the first direction and the second direction are non-parallel to each other;

the plurality of repeating units are arranged along the first direction, forming multiple repeating groups, the multiple repeating group arranged along the second direction;

the display apparatus comprises a plurality of virtual pixels, a respective virtual pixel comprises a respective third subpixel of the plurality third subpixels, and at least one of a respective first subpixel of plurality of first subpixels or a respective second subpixel of the plurality of second subpixels;

the plurality of virtual pixels are arranged in an array comprising a plurality of rows of virtual pixels arranged along the first direction and a plurality of columns of virtual pixels arranged along the second direction;

the two of the plurality third subpixels in the respective repeating unit are in two adjacent rows of virtual pixels, respectively, and in a same column of virtual pixels, a first virtual pixel comprising at least one third subpixel belonging to a first adjacent repeating group of the multiple repeating group and a second virtual pixel comprising at least one third subpixel belonging to a second adjacent repeating group of the multiple repeating group are in a same column of virtual pixels, the first adjacent repeating group and the second adjacent repeating group directly adjacent to each other; and the display apparatus further comprises a driving circuit configured to drive image display according to the array of virtual pixels, at least a virtual pixel shares a first subpixel or a second subpixel belonging to an adjacent virtual pixel so that when the virtual pixel is driven to display image, the first subpixel or the second subpixel belonging to the adjacent virtual pixel also emits light;

wherein the one of the plurality of first subpixels in the respective repeating unit is a first subpixel in an i-th column and in a j-th row, the one of the plurality of second subpixels in the respective repeating unit is a second subpixel in an (i+1)-th column and in the j-th row, the two of the plurality third subpixels in the respective repeating unit are a third subpixel in the i-th column and in a (j−1)-th row and a third subpixel in the i-th column and in the j-th row, respectively; and in the respective repeating unit, the first subpixel in the i-th column and in the j-th row and the third subpixel in the i-th column and in the j-th row belong to a virtual pixel in the i-th column and in the j-th row, the second subpixel in the (i+1)-th column and in the j-th row belongs to virtual pixel in the (i+1)-th column and in the j-th row, the third subpixel in the i-th column and in the (j−1)-th row belongs to virtual pixel in the i-th column and in the (j−1)-th row;

wherein the driving circuit is configured to:

derive a first actual data signal of a subpixel of the plurality of first subpixels in an i-th column and in a j-th row, based on a theoretical data signal of a first logic subpixel from a first logic pixel in a (i−1)-th column and in a (j−1)-th row and a theoretical data signal of a first logic subpixel from a second logic pixel in the (i−1)-th column and the j-th row;

derive a second actual data signal of a subpixel of the plurality of third subpixels in the i-th column and in the j-th row, based on a theoretical data signal of a third logic subpixel from a third logic pixel in the i-th column and in the j-th row;

derive a third actual data signal of a subpixel of the plurality of second subpixels in an (i+1)-th column and in the j-th row, based on a theoretical data signal of a second logic subpixel from a fourth logic pixel in the (i+1)-th column and in the (j−1)-th row and a theoretical data signal of a second logic subpixel from a fifth logic pixel in the (i+1)-th column and in the j-th row; and derive a fourth actual data signal of a subpixel of the plurality of third subpixels in the i-th column and in the (j−1)-th row, based on a theoretical data signal of a third logic subpixel from a sixth logic pixel in the i-th column and in the (j−1)-th row;

wherein $2 \le i \le I$, $2 \le j \le J$.

13. The display apparatus of claim 12, wherein the first logic pixel in a (i−1)-th column and in a (j−1)-th row, the second logic pixel in the (i−1)-th column and the j-th row, the third logic pixel in the i-th column and in the j-th row, the fourth logic pixel in the (i+1)-th column and in the (j−1)-th row, the fifth logic pixel in the (i+1)-th column and in the j-th row, and the sixth logic pixel in the i-th column and in the (j−1)-th row, are pixels in a true red-green-blue (RGB) pixel mode;

the theoretical data signal of the first logic subpixel from the first logic pixel in the (i−1)-th column and in the (j−1)-th row is a data signal of a subpixel in the true RGB pixel mode of a same color as the first subpixel in the i-th column and in the j-th row, the subpixel in a first logic pixel corresponding to a virtual pixel comprising the first subpixel in the i-th column and in the j-th row or a virtual pixel sharing the first subpixel in the i-th column and in the j-th row;

the theoretical data signal of the first logic subpixel from the second logic pixel in the (i−1)-th column and the j-th row is a data signal of a subpixel in the true RGB pixel mode of a same color as the first subpixel in the i-th column and in the j-th row, the subpixel in a first logic pixel corresponding to a virtual pixel comprising the first subpixel in the i-th column and in the j-th row or a virtual pixel sharing the first subpixel in the i-th column and in the j-th row;

the theoretical data signal of the third logic subpixel from the third logic pixel in the i-th column and in the j-th row is a data signal of a subpixel in the true RGB pixel mode of a same color as the third subpixel in the i-th column and in the j-th row, the subpixel in a first logic pixel corresponding to a virtual pixel comprising the third subpixel in the i-th column and in the j-th row;

the theoretical data signal of the second logic subpixel from the fourth logic pixel in the (i+1)-th column and in the (j−1)-th row is a data signal of a subpixel in the true RGB pixel mode of a same color as the second subpixel in an (i+1)-th column and in the j-th row, the subpixel in a fourth logic pixel corresponding to a virtual pixel comprising the second subpixel in an (i+1)-th column and in the j-th row or a virtual pixel sharing the second subpixel in an (i+1)-th column and in the j-th row;

the theoretical data signal of the second logic subpixel from the fifth logic pixel in the (i+1)-th column and in the j-th row is a data signal of a subpixel in the true RGB pixel mode of a same color as the second subpixel in an (i+1)-th column and in the j-th row, the subpixel in a fifth logic pixel corresponding to a virtual pixel comprising the second subpixel in an (i+1)-th column and in the j-th row or a virtual pixel sharing the second subpixel in an (i+1)-th column and in the j-th row; and the theoretical data signal of the third logic subpixel from the sixth logic pixel in the i-th column and in the (j−1)-th row is a data signal of a subpixel in the true RGB pixel mode of a same color as the third subpixel in the i-th column and in the (j−1)-th row, the subpixel in a sixth logic pixel corresponding to a virtual pixel comprising the third subpixel in the i-th column and in the (j−1)-th row or a virtual pixel sharing the third subpixel in the i-th column and in the (j−1)-th row.

14. A display apparatus, comprising a plurality of subpixels, the plurality of subpixels comprising a plurality of first subpixels, a plurality of second subpixels, and a plurality of third subpixels;

wherein the plurality of third subpixels are arranged in an array of I columns and J rows; and the display apparatus comprises a plurality of repeating units, a respective repeating unit of the plurality of repeating units comprising one of the plurality of first subpixels, one of the plurality of second subpixels, and two of the plurality third subpixels;

the two of the plurality third subpixels in the respective repeating unit are arranged along a first direction, the one of the plurality of first subpixels and the one of the plurality of second subpixels in the respective repeating unit are arranged along a second direction, or the two of the plurality third subpixels in the respective repeating unit are arranged along the second direction, the one of the plurality of first subpixels and the one of the plurality of second subpixels in the respective repeating unit are arranged along the first direction, the first direction and the second direction are non-parallel to each other;

the plurality of repeating units are arranged along the first direction, forming multiple repeating groups, the multiple repeating group arranged along the second direction;

the display apparatus comprises a plurality of virtual pixels, a respective virtual pixel comprises a respective third subpixel of the plurality third subpixels, and at least one of a respective first subpixel of plurality of first subpixels or a respective second subpixel of the plurality of second subpixels;

the plurality of virtual pixels are arranged in an array comprising a plurality of rows of virtual pixels arranged along the first direction and a plurality of columns of virtual pixels arranged along the second direction;

the two of the plurality third subpixels in the respective repeating unit are in two adjacent rows of virtual pixels, respectively, and in a same column of virtual pixels, a first virtual pixel comprising at least one third subpixel belonging to a first adjacent repeating group of the multiple repeating group and a second virtual pixel comprising at least one third subpixel belonging to a second adjacent repeating group of the multiple repeating group are in a same column of virtual pixels, the first adjacent repeating group and the second adjacent repeating group directly adjacent to each other; and the display apparatus further comprises a driving circuit configured to drive image display according to the array of virtual pixels, at least a virtual pixel shares a first subpixel or a second subpixel belonging to an adjacent virtual pixel so that when the virtual pixel is driven to display image, the first subpixel or the second subpixel belonging to the adjacent virtual pixel also emits light;

wherein the one of the plurality of first subpixels in the respective repeating unit is a first subpixel in an i-th column and in a j-th row, the one of the plurality of second subpixels in the respective repeating unit is a second subpixel in the i-th column and in the (j+1)-th row, the two of the plurality third subpixels in the respective repeating unit are a third subpixel in a (i−1)-th column and in the j-th row and a third subpixel in the i-th column and in the j-th row, respectively; and the two of the plurality third subpixels in the respective repeating unit belong to a virtual pixel in the i-th column and in the j-th row and a virtual pixel in the (i−1)-th column and in the j-th row, respectively, the one of the plurality of first subpixels in the respective repeating unit belongs to a virtual pixel in the (i−1)-th column and in the (j−1)-th row, the one of the plurality of second subpixels in the respective repeating unit belongs to a virtual pixel in the i-th column and in the (j+1)-th row;

wherein the driving circuit is configured to:

derive a first actual data signal of a subpixel of the plurality of first subpixels in an i-th column and in a j-th row, based on a theoretical data signal of a first logic subpixel from a first logic pixel in a (i−1)-th column and in a (j−1)-th row and a theoretical data signal of a first logic subpixel from a second logic pixel in the i-th column and the (j−1)-th row;

derive a second actual data signal of a subpixel of the plurality of third subpixels in the i-th column and in the j-th row, based on a theoretical data signal of a third logic subpixel from a third logic pixel in the i-th column and in the j-th row;

derive a third actual data signal of a subpixel of the plurality of second subpixels in the i-th column and in the (j+1)-th row, based on a theoretical data signal of a second logic subpixel from a fourth logic pixel in the (i−1)-th column and in the (j+1)-th row and a theoretical data signal of a second logic subpixel from a fifth logic pixel in the i-th column and in the (j+1)-th row; and derive a fourth actual data signal of a subpixel of the plurality of third subpixels in the (i−1)-th column and in the j-th row, based on a theoretical data signal of a third logic subpixel from a sixth logic pixel in the (i−1)-th column and in the j-th row;

wherein $2 \le i \le I$, $2 \le j \le J$.

15. The display apparatus of claim 14, wherein the first logic pixel in a (i−1)-th column and in a (j−1)-th row, the second logic pixel in the i-th column and the (j−1)-th row, the third logic pixel in the i-th column and in the j-th row, the fourth logic pixel in the (i−1)-th column and in the (j+1)-th row, the fifth logic pixel in the i-th column and in the (j+1)-th row, and the sixth logic pixel in the (i−1)-th column and in the j-th row, are pixels in a true red-green-blue (RGB) pixel mode;

the theoretical data signal of the first logic subpixel from the first logic pixel in the (i−1)-th column and in the (j−1)-th row is a data signal of a subpixel in the true RGB pixel mode of a same color as the first subpixel in the i-th column and in the j-th row, the subpixel in a first logic pixel corresponding to a virtual pixel comprising the first subpixel in the i-th column and in the j-th row or a virtual pixel sharing the first subpixel in the i-th column and in the j-th row;

the theoretical data signal of the first logic subpixel from the second logic pixel in the i-th column and the (j−1)-th row is a data signal of a subpixel in the true RGB pixel mode of a same color as the first subpixel in the i-th column and in the j-th row, the subpixel in a first logic pixel corresponding to a virtual pixel comprising the first subpixel in the i-th column and in the j-th row or a virtual pixel sharing the first subpixel in the i-th column and in the j-th row;

the theoretical data signal of the third logic subpixel from the third logic pixel in the i-th column and in the j-th row is a data signal of a subpixel in the true RGB pixel mode of a same color as the third subpixel in the i-th column and in the j-th row, the subpixel in a first logic pixel corresponding to a virtual pixel comprising the third subpixel in the i-th column and in the j-th row;

the theoretical data signal of the second logic subpixel from the fourth logic pixel in the (i−1)-th column and in the (j+1)-th row is a data signal of a subpixel in the true RGB pixel mode of a same color as the second subpixel in the i-th column and in the (j+1)-th row, the subpixel in a fourth logic pixel corresponding to a virtual pixel comprising the second subpixel in the i-th column and in the (j+1)-th row or a virtual pixel sharing the second subpixel in the i-th column and in the (j+1)-th row;

the theoretical data signal of the second logic subpixel from the fifth logic pixel in the i-th column and in the (j+1)-th row is a data signal of a subpixel in the true RGB pixel mode of a same color as the second subpixel in the i-th column and in the (j+1)-th row, the subpixel in a fifth logic pixel corresponding to a virtual pixel comprising the second subpixel in the i-th column and in the (j+1)-th row or a virtual pixel sharing the second subpixel in the i-th column and in the (j+1)-th row; and the theoretical data signal of the third logic subpixel from the sixth logic pixel in the (i−1)-th column and in the j-th row is a data signal of a subpixel in the true RGB pixel mode of a same color as the third subpixel in the (i−1)-th column and in the j-th row, the subpixel in a sixth logic pixel corresponding to a virtual pixel comprising the third subpixel in the (i−1)-th column and in the j-th row or a virtual pixel sharing the third subpixel in the (i−1)-th column and in the j-th row.

16. The display apparatus of claim 14, wherein the first actual data signal of the subpixel of the plurality of first subpixels in the i-th column and in the j-th row is represented by a following equation:

$$X_{i,j} = (\alpha_1 \cdot x_{i-1,j-1}^{\gamma} + \alpha_2 \cdot x_{i,j-1}^{\gamma})^{\frac{1}{\gamma}};$$

wherein $X_{i,j}$ represents the first actual data signal of the subpixel of the plurality of first subpixels in the i-th column and in the j-th row; $x_{j-1,j-1}$ represents the theoretical data signal of the first logic subpixel of a first color from the first logic pixel in the (i−1)-th column and in the (j−1)-th row; $x_{i1,j-1}$ represents the theoretical data signal of the first logic subpixel of the first color from the second logic pixel in the i-th column and the (j−1)-th row; $\alpha_1$ represents a weight of the $x_{i-1,j-1}$; $\alpha_2$ represents a weight of the $x_{i-1,j}$; and $\gamma$ is a constant;

the second actual data signal of the subpixel of the plurality of third subpixels in the i-th column and in the j-th row is represented by a following equation:

$$G_{i,j}=g_{i,j};$$

wherein $G_{i,j}$ represents the second actual data signal of the subpixel of the plurality of third subpixels in the i-th column and in the j-th row; $g_{i,j}$ represents the theoretical data signal of the third logic subpixel of a third color from the third logic pixel in the i-th column and in the j-th row;

the third actual data signal of the subpixel of the plurality of second subpixels in the i-th column and in the (j+1)-th row is represented by a following equation:

$$Y_{i,j+1} = (\beta_1 \cdot y_{i-1,j+1}^{\gamma} + \beta_2 \cdot y_{i,j+1}^{\gamma})^{\frac{1}{\gamma}};$$

wherein $Y_{i,j+1}$ represents the third actual data signal of the subpixel of the plurality of second subpixels in the i-th column and in the (j+1)-th row; $y_{i-1,j+1}$ represents the theoretical data signal of the second logic subpixel of the second color from the fourth logic pixel in the (i−1)-th column and in the (j+1)-th row; $y_{i,j+1}$ represents the theoretical data signal of the second logic subpixel of the second color from the fifth logic pixel in the i-th column and in the (j+1)-th row; $\beta_1$ represents a weight of the $y_{i-1,j+1}$; $\beta_2$ represents a weight of the $y_{i,j+1}$, and $\gamma$ is a constant;

the fourth actual data signal of the subpixel of the plurality of third subpixels in the (i−1)-th column and in the j-th row is represented by a following equation:

$$G_{i-1,j}=g_{i-1,j};$$

wherein $G_{i-1,j}$ represents the fourth actual data signal of the subpixel of the plurality of third subpixels in the (i−1)-th column and in the j-th row; and $g_{i-1,j}$ represents the theoretical data signal of the third logic subpixel of the third color from the sixth logic pixel in the (i−1)-th column and in the j-th row.

* * * * *